US006302518B1

(12) United States Patent
Kudo et al.

(10) Patent No.: US 6,302,518 B1
(45) **Date of Patent: *Oct. 16, 2001**

(54) LIQUID DISCHARGING HEAD, LIQUID DISCHARGING APPARATUS AND PRINTING SYSTEM

(75) Inventors: Kiyomitsu Kudo, Yokohama; Hiroshi Sugitani, Machida; Kiyomi Aono, Kawasaki; Hiroyuki Ishinaga, Tokyo; Toshio Kashino, Chigasaki; Aya Yoshihira, Yokohama; Yoshie Asakawa, Nagano-ken, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/870,574

(22) Filed: Jun. 6, 1997

(30) Foreign Application Priority Data

| | | |
|---|---|---|
| Jun. 7, 1996 | (JP) | 8-146290 |
| Jul. 12, 1996 | (JP) | 8-183726 |
| Jul. 12, 1996 | (JP) | 8-203149 |

(51) Int. Cl.[7] ..... B41J 2/155; B41J 2/05
(52) U.S. Cl. ..... 347/42; 347/65
(58) Field of Search ..... 347/65, 42, 63

(56) References Cited

U.S. PATENT DOCUMENTS

| | | | |
|---|---|---|---|
| 4,412,224 | 10/1983 | Sugitani . | |
| 4,417,251 | 11/1983 | Sugitani . | |
| 4,437,100 | 3/1984 | Sugitani et al. . | |
| 4,450,455 | 5/1984 | Sugitani et al. . | |
| 4,480,259 | 10/1984 | Kruger et al. | 347/63 |
| 4,509,063 | 4/1985 | Sugitani et al. . | |
| 4,521,787 | 6/1985 | Yokota et al. . | |
| 4,609,427 | 9/1986 | Inamoto et al. . | |
| 4,611,219 | 9/1986 | Sugitani et al. . | |
| 4,666,823 | 5/1987 | Yokota et al. . | |
| 4,723,129 | 2/1988 | Endo et al. . | |
| 4,994,825 | 2/1991 | Saito et al. . | |
| 5,208,604 | 5/1993 | Watanabe et al. . | |
| 5,278,585 | 1/1994 | Karz et al. | 347/65 |
| 5,485,184 | 1/1996 | Sugitani et al. . | |
| 5,821,962 * | 10/1998 | Kudo | 347/65 |
| 5,826,333 * | 10/1998 | Iketani | 347/42 X |
| 5,933,163 * | 8/1999 | Koizumi | 347/42 |

FOREIGN PATENT DOCUMENTS

| | | | |
|---|---|---|---|
| 0 436 047 | 7/1991 | (EP) | B41J/2/055 |
| 0 461 935 | 12/1991 | (EP) | B41J/2/05 |
| 0 461 940 | 12/1991 | (EP) | B41J/2/05 |
| 0 655 337 | 5/1995 | (EP) | B41J/2/205 |
| 0 670 222 | 9/1995 | (EP) | B41J/2/16 |
| 0 761 439 | 3/1997 | (EP) | B41J/2/05 |
| 62-196154 | 8/1987 | (JP) | B41J/3/04 |
| 63-199972 | 8/1988 | (JP) | B41J/3/04 |
| 10-63185 | 3/1989 | (JP) | B41M/5/00 |

* cited by examiner

*Primary Examiner*—Joan Pendegrass
(74) *Attorney, Agent, or Firm*—Fitzpatrick, Cella, Harper & Scinto

(57) ABSTRACT

A liquid discharge head comprises a grooved member including plural discharge ports for discharging liquid, plural grooves for respectively constituting first liquid paths directly communicating with the discharge ports, and a recess for constituting a first common liquid chamber communicating with the plural grooves and serving to supply the first liquid paths with liquid, plural element substrates, each including plural heat generating members for generating bubble in the liquid by giving heat thereto and walls of second liquid paths corresponding to each the heat generating members, and arranged along the direction of array of the discharge ports of the grooved member, and a partition wall positioned between the element substrates and the grooved member, and including, in positions respectively opposed to the heat generating members, plural movable members adapted to respectively displace toward the first liquid paths by the pressure of generation of the bubble.

35 Claims, 33 Drawing Sheets

PRIOR ART FIG. 2
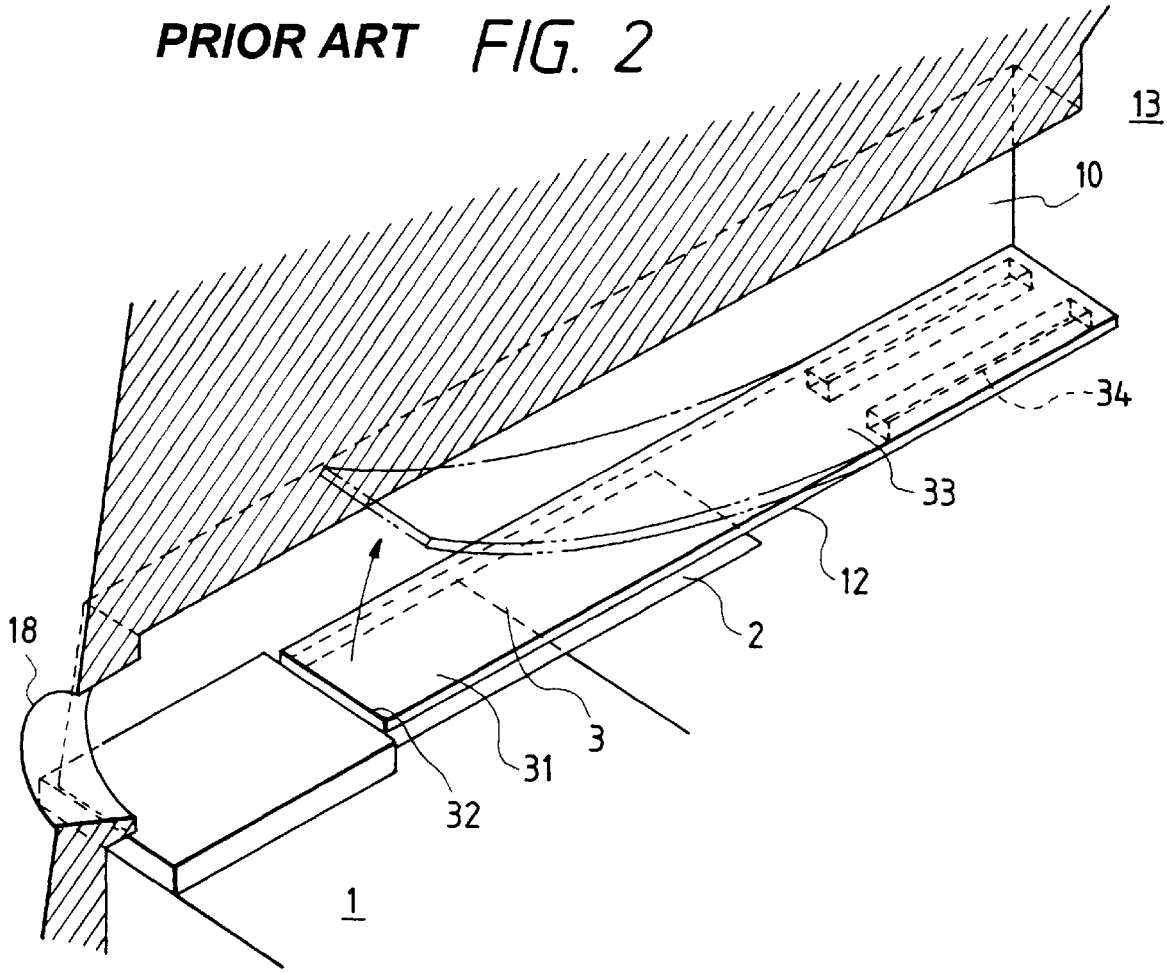
PRIOR ART FIG. 3
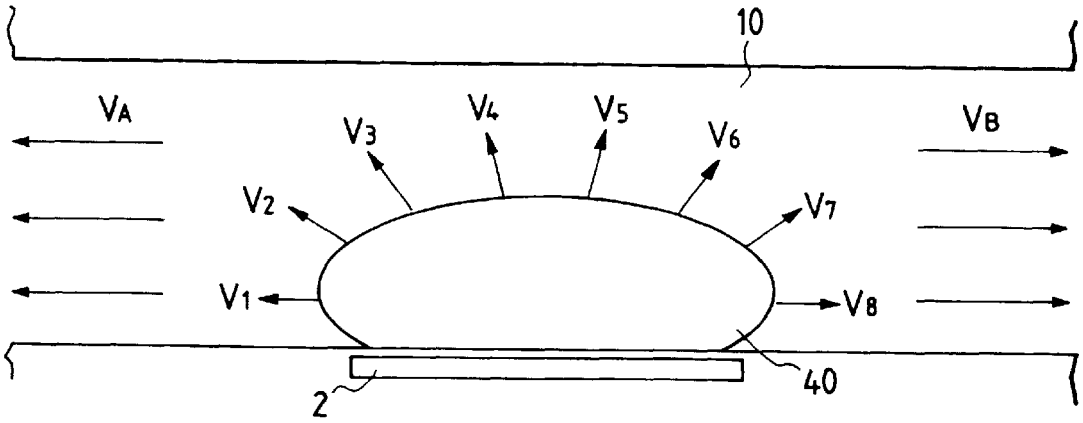

PRIOR ART FIG. 4
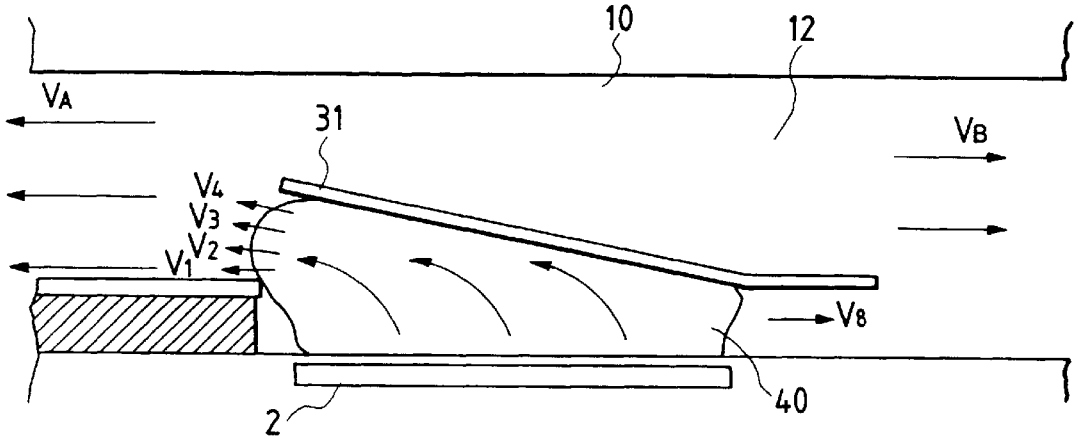
PRIOR ART FIG. 5
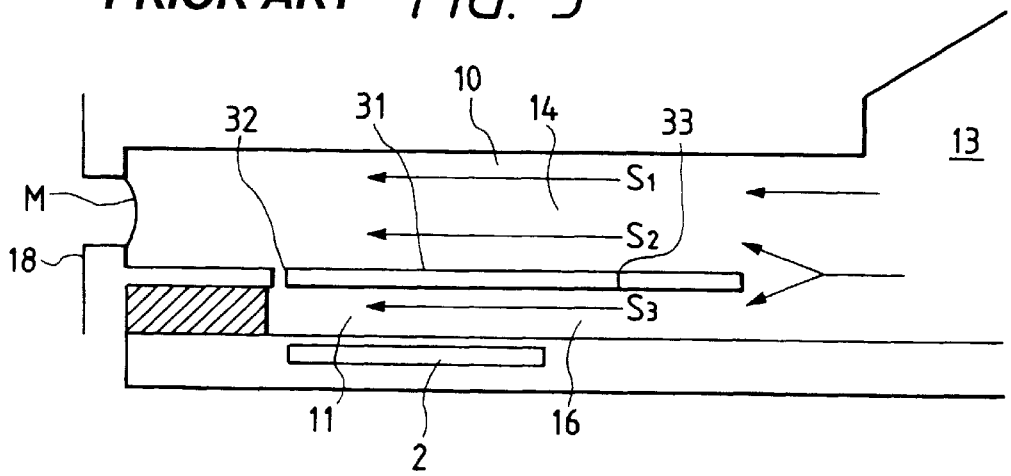

PRIOR ART FIG. 7
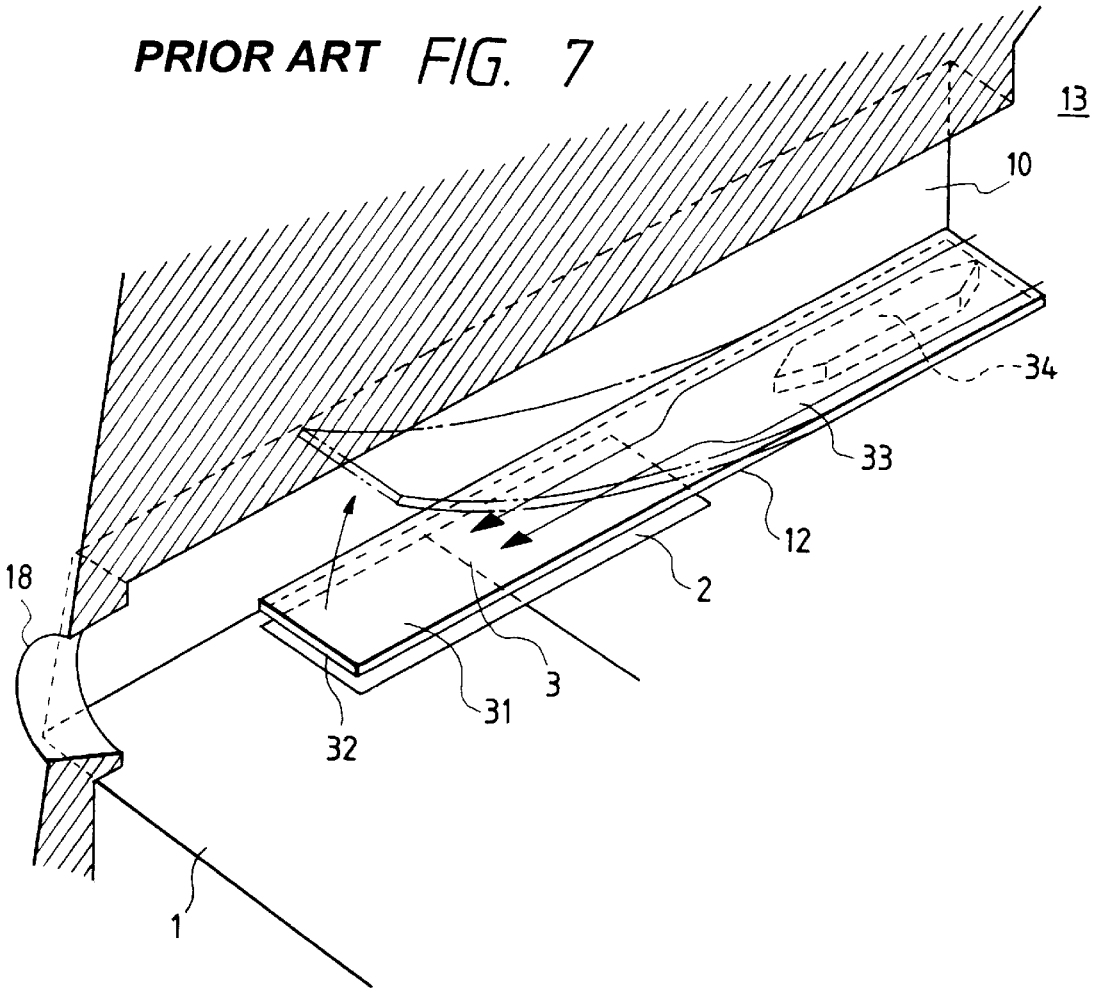
PRIOR ART FIG. 8
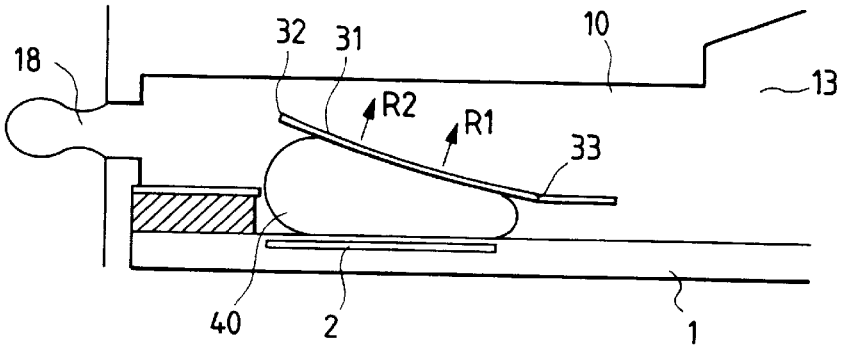

FIG. 12A
PRIOR ART
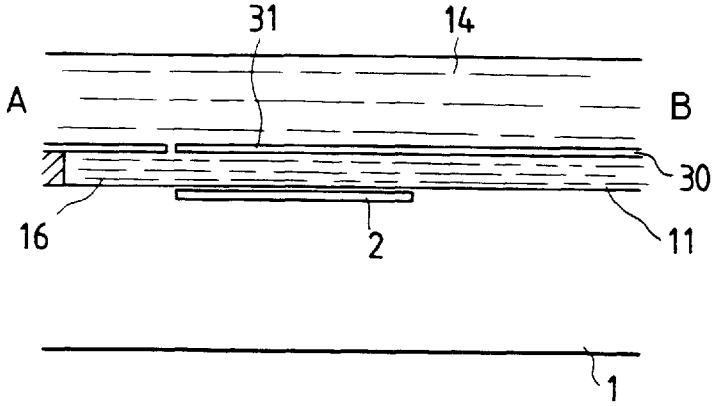
FIG. 12B
PRIOR ART
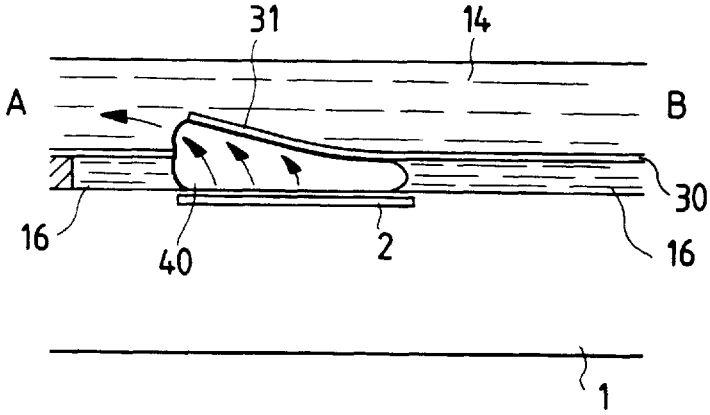
PRIOR ART FIG. 13
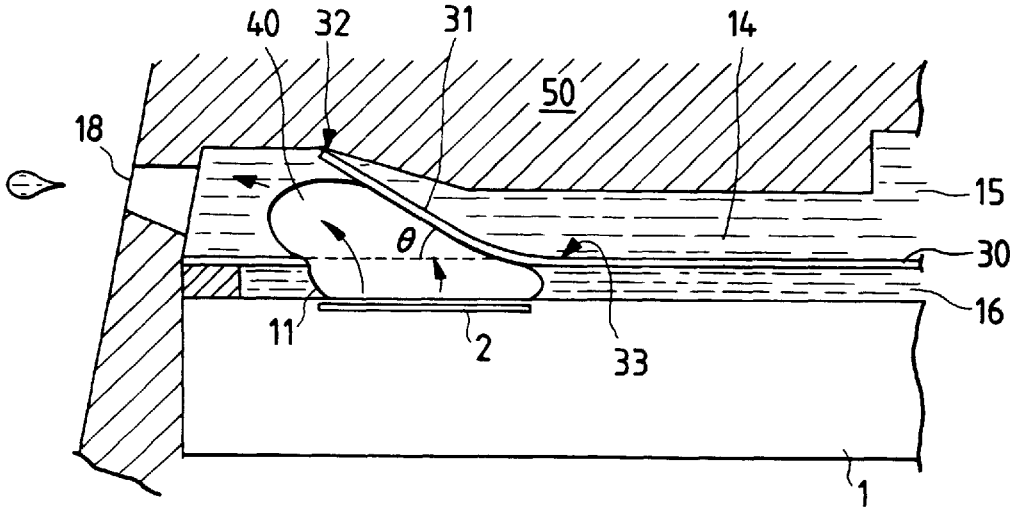

LIQUID DISCHARGING HEAD, LIQUID DISCHARGING APPARATUS AND PRINTING SYSTEM

BACKGROUND OF THE INVENTION

1. Field of the Invention

The present invention relates to a liquid discharging head for discharging desired liquid by bubble generation induced by application of thermal energy to liquid, and a liquid discharging apparatus and a printing system utilizing such liquid discharging head, and more particularly to a liquid discharging head having a movable member which is displaced by bubble generation, and a liquid discharging apparatus utilizing such liquid discharging head.

The present invention is applicable to various apparatus such as a printer for effecting recording on various printing media such as paper, yarn, fiber, fabrics, leather, metal, plastics, glass, timber or ceramics, a copying machine, a facsimile apparatus provided with a communication system, or a word processor having a printer unit, and to an industrial recording apparatus integrally combined with various processing apparatus. "Printing" used in the present invention means not only provision of an image having meaning such as a character or a graphic to the printing medium but also provision of a meaningless image such as a pattern to the printing medium.

2. Related Background Art

There is already known an ink jet printing method, so-called bubble jet printing method, which achieves image formation by providing ink with energy such as heat to induce a state change in the ink, involving a rapid volume change (generation of a bubble), for discharging ink from a discharge port by the action force based on such state change, and for depositing thus discharged ink onto a printing medium. In the printing apparatus utilizing such bubble jet printing method, there are generally provided, as disclosed for example in the U.S. Pat. No. 4,723,129, a discharge port for ink discharge, an ink path communicating with the discharge port, and a heat generating member (electrothermal converting member) provided in the ink path and constituting energy generating means for generating energy for discharging the ink.

Such printing method provides various advantages such as printing an image of high quality at a high speed with a low noise level, and easily obtaining a printed image of a high resolution, including a color image, with a compact apparatus, since, in the printing head utilizing such printing method, ink discharge ports can be arranged at a high density. For this reason, such bubble jet printing method is being recently utilized not only in various office equipment such as printers, copying machines and facsimile apparatus but also in industrial systems such as textile printing apparatus.

With such spreading of the bubble jet printing technology into the products of various fields, there have emerged various requirements to be explained in the following.

For example, for a requirement for improving the efficiency of energy, there is conceived optimization of the heat generating member, such as the adjustment of the thickness of the protective film. This technology is effective in improving the efficiency of propagation of the generated heat to the liquid.

Also for obtaining the image of higher quality, there have been proposed a driving condition for satisfactory liquid discharge, realizing a higher ink discharge speed and stable bubble generation, and an improved shape of the liquid path for realizing a liquid discharge head with a high refilling speed of the discharged liquid into the liquid path.

Among such liquid path shapes, a Liquid path structure shown in FIGS. 34A and 34B is disclosed for example in the Japanese Patent Laid-open Application No. 63-199972. The liquid path structure and the head manufacturing method disclosed in the above-mentioned patent application are based on an invention utilizing a backward wave (pressure directed opposite to the discharge port, namely toward a liquid chamber 12), resulting from the bubble generation.

The invention shown in FIGS. 34A and 34B discloses a valve 10, which is positioned separate from the generation area of the bubble generated by a heat generating element 2 and opposite to the discharge port 11 with respect to the heat generating element 2.

In FIG. 34B, the valve 10 is so disclosed, by a manufacturing method utilizing for example a plate member, as to have an initial position sticking to the ceiling of the liquid path 3 and to hang down into the liquid path 3 with the generation of a bubble. This invention is disclosed to suppress the energy loss by controlling a part of the above-mentioned backward wave by the valve 10.

However, in such structure, the suppression of a part of the backward wave by the valve 10 is not practical for the liquid discharge, as will be made apparent by the consideration of bubble generation in the liquid path 3 containing the liquid to be discharged.

On the other hand, the present inventors already filed a patent application on a line-type liquid discharge head in which discharge ports and electrothermal converting members are arrayed approximately corresponding to the width of the printing medium, and a liquid discharge apparatus utilizing such liquid discharge head. The liquid discharge head disclosed in this patent application is formed by precisely arranging plural heater boards, each having plural electrothermal converting members, on a base plate, and thereon adjoining a cover plate provided at an end thereof with plural ink discharge ports and with plural grooves respectively communicating with the discharge ports and extending from the end to the other end, toward the plural electrothermal converting members so as to close such grooves.

In the liquid discharge head containing an array of the plural heater boards as disclosed by the present inventors, the bubble generating power may leak at the junction of the neighboring heater boards if the cover plate is misaligned in the direction of array of nozzles and a nozzle is positioned at such junction. In such nozzle with leaked bubble generating power, the amount of discharge is reduced to generate a white streak in the printed image, thus deteriorating the image quality thereof.

Also such line-type liquid discharge head may result in fluctuation of the discharge amount, causing unevenness in the image, due to the influence of rear crosstalk, for example depending on the order of driving, and there has been desired a satisfactory printing without defective discharge or without unevenness.

SUMMARY OF THE INVENTION

A first object of the present invention is to provide a liquid discharge head capable of obtaining a high discharge efficiency and a high discharging power even in the line-type liquid discharge head and providing a satisfactory printed image without white streak, and a liquid discharge apparatus and a printing system utilizing such liquid discharge head.

A second object of the present invention is to provide a liquid discharge head capable of satisfactory liquid discharge by significantly reducing the heat accumulation in the liquid on the heat generating member while improving the discharge efficiency and the discharging power and reducing the bubble remaining on the heat generating member, and a liquid discharge apparatus and a printing system utilizing such liquid discharge head.

A third object of the present invention is to provide a liquid discharge head capable of suppressing the inertial force resulting from the backward wave in a direction opposite to the liquid supplying direction and reducing the amount of retraction of meniscus by the valve function of a movable member thereby increasing the refilling frequency and increasing the printing speed, and et liquid discharge apparatus and a printing system utilizing such liquid discharge head.

A fourth object of the present invention is to provide a liquid discharge head capable of reducing the deposition on the heat generating member and expanding the range of application of the liquid to be discharged while maintaining sufficiently high discharge efficiency and discharge force, and a liquid discharge apparatus and a printing system utilizing such liquid discharge head.

The above-mentioned objects can be attained, according to a first aspect of the present invention, by a liquid discharge head comprising:

a grooved member including plural discharge ports for discharging liquid, plural grooves for respectively constituting first liquid paths directly communicating with the discharge ports, and a recess for constituting a first common liquid chamber communicating with the plural grooves for respectively supplying the first liquid paths with the liquid;

plural element substrates respectively provided with plural heat generating members for generating bubbles in the liquid by heat supply thereto and walls of second liquid paths respectively corresponding to the heat generating members, and arranged along the direction of array of the discharge ports of the grooved member; and a partition wall provided between the element boards and the grooved member and provided with plural movable members to be respectively displaced toward the first liquid paths by the pressure of the bubble generation.

The "partition wall" used in the present text means, in a wide sense, a wall (including the movable member) so present as to divide the bubble generating area and an area directly communicating with the discharge port, and, in a narrow sense, a member for separating the liquid path including the bubble generating area and the liquid path directly communicating with the discharge port and avoiding the mixture of liquids present in these areas.

According to a second aspect of the present invention, there is provided a liquid discharge apparatus comprising the liquid discharge head according to the above-mentioned first aspect and drive signal supply means for supplying drive signals for causing the liquid discharge head to discharge liquid.

According to a third aspect of the present invention, there is provided a liquid discharge apparatus comprising the liquid discharge head according to the above-mentioned first aspect and print medium transporting means for transporting a printing medium for receiving the liquid discharged from the liquid discharge head.

According to a fourth aspect of the present invention, there is provided a printing system comprising the liquid discharge apparatus according to the above-mentioned second or third aspect and a post-processing device for accelerating the fixation of the liquid, on the printing medium after the printing operation.

According to a fifth aspect of the present invention, there is provided a printing system comprising the liquid discharge apparatus according to the above-mentioned second or third aspect and a pre-processing device for increasing the fixation of the liquid, on the printing medium before the printing operation.

BRIEF DESCRIPTION OF THE DRAWINGS

FIG. 2 is a partially cut-off perspective view of a liquid discharge head of the present invention;

FIG. 3 is a schematic view showing the pressure propagation from a bubble in a conventional head;

FIG. 4 is a schematic view showing the pressure propagation from a bubble in a head of the present invention;

FIG. 5 is a schematic view showing the liquid flow in the present invention;

FIG. 7 is a partially cut-off perspective view of a liquid discharge head of a third embodiment of the present invention;

FIG. 8 is a cross-sectional view of a liquid discharge head of a fourth embodiment of the present invention;

FIGS. 12A and 12B are views showing the function of a movable member;

FIG. 13 is a view showing the configuration of the movable member and the first liquid path;

FIGS. 41A, 41B and 41C show a seventh embodiment of the present invention, wherein FIG. 41A is a schematic plan view showing the configuration of movable members provided on a substate, FIG. 41B is a chart showing the amount of discharge and FIG. 41C is a chart showing the total amount of discharge;

FIGS. 42A, 42B, 42C, 42D and 42E show the fifth embodiment of the present invention, wherein FIGS. 42A and 42B are schematic plan views showing the configuration of heat generating members and movable members provided on substrates, FIGS. 42C and 42D are charts showing the amount of discharge and FIG. 42E is a chart showing the total amount of discharge.

DESCRIPTION OF THE PREFERRED EMBODIMENTS

Figure 1A:
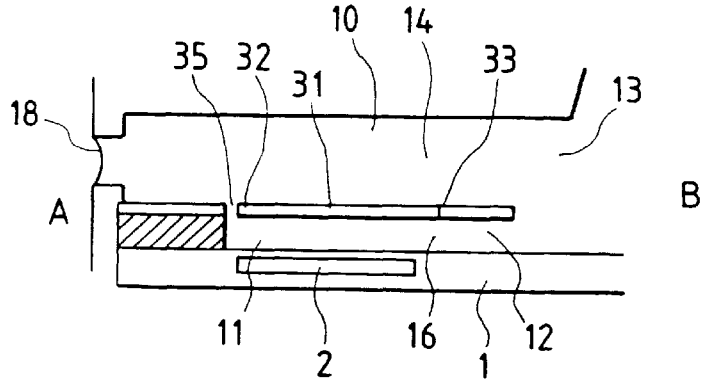
FIG. 1A PRIOR ART
FIGS. 1A, 1B, 1C and ID are schematic cross-sectional views showing an embodiment of the liquid discharge head of the present invention.

In a first embodiment of the present invention, the discharge ports are preferably provided in a number of 500 or larger, and are preferably arranged over the entire width of the printing area, perpendicular to the transporting direction of the printing medium. The partition walls may be composed of a single member positioned over all the element substrates or of plural members positioned respectively corresponding to the element substrates. Also there may be provided plural members of the partition walls, each of which bridges over the two neighboring element substrates. It is also effective to provide a base plate on which the element substrates are adhered, and the free end of the movable member may be positioned at the downstream side of the center of the area of the heat generating member. The grooved member may be further provided with a first introduction path for introducing the liquid into a first common liquid chamber, and a second introduction path for introducing the liquid into a second common chamber. In such case the second introduction path is preferably provided in plural units, and the ratio of the cross section of the first introduction path and that of the second introduction path is preferably in proportion to the ratio of the supply amounts of the respective liquids, and the second introduction path may be so constructed as to supply the second common liquid chamber with the liquid through the partition wall. Also the liquid supplied to the first common liquid chamber may be same as or different from the liquid supplied to the second common liquid chamber, and, in the latter case, the liquid supplied to the second common liquid chamber is desirably superior in at least one of the lower viscosity, bubble generating ability and thermal stability, in comparison with the liquid supplied to the first common liquid chamber. Furthermore, the heat generating member is preferably an electrothermal converting member including a heat-generating resistance member which generates heat in response to a received electrical signal, and, in such case, the electrothermal converting member may be composed of a heat-generating resistance member provided thereon with a protective film, or may be provided, on the element substrate, with a wiring for transmitting the electrical signal to the electrothermal converting member and a functional element for selectively supplying the electrothermal converting members with electrical signals. In the bubble generating area or in the area of the heat generating member, the second liquid path may be formed as a chamber or may have a constricted portion in the upstream side of the bubble generating area or the heat generating member. Also the distance from the surface of the heat generating member to the movable member is desirably 30 $\mu$m or less, and the liquid discharged from the discharge ports may be ink.

The expression "upstream" used in the present text refers to the direction of flow of the liquid from the supply source thereof toward the discharge port through the bubble generation area (or the movable member), or to the direction of the same sense in the configuration.

Also the expression "downstream side" relating to the bubble itself represents a part of the bubble in the side of the discharge port, considered to directly contribute to the discharge of liquid droplet. More specifically, it means a part of the bubble generated in the downstream side in the liquid flow direction or in the above-mentioned configuration with respect to the center of the bubble, or the bubble generated in the area of the downstream side with respect to the center of area of the heat generating member.

In a second or third embodiment of the present invention, the print may be made by discharging ink from the liquid discharge head and depositing ink on a printing paper, or on textile, or on plastics, or on a metal, or on a timber, or on a leather. Also a color print may be made by discharging printing liquids of plural colors from the liquid discharge head and depositing such printing liquids onto the printing medium. Also desirably a plurality of discharge ports are provided over the entire width of the printing area of the printing medium.

Prior to the description of the examples of the present invention, there will be explained, in first to sixth embodiments, the configuration of the liquid discharge head in which the present invention is advantageously applicable, namely in which a movable member is provided in the liquid path for improving the discharge power, discharge efficiency and refilling ability.

First Embodiment

The first embodiment explains the improvement in the discharge power and the discharge efficiency, by controlling the propagating direction of the pressure resulting from the bubble generation or the bubble growing direction, for the liquid discharge.

Figure 1B:
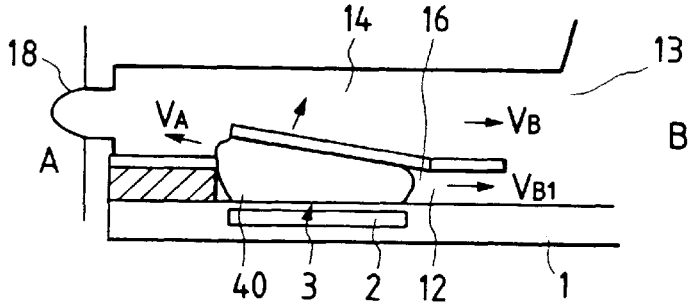
FIG. 1B PRIOR ART
Figure 1C:
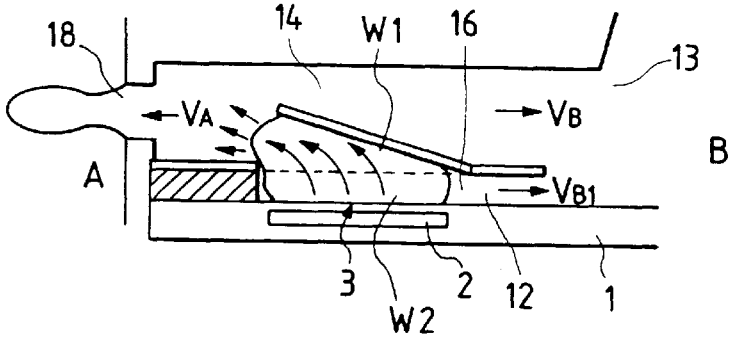
FIG. 1C PRIOR ART

FIGS. 1A, 1B, 1C and iD are schematic cross-sectional views, along the liquid path, of a liquid discharge head of such first embodiment, and FIG. 2 is a partially cut-off perspective view thereof.

In the liquid discharge head of the present embodiment, a heat generating member 2 (a heat generating resistance member of a size of 40×105 $\mu$m in the present embodiment), applying thermal energy to the liquid and constituting the element for generating energy for liquid discharge, is provided on an element substrate 1, and a liquid path 10 is formed on the element substrate 1, corresponding to the heat generating member 2. The liquid path 10 communicates with a discharge port 18 and also communicates with a common liquid chamber 13 for supplying plural liquid paths 10 with the liquid, and receives, from the common liquid chamber 13, the liquid of an amount corresponding to that discharged from the discharge port 18.

On the element substrate 1 of the liquid path 10, a plate-shaped planar movable member 31, composed of an elastic material such as metal, is provided in the form of a beam supported at an end, so as to oppose to the heat generating member 2. An end of the movable member 31 is fixed on a support member 34, formed by patterning photosensitive resin or the like on the wall of the liquid path 10 or on the element substrate 1. Such support member supports the movable member 31 and constitutes a fulcrum portion 33.

The movable member 31 is provided in a position opposed to the heat generating member 2, with a distance of about 15 $\mu$m therefrom, so as to cover the heat generating member 2, in such a manner as to have the fulcrum (fixed end) 33 at the upstream side of the major flow from the common liquid chamber 13 to the discharge port 18 through the movable member 31 induced by the liquid discharging operation, and a free end 32 at the downstream side of the fulcrum 33. A space between the heat generating member 2 and the movable member 31 constitutes the bubble generating area. The kind, shape and arrangement of the heat generating member 2 and the movable member 31 are not limited to those explained above but may be so arbitrarily selected as to control the bubble growth and the pressure propagation as will be explained in the following. Also for facilitating the following description of the liquid flow, the liquid path 10 will be divided by the movable member 31 in a. state shown in FIGS. 1A and 1B, into a first liquid path 14 constituting a part communicating with the discharge port 18, and a second liquid path 16 including the bubble generating area 11 and the liquid supply chamber 12.

Heat generated by the heat generating member 2 is applied to the liquid present in the bubble generating area 11 between the movable member 31 and the heat generating member 2, thus generating a bubble in the liquid, based on a film boiling phenomenon, as described in the U.S. Pat. No. 4,723,129. The bubble and the pressure resulting from the generation thereof act preferentially on the movable member 31 through the liquid, whereby the movable member 31 displaces to open toward the discharge port 18 about the fulcrum 33, as shown in FIGS. 1B, 1C and 2. By the displacement of the movable member 31 or in the displaced state thereof, the propagation of the pressure resulting from the bubble generation and the growth of the bubble itself are transmitted toward the discharge port 18.

Now there will be explained on of the basic discharging principles of the present embodiment. In the present embodiment, one of the most important principles is that the movable member 31, so positioned as to oppose to the bubble, is displaced with the growth of the bubble from a first position in the stationary state to a second position after the maximum displacement by the pressure of the bubble, prior to the contact of the bubble with the movable member 31, and that the movable member 31 comes into contact, in a part of the elastic returning period from the second position at the maximum displacement, with the bubble in the course of growth, whereby the movable member 31 in the returning displacement guides the pressure resulting from the bubble generation and the bubble itself toward the downstream side where the discharge port 18 is located.

This principle will be explained in further details, with reference to FIG. 3 showing the configuration of the conventional liquid path without the movable member 31 and FIG. 4 showing the configuration of the present embodiment, wherein $V_A$ stands for the pressure propagating direction toward the discharge port 18, and $V_B$ stands for that toward the upstream side.

The conventional head as shown in FIG. 3 lacks any configuration limiting the propagating direction of the pressure resulting from the generated bubble 40. Consequently the pressure propagates in various directions, respectively perpendicular to the surface of the bubble 40, as indicated by $V_1$–$V_8$. Among these directions, those having a component in the pressure propagating direction $V_A$ showing the largest influence on the liquid discharge are $V_1$–$V_4$, which are generated in an about a half, closer to the discharge port 18, of the bubble, and which constitute an important portion directly contributing to the liquid discharge efficiency, the liquid discharge power and the liquid discharge speed. The direction $V_1$ is most efficient as it is closest to the discharge direction $V_A$, but $V_4$ contains a relatively small component in the direction $V_A$.

On the other hand, in the configuration of the present embodiment shown in FIG. 4, the movable member 31 in the course of the returning displacement aligns the pressure propagating directions $V_1$–$V_4$, which are in various directions in the configuration shown in FIG. 3, toward the downstream side (toward the discharge port 18), namely in the propagating direction $V_A$, whereby the pressure of the bubble 40 contributes to the liquid discharge directly and efficiently. Also the growth itself of the bubble is guided toward the downstream side, like the pressure propagating directions $V_1$–$V_4$, whereby the bubble grows larger in the downstream side than in the upstream side. Such control of the growing direction itself of the bubble and of the pressure propagating direction thereof by the movable member 31 enables basic improvements in the discharge efficiency, the discharge power and the discharge speed.

Now reference is made again to FIGS. 1A to 1D, for explaining the discharge operation of the liquid discharge head of the present embodiment.

FIG. 1A shows a state prior to the heat generation of the heat generating member 2, by the application of energy such as electrical energy. In this state, it is important that the movable member 31 is provided in a position opposed at least to the downstream portion of the bubble generated by the heat from the heat generating member 2. Stated differently, the movable member 31 is provided, in the configuration of the liquid path, at least from the center 3 of the area of the heat generating member 2 to the downstream position (namely a range at the downstream side of a line passing through the center 3 of the area of the heat generating member 2 and perpendicular to the longitudinal direction of the liquid path), whereby the downstream side of the bubble acts on the movable member 31.

FIG. 1B shows a state in which the heat generating member 2 has generated heat by the application for example of electrical energy to heat a part of the liquid present in the bubble generating area 11, thereby generating a bubble by film boiling.

In this state the movable member 31 starts displacement from the first position, by the pressure resulting from the generation of the bubble 40. It is important in this state, as explained in the foregoing, that the free end 32 of the movable member 31 is positioned at the downstream side (side of the discharge port 18) while the fulcrum 33 is positioned at the upstream side (side of the common liquid chamber 13) and that at least a part of the movable member 31 is opposed to downstream portion of the heat generating member 2, or the downstream portion of the bubble.

FIG. 1C shows a state in which the bubble continues growth and the movable member 31 is displaced while the liquid is still present between the bubble 40 and the movable member 31. Because of the pressure resulting from the bubble generation, the movable member 31 continues displacement to the second position of maximum displacement. The generated bubble 40 grows larger is the downstream side than in the upstream side and continues growth beyond the broken-lined first position of the movable member 31. The gradual displacement of the movable member 31 in the course of the growth of the bubble 40 is considered to align the pressure propagating direction of the bubble 40 and the direction of easy volume movement thereof, namely the growth direction of the bubble toward the free end side, uniformly toward the discharge port 18, thereby improving the discharge efficiency. The movable member 31 performs positive contribution in guiding the bubble itself and the pressure thereof toward the discharge port 18, and can efficiently control the pressure propagating direction and the bubble growing direction.

Figure 1D:
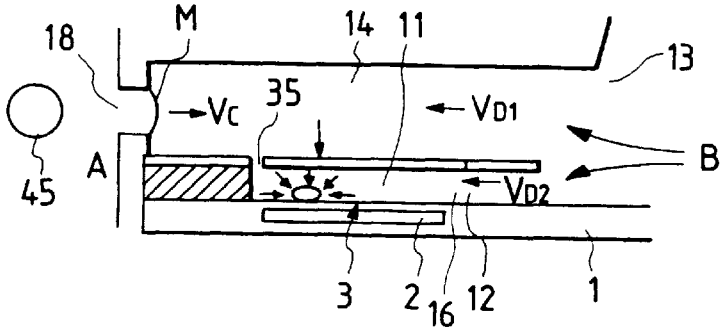
FIG. 1D PRIOR ART

FIG. 1D shows a state in which the bubble 40 contracts and vanishes by the decrease of the pressure in the bubble, after the film boiling mentioned before.

The movable member 31 returns to the initial first position shown in FIG. 1A, by a negative pressure generated by the contraction of the bubble and the elastic returning force of the movable member 31 itself. When the bubble vanishes, in order to compensate the volume contraction of the bubble in the bubble generating area 11 and to compensate the volume of the discharged liquid, the liquid flows in as indicated by flows $V_{D1}$, $V_{D2}$ from the side of the common liquid chamber 13 and a flow $V_C$ from the side of the discharge port 18.

In the foregoing there have been explained the function of the movable member 31 and the liquid discharging operation based on the bubble generation. In the following there will be explained the liquid refilling in the liquid discharge head of the present invention.

There will be given a detailed explanation on the liquid filling mechanism in the present invention, with reference to FIGS. 1A to 1D.

When the bubble 40 enters a vanishing stage from the state of maximum volume, after the state shown in FIG. 1D, the liquid of a volume corresponding to the vanishing bubble flows into the bubble generation area, from the side of the discharge port 18 in the first liquid path 14 and from the side of the common liquid chamber 13 in the second liquid path 16. In the conventional liquid path configuration without the movable member 31, the amount of the liquid flowing into the position of the vanishing bubble from the side of the discharge port 18 and that from the common liquid chamber 13 are determined by the resistance of the liquid paths and the inertia of the liquid, and are dependent on the flow resistances in portions closer to the discharge port 18 and to the common liquid chamber 13.

Therefore, if the flow resistance is smaller in the side closer to the discharge port 18, a larger amount of liquid flows into the bubble vanishing position from the side of the discharge port 18, thereby increasing the amount of retraction of the meniscus M. Therefore, if a smaller flow resistance is selected in the side closer to the discharge port 18 in order to improve the discharge efficiency, there results a larger amount of retraction of the meniscus M, thus prolonging the refilling time and hindering the high-speed printing.

On the other hand, in the present embodiment involving the movable member 31, the retraction of the meniscus M stops when the movable member 31 reaches the original position in the course of bubble vanishing, and, if the bubble volume W is divided, by the first position of the movable member 31, into a volume W1 at the upper side and W2 at the side of the bubble generation area 11, the volume W2 remaining thereafter is principally replenished by the liquid flow $V_{D2}$ of the second liquid path 16. Consequently, the amount of retraction of the meniscus M, which has been about a half of the bubble volume W in the conventional configuration, can be reduced to about a half of the smaller volume W1.

Also the liquid replenishment of the volume W2 can be achieved, by the pressure at the bubble vanishing, in forced manner principally from the upstream side ($V_{D2}$) of the second liquid path, along a face of the movable member 31 at the side of the heat generating member 2, whereby faster refilling can be achieved.

The refilling operation in the conventional head utilizing the pressure at the bubble vanishing causes a significant vibration of the meniscus, leading to the deterioration of the image quality. In contrast, the high-speed refilling in the present embodiment can minimize the meniscus vibration as the movable member 31 suppresses the liquid movement between the first liquid path 14 at the side of the discharge port 18 and the bubble generating area 11.

As explained in the foregoing, the present embodiment achieves forced refilling to the bubble generating area through the liquid supply path 12 of the second liquid path 16 and the high-speed refilling by the above-explained suppression of the meniscus retraction and the meniscus vibration, thereby realizing stable discharge, high-speed repeated discharges, and improvement in the image quality and in the printing speed of the print.

The configuration of the present invention also has the following effective function, which is the suppression of propagation of the bubble-generated pressure to the upstream side (backward wave). Within the pressure resulting from the bubble generated on the heat generating member 2, that based on the bubble in the side of the common liquid chamber 13 (upstream side) forms a force (backward wave) which pushes back the liquid toward the upstream side. Such backward wave creates a pressure in the upstream side, a resulting liquid movement and an inertial force associated with the Liquid movement, which retard the liquid refilling into the liquid path and hinder the high-speed drive. On the other hand, in the configuration of the present invention, the movable member 31 suppresses these actions toward the upstream side, thereby further improving the refilling ability.

In the following there will be explained other features in the configuration and other advantages of the present embodiment.

The second liquid path 16 of the present embodiment is provided with a liquid supply path 12 with an internal wall which is connected with the upstream side of the heat generating member 2 in substantially flat manner (without a significant recess in the portion of the heat generating member 2. In such configuration, the liquid is supplied to the bubble generating area 11 and the surface of the heat generating member 2 by a flow $V_{D2}$, along a face of the movable member 31 close to the bubble generating area 11. Such mode of liquid supply suppresses stagnation of the liquid on the surface of the heat generating member 2, thereby preventing separation of the gas dissolved in the liquid, also facilitating the elimination of so-called remaining bubble that could not vanish totally, and also avoiding excessive heat accumulation in the liquid. Consequently the bubble generation can be repeated at a high speed, in more stable manner. The present embodiment discloses a configuration having the liquid supply path 12 with a substantially flat internal wall, but there may be employed any liquid supply path that has a smooth internal wall connected smoothly with the surface of the heat generating member 2 so as not to cause liquid stagnation thereon or significant turbulence in the liquid supply.

The liquid supply to the bubble generating area is also conducted through a path $V_{D1}$ through a side (slit 35) of the movable member 31. However, the liquid flow to the bubble generating area 11 through such path $V_{D1}$ is hindered in case the movable member 31 is so formed as to cover the entire bubble generating area or the entire area of the heat generating member 2 as shown in FIG. 1A in order to more effectively guide the pressure of the bubble generation to the discharge port 18 and so formed, upon returning to the first position, as to increase the flow resistance of the liquid between the bubble generating area 11 and the area of the first liquid path 14 closer to the discharge port 18. Nevertheless, the head configuration of the present invention realizes very high liquid refilling ability because of the presence of the flow path $V_{D2}$ to the bubble generating area, so that the liquid supply performance is not deteriorated even when the movable member 31 is so formed as to cover the entire bubble generating area 11 for improving the discharge efficiency.

The movable member 31 is so constructed, as shown in FIG. 5, that the free end 32 is positioned at the downstream side, with respect to the fulcrum 33. Such configuration allows to realize, at the bubble generation, the aforementioned functions and effects such as aligning the pressure propagating direction of the bubble and the growing direction thereof toward the discharge port 18. Also such positional relationship attains, in addition to the functions and effects relating to the liquid discharge, a lower flow resistance for the liquid flowing in the liquid path 10, thereby enabling high-speed refilling. This is because the free end 32 and the fulcrum 33 are so positioned, as shown in FIG. 5, that the movable member 31 is not against the flows S1, S2, S3 in the liquid path 10 (including the first liquid path 14 and the second liquid path 16) at the returning of the meniscus M to the discharge port 18 by the capillary force or at the liquid replenishment for the vanished bubble.

In more details, in the present embodiment shown in FIGS. 1A to 1D, the free end 32 of the movable member 31 is so extended with respect to the heat generating member 2, as already explained in the foregoing, as to oppose to a position which is at the downstream side of the area center 3 (a line passing the center of the area of the heat generating member 2 perpendicularly to the longitudinal direction of the liquid path) which divides the heat generating member 2 into the upstream area and the downstream area. Because of such structure, the pressure or the bubble, generated at the downstream side of the areal center position 3 of the heat generating member 2 and significantly contributing to the liquid discharge, is received by the movable member 31 and can thus be directed toward the discharge port 18, whereby a fundamental improvement can be achieved in the discharge efficiency and the discharge power.

In addition, the upstream side of the bubble is also utilized to attain various effects.

Also in the configuration of the present embodiment, the instantaneous mechanical displacement of the free end of the movable member 31 is considered to effectively contribute to the liquid discharge.

Second Embodiment

Figure 6:
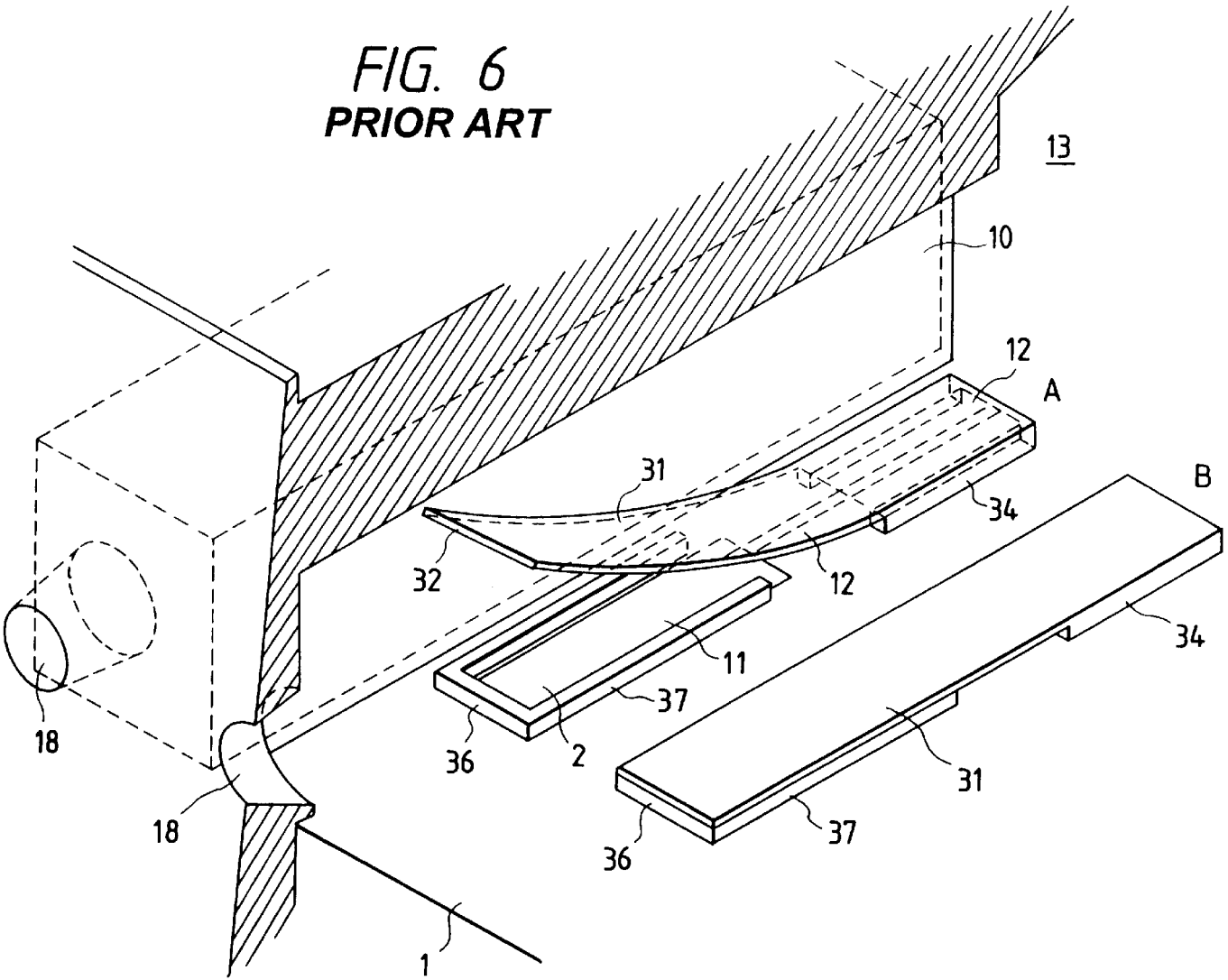
FIG. 6 PRIOR ART
FIG. 6 is a partially cut-off perspective view of a liquid discharge head of a second embodiment of the present invention.

FIG. 6 shows a second embodiment of the present invention, wherein A indicates a state in which the movable member 31 is displaced (bubble being omitted from illustration), while B indicates a state in which the movable member 31 is in the initial (first) position substantially isolating the bubble generating area 11 from the discharge port 18. (Though not illustrated, a liquid path wall is present to separate the paths A and B.)

The movable member 31 in FIG. 6 is provided with two lateral support members 34, between which the liquid supply path 12 is formed. In this manner the liquid can be supplied along the face of the movable member 31 at the side of the heat generating member 2, by the liquid supply path 12 having a face which is substantially flat with the surface of the heat generating member or is smoothly connected therewith.

In the initial (first) position, the movable member 31 is positioned close or in intimate contact with a downstream wall 36 and a lateral wall 37 of the heat generating member 2, positioned at the downstream side and the lateral side thereof, thereby substantially sealing the bubble generating area 11 at the side of the discharge port 18. Consequently, at the bubble generation, the bubble pressure, particularly that at the downstream side of the bubble, does not leak but can be concentrated on the free end portion of the movable member 31.

Also at the bubble vanishing, the movable member 31 returns to the first position to substantially seal the bubble generating area 11 at the side of the discharge port 18, whereby attained are various effects explained in the foregoing embodiment, such as suppression of retraction of the meniscus at the liquid supply onto the heat generating member 2 at the bubble vanishing. Also there can be obtained functions and effects on the liquid refilling, similar to those explained in the foregoing embodiment.

In the present embodiment, as shown in FIGS. 2 and 6, the support member 34 for the movable member 31 is provided at an upstream position separate from the heat generating member 2, and is formed with a smaller width in comparison with the liquid path 10, in order to realize the liquid supply into the aforementioned liquid supply path 12. The shape of the support member 34 is however not limited to that explained above can be arbitrarily selected as long as the liquid refilling can be achieved smoothly.

In the present embodiment, the distance between the movable member 31 and the heat generating member 2 is selected as about 15 $\mu$m, but it may be selected within a range that permits sufficient transmission of the bubble-generated pressure to the movable member 31.

Third Embodiment

FIG. 7 illustrates a third embodiment of the present invention, representing one of the basic concepts thereof. FIG. 7 illustrates the positional relationship of the bubble generating area, the bubble generated therein and the movable member 31 in a liquid path, in order to facilitate the understanding of the liquid discharging method and the liquid refilling method of the present invention.

The foregoing embodiments achieve to concentrate the bubble movement toward the discharge port 18, simultaneously with the abrupt displacement of the movable member 31, by concentrating the pressure of the generated bubble to the free end portion of the movable member 31. On the other hand, the present embodiment, while giving certain freedom to the generated bubble, limits the downstream portion of the bubble, positioned at the side of the discharge port 18 and directly contributing to the liquid discharge, by means of the free end portion of the movable member 31.

In comparison with the foregoing first embodiment shown in FIG. 2, the configuration shown in FIG. 7 lacks a protruding portion (indicated by hatching), formed on the element substrate 1 and functioning as a barrier at the downstream end of the bubble generating area. Thus, in the present embodiment, the area at the free end and at both sides of the movable member 31 does not seal but keeps the bubble generating area open to the area of the discharge port 18.

In the present embodiment, in the downstream portion of the bubble, directly contributing to the liquid discharge, the bubble can grow in the end portion at the downstream side, and the pressure component of such portion is effectively utilized in the liquid discharge. In addition, the free end portion of the movable member 31 so acts as to add the upward pressure (components of $V_2$, $V_3$, $V_4$ shown in FIG. 3) of at least such downstream portion to the bubble growth at the above-mentioned end portions of the downstream side, whereby the discharge efficiency is improved as in the foregoing embodiments. Also in comparison with the foregoing embodiments, the present embodiment is superior in the response to the driving of the heat generating member 2.

In addition, the present embodiment is advantageous in the manufacture, because of the simpler structure.

In the present embodiment, the fulcrum of the movable member 31 is fixed to the support member 34 of a width smaller than that of the face position of the movable member 31. Consequently, the liquid supply to the bubble generating area 11 at the bubble vanishing is made through both sides of such support member 34 (as indicated by arrows in the drawing). The support member 34 may have any configuration as long as the liquid supply can be secured.

In the present embodiment, the liquid refilling at the bubble vanishing is superior to that in the conventional configuration containing the heat generating member only, since the movable member 31 controls the liquid flow into the bubble generating area from above. Naturally such control also reduces the amount of retraction of the meniscus.

In a preferred variation of the third embodiment, both lateral sides (or either one thereof) at the free end portion of the movable member 31 are so constructed to substantially close the bubble generating area 11. Such configuration allows to utilize also the pressure directed to the lateral direction of the movable member 31 for the growth of the bubble at the lateral end portion of the discharge port 18, thereby further improving the discharge efficiency.

Fourth Embodiment

The present embodiment discloses a configuration which further improves the liquid discharging power by the aforementioned mechanical displacement. FIG. 8 is a longitudinal cross-sectional view of such head configuration, wherein the movable member 31 is so further extended that the free end 32 thereof is located in a further downstream position of the heat generating member 2. Such configuration allows to increase the displacing speed of the movable member 31 at the free end position, thereby further increasing the discharge power by the displacement of the movable member 31.

Also in comparison with the foregoing embodiment, the free end 32 is positioned closer to the discharge port 18, thereby concentrating the bubble growth in a stabler directional component and achieving more satisfactory liquid discharge.

Also, the movable member 31 effects the returning motion, from the second position of the maximum displacement, with a returning speed R1 by the elastic returning force, while the free end 32 which is farther from the fulcrum 33 returns with a larger returning speed R2. Consequently the free end 32 acts, with a higher speed, on the bubble 40 in the course or after the growth to induce a flow of the liquid positioned downstream of the bubble 40 toward the discharge port 18, thereby improving the directionality of liquid discharge and increasing the discharge efficiency.

The free end may be formed perpendicular to the liquid flow as in the case of FIG. 7, thereby allowing the pressure of the bubble 40 and the mechanical action of the movable member 31 to contribute more efficiently to the liquid discharge.

Fifth Embodiment

Figure 9A:
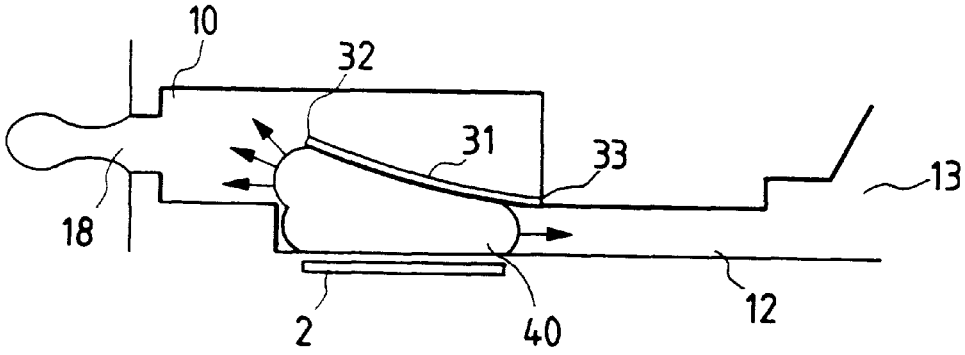
FIG. 9A PRIOR ART
FIGS. 9A, 9B and 9C are schematic cross-sectional views of a liquid discharge head of a fifth embodiment of the present invention.
Figure 9B:
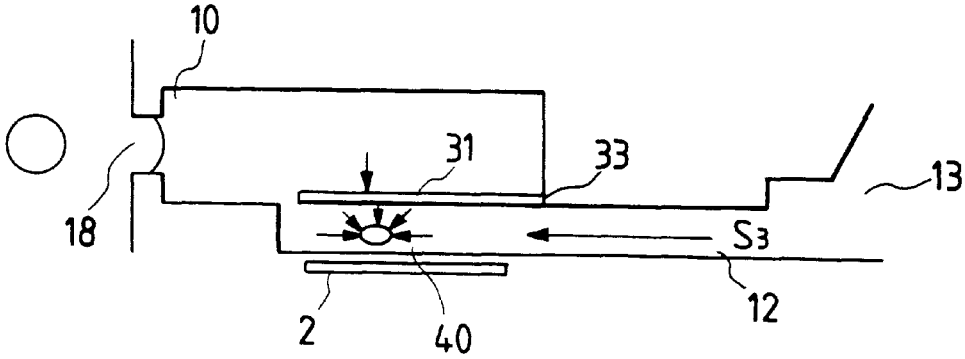
FIG. 9B PRIOR ART
Figure 9C:
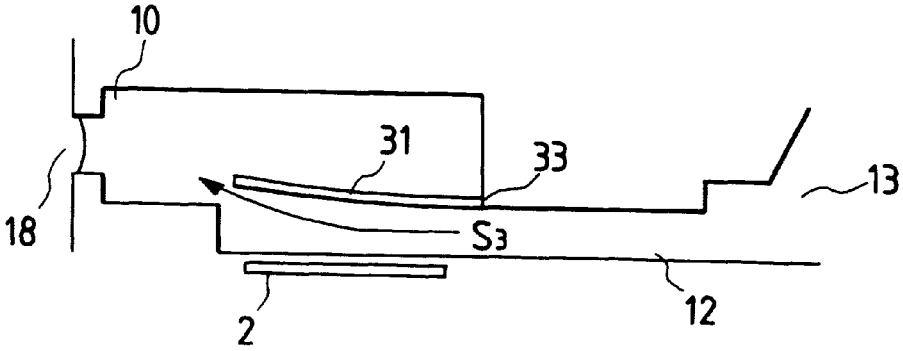
FIG. 9C PRIOR ART

FIGS. 9A, 9B and 9C illustrate a fifth embodiment of the present invention.

In contrast to the foregoing embodiment, in the liquid path of the present embodiment, the area directly communicating with the discharge port 18 does not communicate with the liquid chamber side, whereby the configuration can be made simpler.

The liquid supply is solely made through the liquid supply path 12 along the face of the movable member 31 facing the bubble generating area, while the positional relationship of the free end 32 and the fulcrum 33 of the movable member 31 relative to the discharge port 18 and to the heat generating member 2 is same as in the foregoing embodiment.

The present embodiment achieves the aforementioned effects in the discharge efficiency and in the liquid supply, but is particularly effective in suppressing the retraction of the meniscus, wherein almost all of the liquid refilling is achieved in forced manner by the pressure at the bubble vanishing.

FIG. 9A shows a state where the bubble has been generated in the liquid by the heat generating member 2 and the movable member 31 is brought into contact with the bubble in the course of returning motion, while FIG. 9B shows a state where the bubble is in the course of contraction with the returning motion of the movable member 31 to the initial position and the liquid supply by S3.

FIG. 9C shows a state in which a slight retraction of the meniscus induced by the returning motion of the movable member 31 to the initial position is replenished, after the bubble vanishing, by the capillary force in the vicinity of the discharge port 18.

Sixth Embodiment

In the following there will be explained another embodiment of the present invention, with reference to the attached drawings.

The present embodiment is same as the foregoing embodiments in the discharging principle of the principal liquid but adopts a doubled liquid path configuration thereby dividing the used liquid into bubble generating liquid which generates a bubble by heat application and discharge liquid which is principally discharged.

Figure 10:
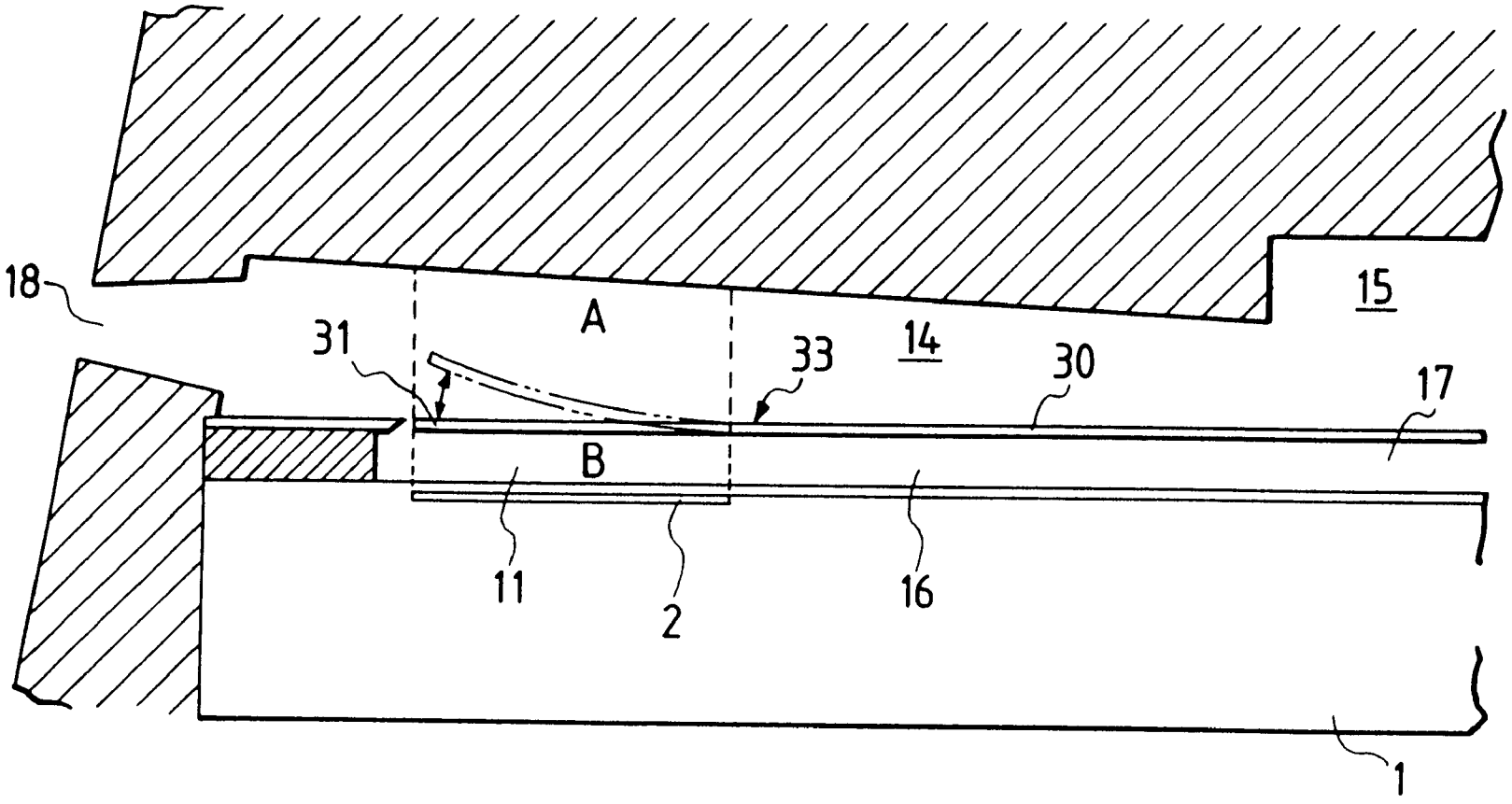
FIG. 10 PRIOR ART
FIG. 10 is a cross-sectional view of a liquid discharge head (2 flow paths) of a sixth embodiment of the present invention.
Figure 11:
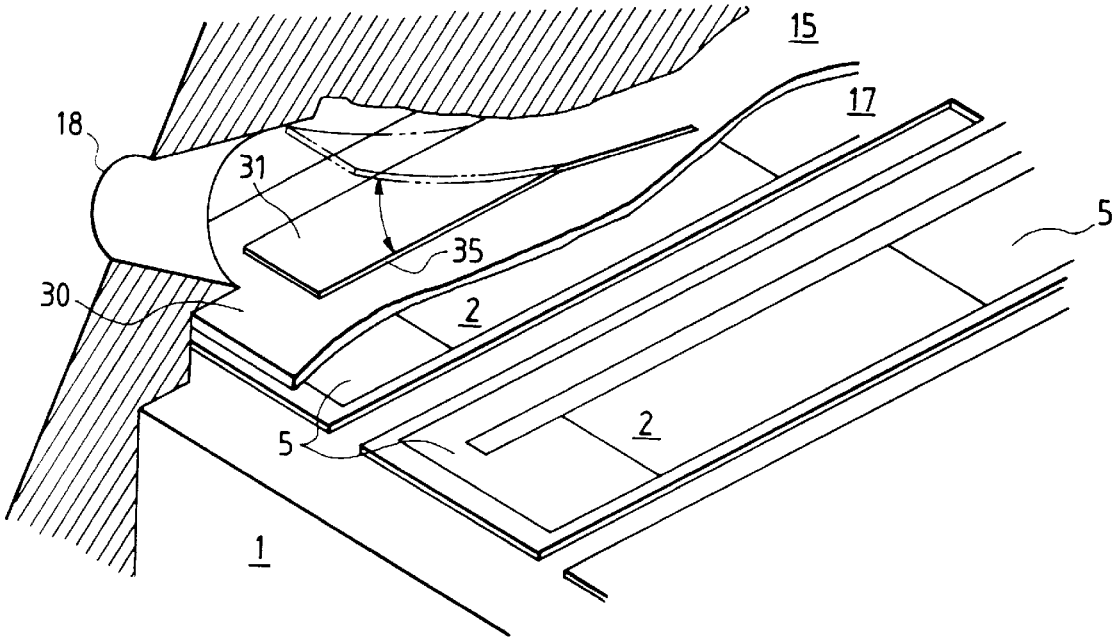
FIG. 11 PRIOR ART
FIG. 11 is a partially cut-off perspective view of a liquid discharge head of the sixth embodiment of the present invention.

FIG. 10 is a schematic cross-sectional view of the liquid discharge head of the present embodiment along the liquid path, and FIG. 11 is a partially cut-off perspective view of such liquid discharge head.

The liquid discharge head of the present embodiment is provided, on the element substrate 1 on which the heat generating member 2 for supplying the liquid with thermal energy for bubble generation is formed, with a liquid path 16 for second liquid as the bubble generating liquid, and thereon with a liquid path 14 for first liquid as the discharge liquid, communicating directly with the discharge port 18.

The upstream side of the first liquid's liquid path 14 communicates with a first common liquid chamber 15 for supplying the discharge liquid to the plural first liquid path 14, while the upstream side of the second liquid's liquid path 16 communicates with a second common liquid chamber 17 for supplying the bubble generating liquid to the plural second liquid paths 16.

However, if the bubble generating liquid and the discharge liquid are same, the common liquid chambers 15, 17 may be united into a chamber.

Between the first and second liquid's liquid paths 14, 16 there is provided a partition wall 30 composed of an elastic material such as a metal, for separating the paths 14 and 16. In case the bubble generating liquid and the discharge liquid are to be least mixed, it is desirable to separate, as far as possible, the liquid of the first liquid's liquid path 14 and that of the second liquid's liquid path 16 by the partition wall 30, but, in case the bubble generating liquid and the discharge liquid may be mixed to a certain extent, the partition wall need not be given the function of such complete separation.

In a space defined by projecting the heat generating member 2 upwards (space corresponding to an area A and the bubble generating area 11 (B) in FIG. 10 and hereinafter called a discharge pressure generating area), the partition wall constitutes the movable member 31 in the form of a beam supported at an end, having a free end by a slit 35 at the side of the discharge port 18 (at the downstream side in the liquid flow) and a fulcrum 33 at the side of the common liquid chambers 15, 17. The movable member 31, being so positioned as to face the bubble generating area 11 (B), is opened toward the discharge port 18 of the first liquid path 14 (as indicated by an arrow in FIG. 10, by the bubble generation in the bubble generating liquid. Also in FIG. 11, it will be understood that the partition wall 30 is positioned, across a space constituting the second liquid path 16, above the element substrate 1 which bears thereon a heat-generating resistance (electrothermal converting member) constituting the heat generating member 2 and a wiring electrode 5 for supplying the heat-generating resistance with an electrical signal.

The arrangement of the fulcrum 33 and the free end 32 of the movable member 31 and the positional relationship thereof to the heat generating member 2 are same as those in the foregoing embodiment.

The configurational relationship of the second liquid's liquid path 16 and the heat generating member 2 is same as that of the liquid supply path 12 and the heat generating member 2 explained in the foregoing embodiments.

Now reference is made to FIGS. 12A and 12B for explaining the function of the liquid discharge head of the present embodiment.

The head of the present embodiment was driven with same aqueous ink as the discharge liquid to be supplied to the first liquid's liquid path 14 and the bubble generating liquid to be supplied to the second liquid's liquid path 16.

The heat generated by the heat generating member 2 is applied to the bubble generating liquid contained in the bubble generating area of the second liquid's liquid path to generate a bubble 40 therein by the film boiling phenomenon, as disclosed in the U.S. Pat. No. 4,723,129.

In the present embodiment, since the bubble-generated pressure cannot escape from the bubble generating area in the three directions thereof, except for the upstream side, such pressure is concentrated to the movable member 31 provided in the discharge pressure generating area, and, with the growth of the bubble, the movable member 31 displaces from the state shown in FIG. 12A toward the first liquid path 14 as shown in FIG. 12B. By such function of the movable member 31, the first liquid's liquid path 14 communicates with the second liquid's liquid path 16 and the bubble-generated pressure is principally transmitted toward the discharge port 18 (direction A) in the first liquid's liquid path 14. The liquid is discharged from the discharge port 18 by the propagation of such pressure, combined with the mechanical displacement of the movable member 31.

Then, with the contraction of the bubble, the movable member 31 returns to the position shown in FIG. 12A and, in the first liquid's liquid path 14, the discharge liquid of an amount, corresponding to that of the discharged liquid, is replenished from the upstream side. Also in the present embodiment, the refilling of the discharge liquid is not hindered by the movable member 31, as the movable member 31 is in the closing direction.

The present embodiment is same as the foregoing first embodiment in the functions and effects of the principal components such as pressure propagation, growing direction of the bubble, prevention of the backward wave etc. by the displacement of the movable member 31, but provides the following additional advantage because of the two-path configuration.

In the above-explained configuration, the discharge liquid and the bubble generating liquid can be separated and the discharge liquid can be discharged by the pressure obtained by the bubble generation in the bubble generating liquid. It is therefore rendered possible to satisfactorily discharge even viscous liquid, which is insufficient in the discharging power because of insufficient bubble generation under heat application, such as polyethyleneglycol, by supplying such liquid into the first liquid's liquid path and also supplying the second liquid's liquid path with liquid capable of satisfactory bubble generation (for example a mixture of ethanol:water=4:6, with a viscosity of 1–2 cp) or low-boiling liquid as the bubble generating liquid.

Also liquid which does not generate deposit such as cognation on the surface of the heat generating member 2 under heat application may be selected as the bubble generating liquid to stabilize bubble generation, thereby achieving satisfactory liquid discharge.

The heat configuration of the present embodiment, being capable of achieving the effects explained in the foregoing embodiments, can discharge various liquid such as highly viscous liquid with a higher discharge efficiency and a higher discharge power.

Also liquid susceptible to heat may be discharged without thermal damage, by supplying such liquid as the discharge liquid in the first liquid path and supplying the second liquid's liquid path with liquid capable of satisfactory bubble generation and resistant to heat, with a high discharge efficiency and a high discharge power as explained in the foregoing.

Other Embodiments

In the foregoing there have been explained embodiments of the principal parts of the liquid discharge head and the liquid discharge method of the present invention. In the following there will be explained other embodiments which are advantageously applicable to such foregoing embodiments, with reference to the attached drawings. It is to be noted that the following embodiments may refer to either of the foregoing embodiment with one-path configuration and that with two-path configuration, but are generally applicable to both configurations unless otherwise specified.

[Ceiling shape of liquid path]

FIG. 13 is a cross-sectional view of a liquid discharge head of the present invention along the liquid path, wherein provided, on the partition wall 30, is a grooved member 50 having grooves for constituting the first liquid's liquid path 14 (or liquid path 10 in FIG. 1A). In this embodiment, the ceiling of the liquid path is made higher in the vicinity of the free end of the movable member 31, in order to increase the moving angle θ thereof. The moving range of the movable member 31 is determined in consideration of the structure of the liquid path, the durability of the movable member 31, the bubble generating power etc., but desirably covers a position including the angle of the discharge port 18 in the axial direction.

Also the discharging power can be transmitted in more satisfactory manner by selecting, as shown in FIG. 13, the height of displacement of the free end of the movable member 31 larger than the diameter of the discharge port 18. Furthermore, as shown in FIG. 13, the ceiling of the liquid path is made lower at the fulcrum 33 of the movable member 31 than at the free end 32 thereof, whereby the leak of the pressure wave toward the upstream side can be prevented in more effective manner.

[Positional relationship of second liquid path and movable member 31]

Figure 14A:
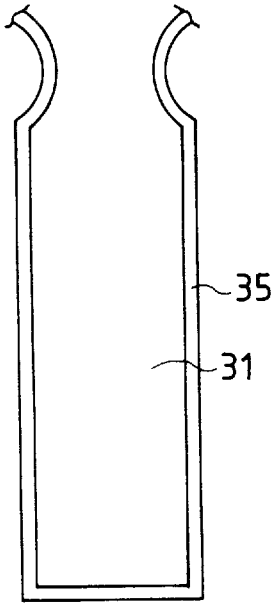
PRIOR ART FIG. 14A
FIGS. 14A, 14B and 14C are views showing the configuration of the movable member and the liquid path.
Figure 14B:
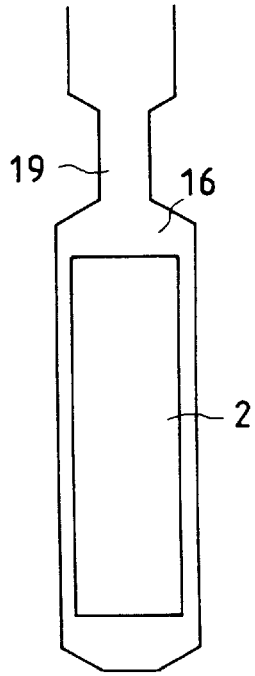
PRIOR ART FIG. 14B
Figure 14C:
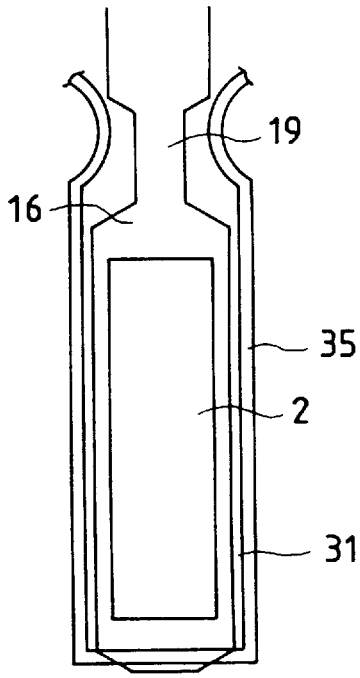
PRIOR ART FIG. 14C

FIGS. 14A to 14C illustrate the positional relationship of the movable member 31 and the second liquid's liquid path 16. FIG. 14A is a plan view of the partition wall 30 and the movable member 31 seen from above, while FIG. 14B is a plan view of the second liquid's liquid path 16, without the partition wall 30, seen from above, and FIG. 14C is a schematic view of the positional relationship of the movable member 31 and the second liquid's liquid path 16, which are illustrated in mutually superposed manner. In these drawings, the lower side is the front side having the discharge port 18.

The second liquid's liquid path 16 in the present embodiment has a constricted portion 19 in the upstream side of the heat generating member 2 (the upstream side being defined in the major stream from the second common liquid chamber to the discharge port 18 through the heat generating member 2, the movable member 31 and the first liquid path), thereby forming a chamber structure (bubble generating chamber) for avoiding easy escape of the pressure of bubble generation to the upstream side of the second liquid's liquid path 16.

In case the constricted portion 19 for avoiding the escape of the pressure, generated in the liquid chamber by the heat generating member 2, toward the common liquid chamber is formed in the conventional head in which the bubble generating liquid path is same as the liquid discharging path, the cross section of the liquid path in such constricted portion 19 cannot be made very small in consideration of the liquid refilling.

On the other hand, in the present embodiment, most of the discharged liquid can be the discharge liquid present in the first liquid's liquid path and the consumption of the bubble generating liquid in the second liquid's liquid path, where the heat generating member is present, can be made small. Consequently the replenishing amount of the bubble generating liquid into the bubble generating area 11 of the second liquid's liquid path can be made low. For this reason the gap of the above-mentioned constricted portion 19 can be made as small as several micrometers to less than twenty micrometers, so that the bubble pressure generated in the second liquid's liquid path can be further prevented from escaping and concentrated toward the movable member 31. Such pressure can be utilized, through the movable member 31, as the discharging power, thereby achieving a higher discharge efficiency and a higher discharging power. The first liquid's liquid path 16 is not limited to the above-explained shape but may assume any shape that can effectively transmit the bubble-induced pressure to the movable member 31.

As shown in FIG. 14C, the lateral portions of the movable member 31 cover a part of the wall constituting the second liquid's liquid path, and such configuration prevents the movable member 31 from dropping into the second liquid's liquid path, whereby the aforementioned separation of the discharge liquid and the bubble generating liquid can be further enhanced. It also suppresses the leakage of the bubble through the slit, thereby further increasing the discharge pressure and the discharge efficiency. Furthermore, the aforementioned liquid refilling effect from the upstream side by the pressure of bubble vanishing can be further enhanced.

In FIG. 12B and FIG. 13, a part of the bubble, generated in the bubble generating area of the second liquid's liquid path 16 extends in the first liquid's liquid path 14 as a result of the displacement of the movable member 31 toward the first liquid's liquid path 14, and such a height of the second liquid path as to permit such extension of the bubble allows to further increase the discharge power, in comparison with the case without such extension of the bubble. For realizing such extension of the bubble into the first liquid's liquid path 14, the height of the second liquid's liquid path 16 is desirably made smaller than the height of the maximum bubble and is preferably selected within a range of several to 30 micrometers. In the present embodiment, this height is selected as 15 μm.

[Movable member and partition wall]

Figure 15A:
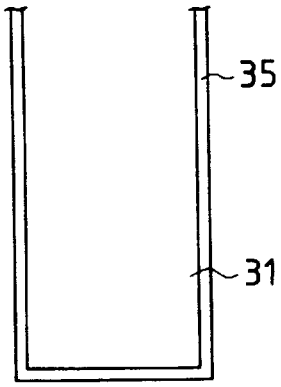
PRIOR ART FIG. 15A
FIGS. 15A, 15B and 15C are views showing other shapes of the movable member.
Figure 15B:
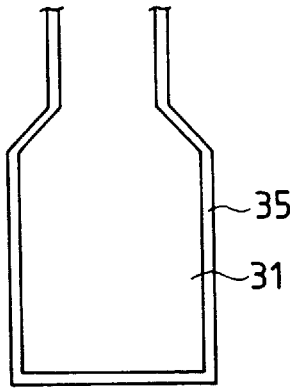
PRIOR ART FIG. 15B
Figure 15C:
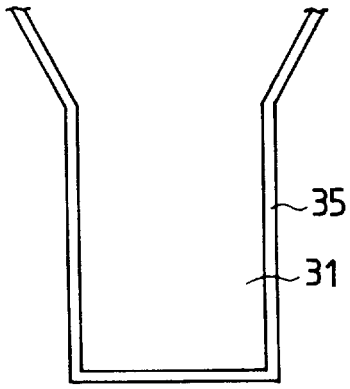
PRIOR ART FIG. 15C

FIGS. 15A to 15C show other shapes of the movable member 31. A slit 35 formed in the partition wall defines the movable member 31. FIG. 15A shows a rectangular shape, while FIG. 15B shows a shape with a narrower fulcrum portion to facilitate displacement of the movable member 31, and FIG. 15C shows a shape with a wider fulcrum portion to increase the durability of the movable member 31. For realizing easy displacement and satisfactory durability, the width of the fulcrum portion is desirably constricted in arc shape as shown in FIG. 14A, but the shape of the movable member 31 may be arbitrarily selected so as not to drop into the second liquid's liquid path and as to realize easy displacement and satisfactory durability.

In the foregoing embodiment, the partition wall 5 including the plate-shaped movable member 31 was composed of nickel of a thickness of 5 μm, but the partition wall 5 and the movable member 31 may be composed of any material that is resistance to the bubble generating liquid and the discharge liquid, has elasticity allowing satisfactory function of the movable member 31 and permits formation of the fine slit 35.

Preferred examples of the material constituting the movable member 31 include a durable metal such as silver, nickel, gold, iron, titanium, aluminum, platinum, tantalum, stainless steel, phosphor bronze or an alloy thereof; nitryl radical-containing resin such as acrylonitrile, butadiene or styrene; amide-radical containing resin such as polyamide; carboxyl-radical containing resin such as polycarbonate; aldehyde-radical containing resin such as polyacetal; sulfone-radical containing resin such as polysulfone; other resins such as liquid crystal polymer or compounds thereof; an ink-durable metal such as gold, tungsten, tantalum, nickel, stainless steel, titanium or an alloy thereof; a material surfacially coated with such ink-durable metal or alloy; amide-radical containing resin such as polyamide; aldehyde radical-containing resin such as polyacetal; ketone radical-containing resin such as polyetheretherketone; imide radical-containing radical such as polyimide; hydroxyl radical-containing resin such as polyethylene; alkyl radical-containing resin such as polypropylene; epoxy radical-containing resin such as epoxy resin; amino radical-containing resin such as melamine resin; methylol radical-containing resin such as xylene resin; and ceramics such as silicon dioxide and compounds thereof.

Also preferred examples of the material constituting the partition wall include resin with satisfactory heat resistance, solvent resistance and moldability represented by recent engineering plastics such as polyethylene, polypropylene, polyamide, polyethylene terephthalate, melamine resin, phenolic resin, epoxy resin, polybutadiene, polyurethane, polyetheretherketone, polyethersulfone, polyarylate, polyimide, polysulfone, liquid crystal polymer or compounds thereof; and a metal such as silicon dioxide, silicon nitride, nickel, gold, stainless steel, alloys and compounds thereof; and a material surfacially coated with titanium or gold.

The thickness of the partition wall can be determined in consideration of the material and the shape thereof, so as to attain the required strength and to ensure satisfactory function of the movable member 31, and is preferably selected within a range of 0.5 to 10 μm.

The width of the slit 35 defining the movable member 31 was selected as 2 μm in the present embodiment, but, in case the bubble generating liquid and the discharge liquid are different and the mixing of the both is to be avoided, the width of the slit is so selected as to form a meniscus between the both liquids, thereby suppressing the mutual flow therebetween. As an example, if the bubble generating liquid has a viscosity of about 2 cp while the discharge liquid has a viscosity of 100 cp or higher, the mutual mixing can be avoided even with a slit width of about 5 μm, but the slit width is preferably selected as 3 μm or smaller.

The thickness of the movable member 31 of the present invention is not in the order of centimeter but in the order of micrometer (t). For forming such movable member 31 with the slit of a width in the order micrometer (W), it is desirable to take certain fluctuation in the manufacture into consideration.

If the thickness of the member opposed to the free end and/or the lateral end of the movable member 31 defining the slit is comparable with that of the movable member 31 (as shown in FIGS. 121, 12B and 13), the mixing of the bubble generating liquid and the discharge liquid can be stably suppressed by selecting the relationship of the slit width and the thickness within the following range, in consideration of the fluctuation in the manufacture. Though this gives a limitation in the designing, a condition $W/t \leqq 1$ enables suppression of mixing of the two liquids over a prolonged period in case of using the bubble generating liquid of a viscosity of 3 cp or less in combination with the highly viscous ink (5 or 10 cp).

When the functions are divided into the bubble generating liquid and the discharge liquid, the movable member 31 constitutes a substantial partition member for these liquids. A slight mixing of the bubble generating liquid into the discharge liquid is observed as a result of displacement of the movable member 31 by the growth of the bubble. However, since the discharge liquid which forms the image in the ink jet printing generally contains a coloring material with a concentration of 3–5%, a significant variation in the color concentration will not result if the bubble generating liquid is contained, within a range up to 20%, in the droplet of the discharge liquid. Consequently, the present invention includes a situation where the bubble generating liquid and the discharge liquid are mixed within such a range that the content of the bubble generating liquid in the discharged droplet does not exceed 20%.

In the above explained configuration, the mixing ratio of the bubble generating liquid did not exceed 15% even when the viscosity was changed, and, with the bubble generating liquid of a viscosity not exceeding 5 cp, the mixing ratio did not exceed 10% though it is variable depending on the drive frequency.

Such mixing of the liquids can be reduced, for example to 5% or less, by reducing the viscosity of the discharge liquid from 20 cp.

In the following there will be explained the positional relationship of the heat generating member 2 and the movable member 31 in the head, with reference to the attached drawings. However the shape, dimension and number of the movable member 31 and the heat generating member 2 are not limited to those explained in the following. The optimum arrangement of the heat generating member 2 and the movable member 31 allows to effectively utilize the pressure of bubble generation by the heat generating member 2 as the discharging pressure.

Figure 16:
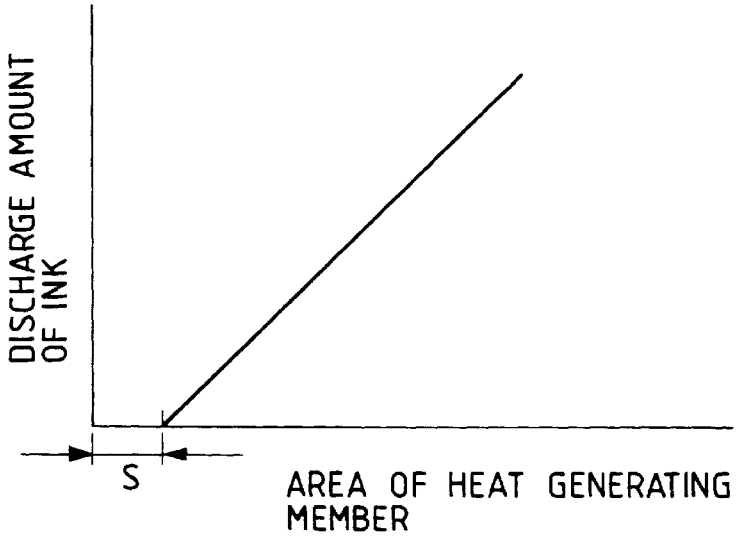
FIG. 16 PRIOR ART
FIG. 16 is a chart showing the relationship between the area of the heat generating member and the ink discharge amount.

In the conventional technology of so-called bubble jet printing which is the ink jet printing for effecting image formation by providing ink with energy such as heat to generate therein a state change involving a steep volume change (bubble generation), discharging the ink from the discharge port 18 by an action force resulting from such state change and depositing thus discharged ink onto the printing medium, the discharged amount of ink is in proportion to the area of the heat generating member as shown in FIG. 16, but there also exists an ineffective area s which does not contribute to the bubble generation. The state of cognation on the heat generating member 2 indicates that such ineffective area is present in the peripheral area of the heat generating member 2. Based on these results, it is assumed that a peripheral area, with a width of about 4 μm, of the heat generating member does not contribute to the heat generation.

Consequently, for effective utilization of the pressure of the bubble generation, it is considered effective to position the movable member 31 in such a manner that the movable member 31 covers an area immediately above the effective bubble generating area, which is inside the peripheral area of a width of about 4 μm of the heat generating member. In the present embodiment, the effective bubble generating area is considered as the area inside the peripheral area of a width of about 4 μm of the heat generating member, but such configuration is not restrictive depending on the kind of the heat generating member and the method of formation thereof.

Figure 17A:
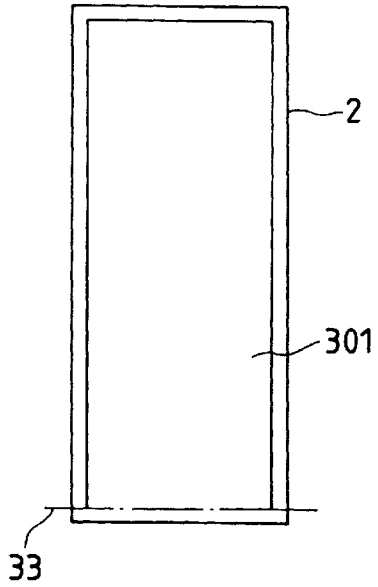
PRIOR ART FIG. 17A
FIGS. 17A and 17B are views showing the positional relationship between the movable member and the heat generating member.
Figure 17B:
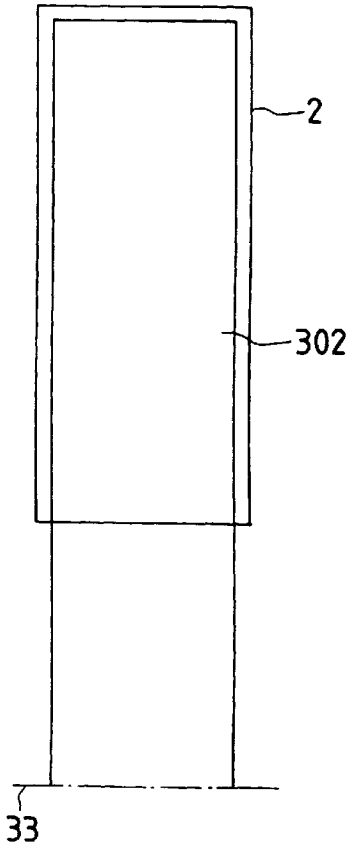
PRIOR ART FIG. 17B

FIGS. 17A and 17B are schematic views, seen from above, of the heat generating member 2 of an area of 58×150 μm, respectively superposed with the movable member 301 and 302 of different movable areas.

The movable member 301 has a dimension of 53×145 μm, which is smaller than the heat generating member 2 but is comparable to the effective bubble generating area of the heat generating member 2, and it is so positioned as to cover such effective bubble generating area. On the other hand, the movable member 302 has a dimension of 53×220 μm, which is larger than the heat generating member 2 (distance from the fulcrum to the movable end being longer than the length of the heat generating member 2, for the same width) and is so positioned as to cover the effective bubble generating area as in the case of the movable member 301. The durability and the discharge efficiency were measured for such movable members 301 and 302, under the following conditions:

| | |
|---|---|
| bubble generating liquid: | 40% aqueous solution of ethanol |
| discharge ink: | dye-containing ink |
| voltage: | 20.2 V |
| frequency: | 3 kHz |

The measurement under these conditions revealed that (1) the movable member 301 showed a damage in the fulcrum portion after the application of $1\times10^7$ pulses, while (2) the movable member 302 did not show any damage after the application of $3\times10^8$ pulses. It was also confirmed that the energy of motion, determined from the discharged amount and the discharging speed relative to the entered energy, was increased by 1.5 to 2.5 times.

Based on these results, it is preferable, in terms of the durability and the discharge efficiency, to position the movable member in such a manner that it covers an area directly above the effective bubble generating area and that the area of the movable member is larger than that of the heat generating member 2.

Figure 18:
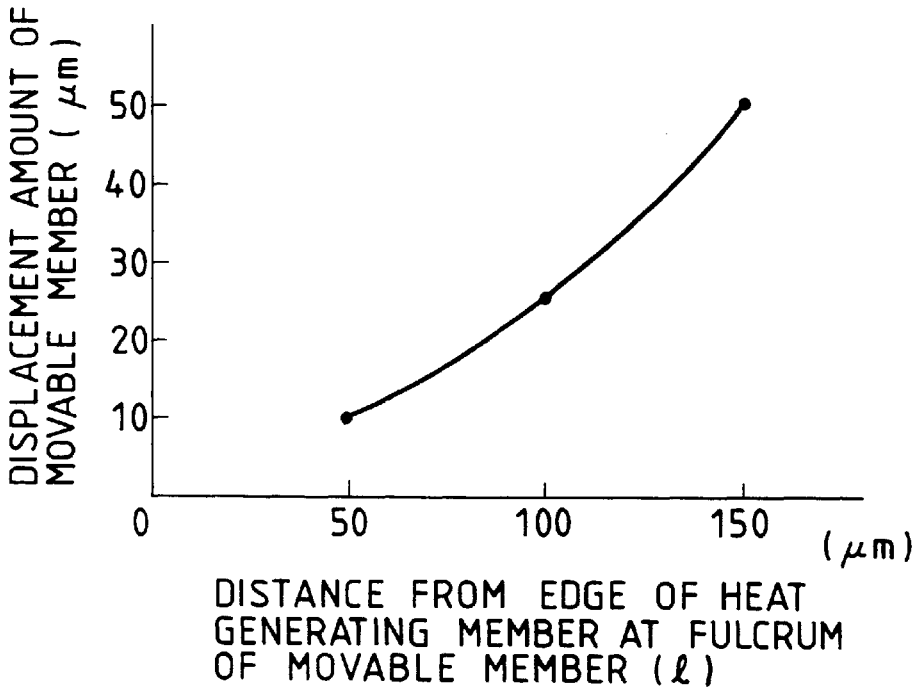
FIG. 18 PRIOR ART
FIG. 18 is a chart showing the relationship between the distance from the edge of the heat generating member to the fulcrum and the amount of displacement of the movable member.
Figure 19:
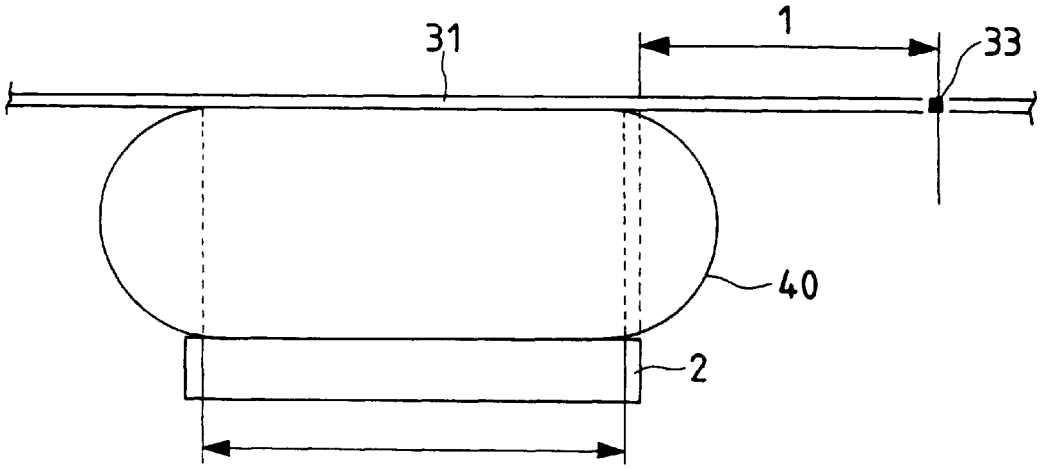
FIG. 19 PRIOR ART
FIG. 19 is a view showing the positional relationship between the heat generating member and the movable member.

FIG. 18 shows the relationship between the distance from the edge of the heat generating member 2 to the fulcrum of the movable member and the amount of displacement thereof. Also FIG. 19 is a lateral cross-sectional view showing the positional relationship of the heat generating member 2 and the movable member 31. The heat generating member 2 had a dimension of 40×105 μm. It will be understood that the amount of displacement increases with the increase in the distance from the edge of the heat generating member 2 to the fulcrum 33 of the movable member 31. It is therefore desirable to determine the optimum amount of displacement and to determine the position of the fulcrum 33 of the movable member 31, according to the desired discharge amount of ink, the structure of the liquid path for the discharge liquid and the shape of the heat generating member 2.

If the fulcrum 33 of the movable member 31 is positioned directly above the effective bubble generating area of the heat generating member 2, the durability of the movable member 31 becomes deteriorated since the fulcrum 33 directly receives the pressure of bubble generation, in addition to the strain by the displacement of the movable member 31. According to the experiment of the present inventors, the movable member showed deterioration in the durability, generating damage after the application of about $1\times10^6$ pulses, in case the fulcrum 33 was located directly above the effective bubble generating area. Consequently, a movable member 31 of a shape or a material of medium durability may also be employed by positioning the fulcrum thereof outside the area directly above the effective bubble generating area of the heat generating member 2. However, the fulcrum may also be positioned directly above such effective bubble generating area if the shape and the material are suitably selected. In this manner there can be obtained a liquid discharge head which is excellent in the discharge efficiency and in the durability.

[Element substrate]

In the following there will be explained the configuration of the element substrate 1, on which provided is the heat generating member 2 for giving heat to the liquid.

Figure 20A:
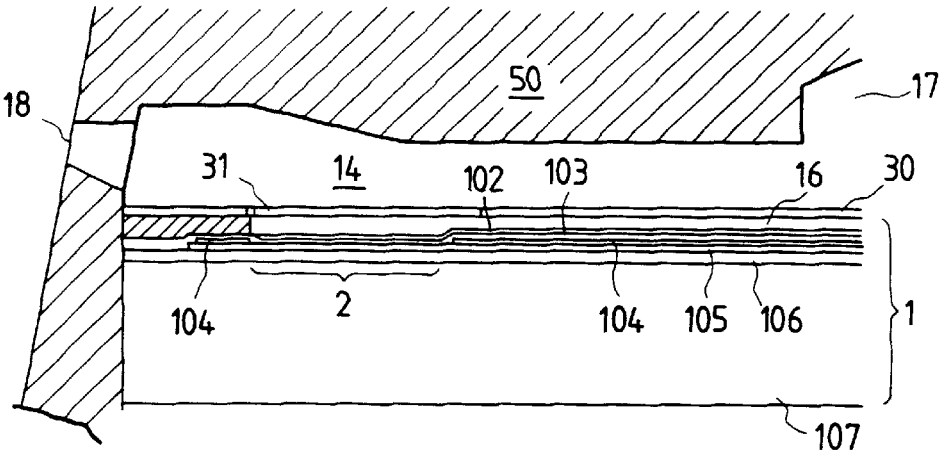
FIG. 20A PRIOR ART
FIGS. 20A and 20B are vertical cross-sectional views of a liquid discharge head of the present invention.
Figure 20B:
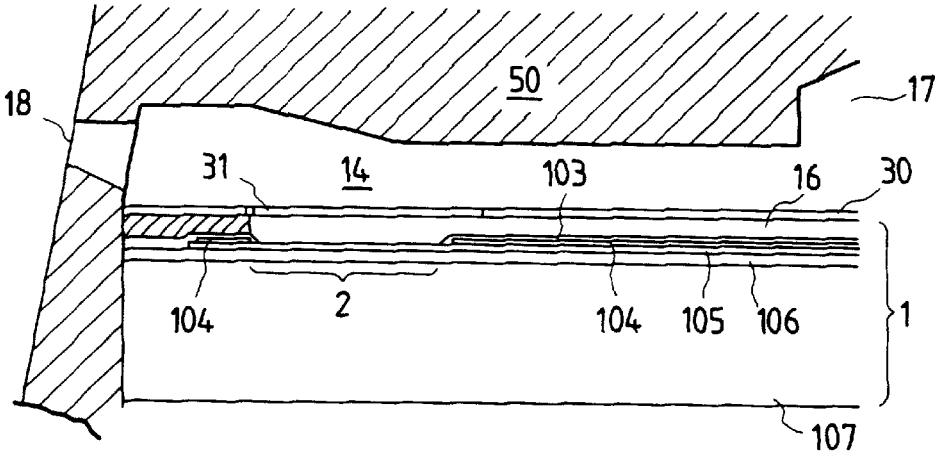
FIG. 20B PRIOR ART

FIGS. 20A and 20B are vertical cross-sectional views of the liquid discharge head of the present invention, respectively with and without a protective film to be explained later.

Above the element substrate 1, there is positioned a grooved member 50 provided with a second liquid's liquid path 16, a partition wall 30, a first liquid's path 14 and a groove for constituting the liquid path 14.

The element substrate 1 is prepared, on a substrate 107 such as of silicon, by forming a silicon oxide film or a silicon nitride film 106 for insulation and heat accumulation, and thereon patterning, as shown in FIG. 11, an electric resistance layer 105 (0.01–0.2 μm thick) composed for example of hafnium boride ($HfB_2$), tantalum nitride (TaN) or tantalum-aluminum (TaAl) and constituting the heat generating member 2 and wiring electrodes 104 (0.2–1.0 μm thick) composed for example of aluminum. The two wiring electrodes 104 apply a voltage to the electric resistance layer 105, thereby supplying a current thereto and generating heat therein. The electric resistance layer 105 between the wiring electrodes 104 bears thereon a protective layer 103 of a thickness of 0.1–2.0 μm, composed for example of silicon oxide or silicon nitride, and an anticavitation layer 102 (0.1–0.6 μm) composed for example of tantalum, for protecting the resistance layer 105 from ink or other liquids.

Since the pressure or the impact wave generated at the generation or vanishing of the bubble is very strong and significantly damages the durability of the hard and fragile oxide film, a metallic material such as tantalum (Ta) is employed as the anticavitation layer 102.

The above-mentioned protective layer 103 may be dispensed with by the combination of the liquid, the configuration of the liquid paths and the resistance material, as exemplified in FIG. 20B. An example of the material for the resistance layer which does not require the protective layer is iridium-tantalum-aluminum alloy.

The heat generating member 2 in the foregoing embodiments may be composed solely of the resistance layer (heat generating part) provided between the electrodes or may include the protective layer for protecting the resistance layer.

In the present embodiment, the heat generating member 2 has the heat generating part composed of the resistance layer which generates heat in response to the electrical signal, but such configuration is not restrictive and there may be employed any member capable of generating a bubble sufficient for discharging the discharge liquid. For example the heat generating member 2 may have an optothermal converting member which generates heat by receiving light such as from a laser, or a heat generating part which generates heat by receiving a high-frequency signal.

The element substrate 1 may be further provided, in addition to the electrothermal converting member which is composed of the resistance layer 105 constituting the aforementioned heat generating part and the wiring electrodes 104 for supplying the resistance layer 105 with the electrical signal, with functional elements such as transistors, diodes, latches and shift registers which are used for selectively driving the electrothermal converting element, and are integrally prepared by a semiconductor process.

Figure 21:
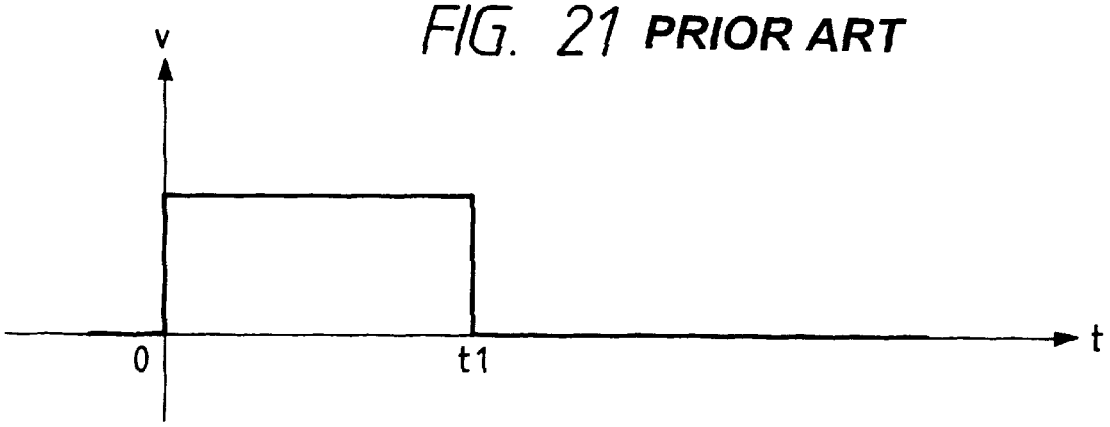
FIG. 21 PRIOR ART
FIG. 21 is a chart showing the shape of a driving pulse.
Figure 22:
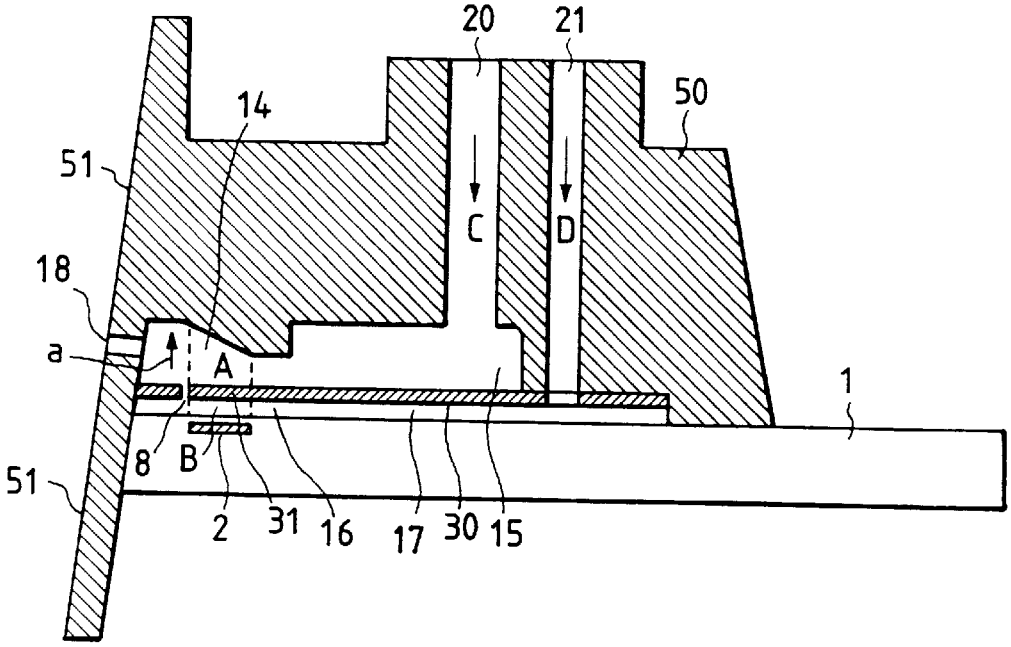
FIG. 22 PRIOR ART
FIG. 22 is a cross-sectional view showing a supply path of the liquid discharge head of the present invention.
Figure 23:
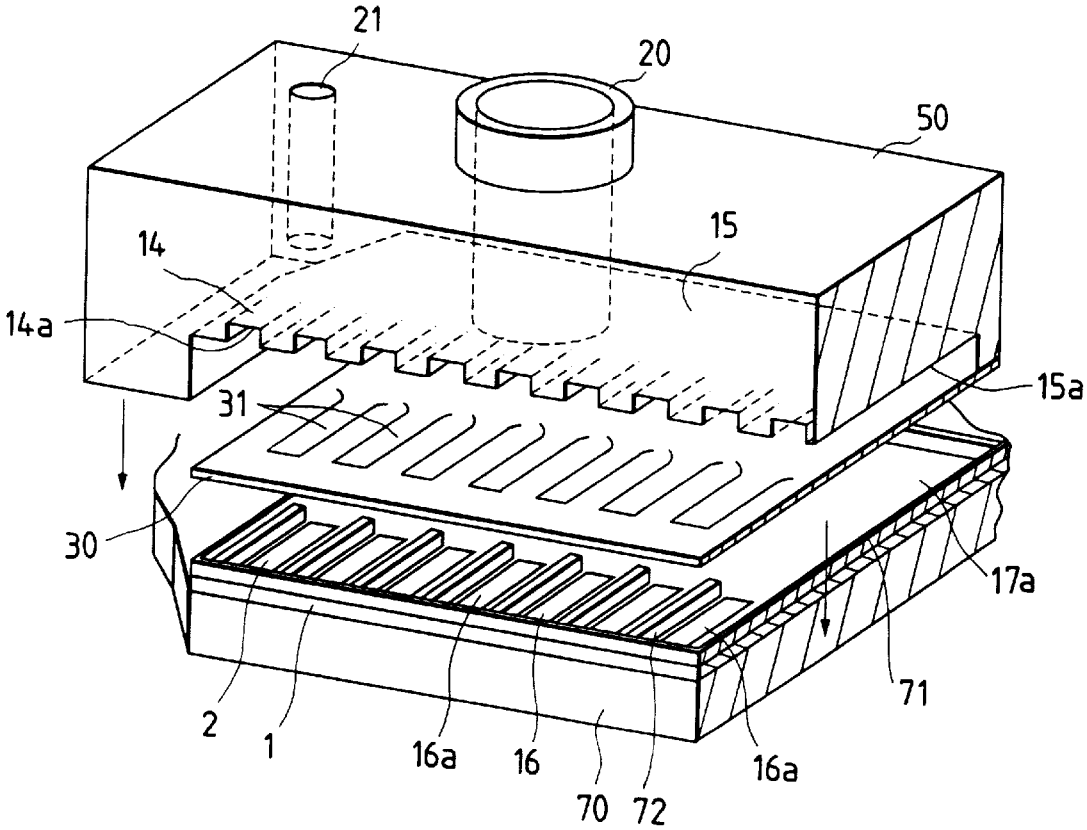
FIG. 23 PRIOR ART
FIG. 23 is an exploded partial perspective view of an embodiment of the head of the present invention.

For discharging the liquid by driving the heat generating part of the electrothermal converting member provided on such element substrate 1, a rectangular pulse as shown in FIG. 21 is applied to the resistance layer 105 through the wiring electrodes 104 to induce rapid heat generation in the resistance layer 105. In the heads of the foregoing embodiments, an electrical signal of a voltage of 24 V, a pulse duration of 7 $\mu$sec and a current of 150 mA was applied with a frequency of 6 kHz to drive the heat generating member 2, thereby discharging ink from the discharge port 18 by the above-explained functions. However the drive signal is not limited to such conditions but may have any conditions that can adequately generate a bubble in the bubble generating liquid.

EXAMPLE 1

Figure 24:
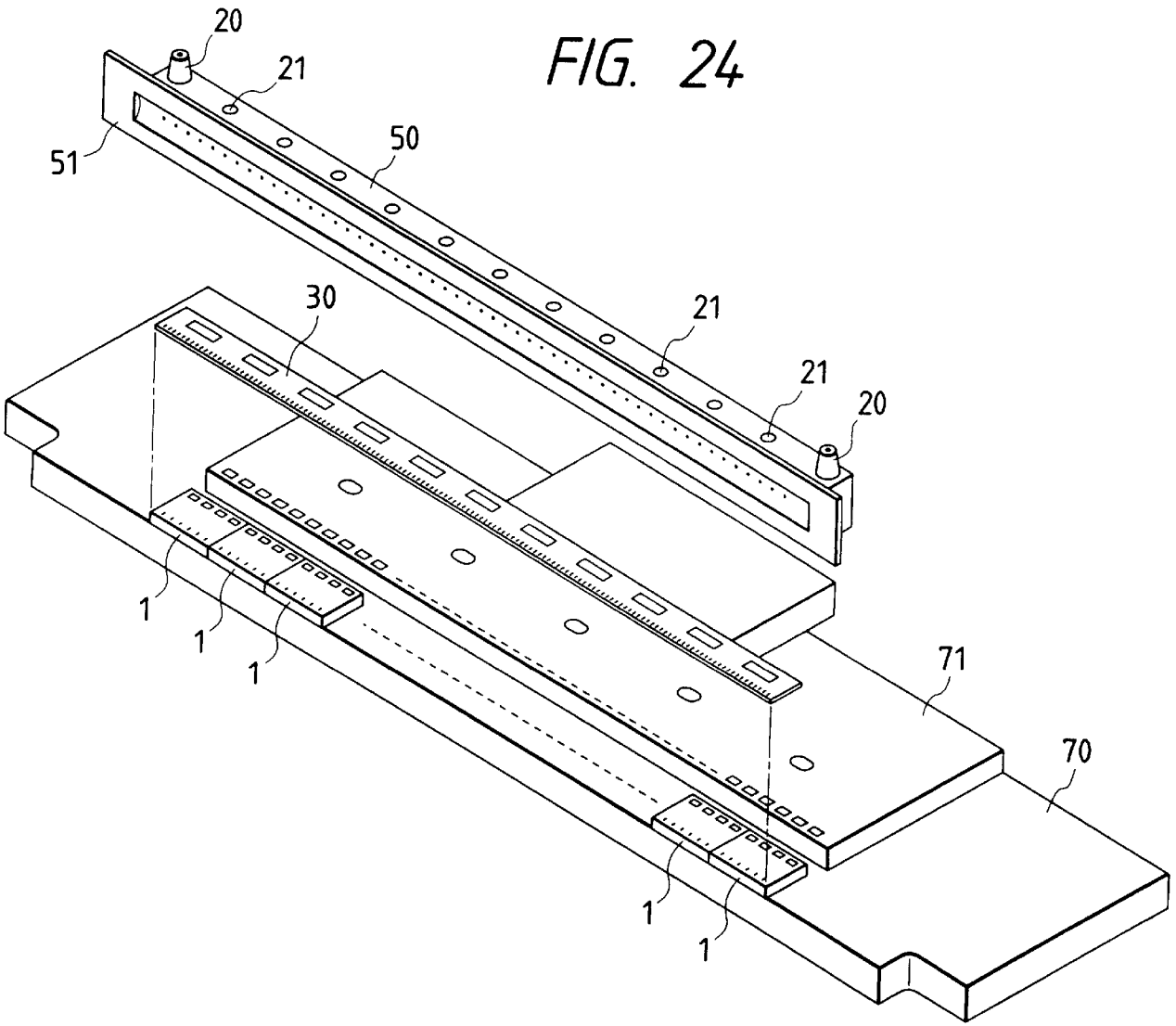
FIG. 24 is an entire exploded perspective view of an embodiment of the head of the present invention.
Figure 35:
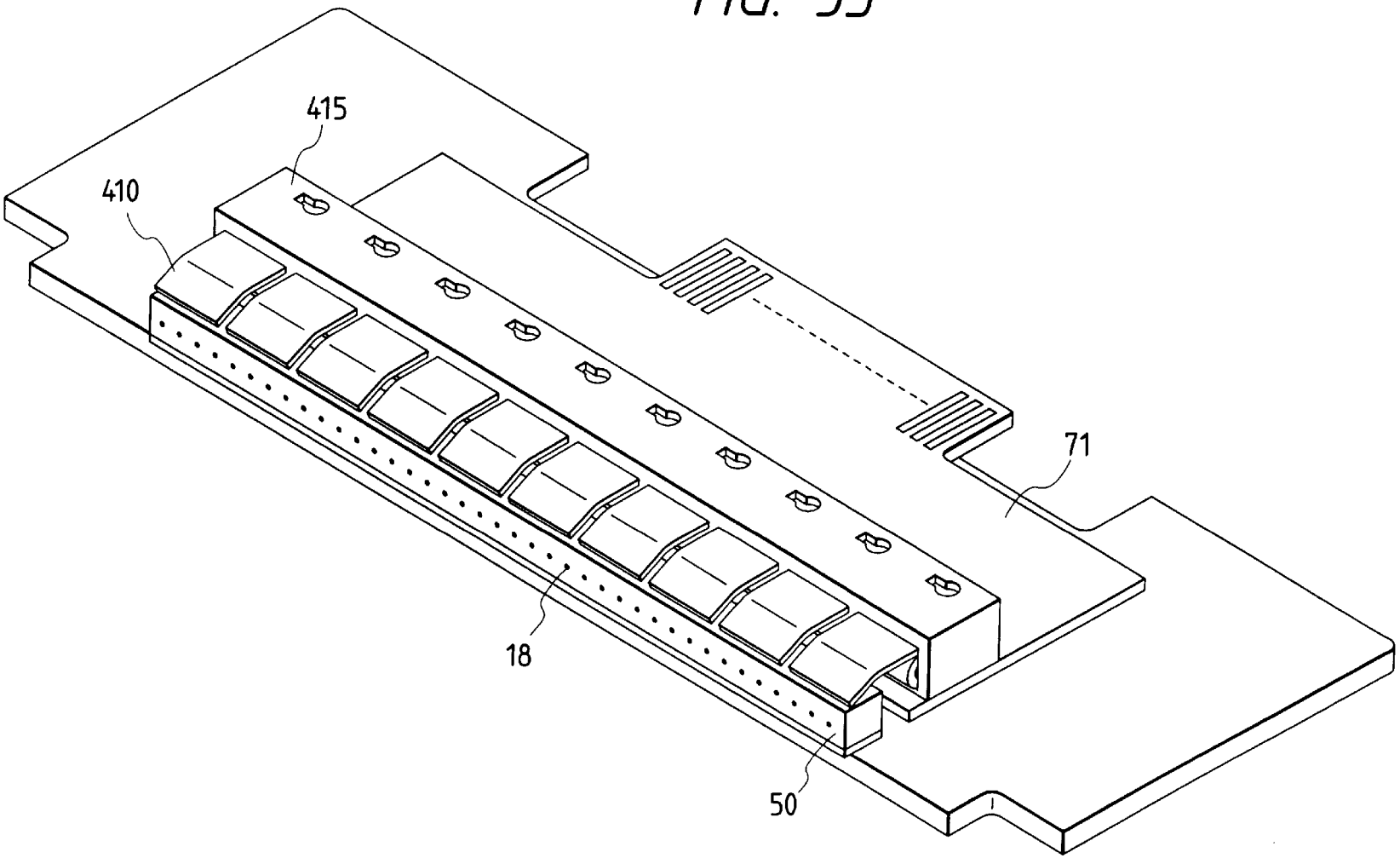
FIG. 35 is a perspective view showing the schematic configuration of a liquid discharge head of the present invention.

Now reference is made to FIGS. 35 and 24 for explaining the basic structure of the liquid discharge head of the two-flow-path configuration in which the present invention is applicable. FIG. 35 is a schematic perspective view showing the schematic configuration of the liquid discharge head, while FIG. 24 is a perspective view of a base plate, a silicon substrate unit and a wiring board constituting the liquid discharge head.

The liquid discharge head shown in these drawings is based on an ink jet printing method in which liquid is discharged by transmitting the heat generated by the heat generating member to the liquid, thereby causing film boiling phenomenon therein. In this example, the liquid discharge head is assumed to be an ink jet recording head (hereinafter simply called recording head) for recording an image on a recording medium by discharging ink.

As shown in FIG. 24, the ink jet recording head has a wiring board 71 and a plurality of silicon substrate units 1, laminated on a base plate 70. Each silicon substrate unit is provided with energy generating elements 2 for generating energy for ink discharge at arbitrary timings in response to externally supplied electrical signals, signal pads for driving the energy generating elements and power pads for supplying the electric power for driving the signal pads. On the base plate 70, the silicon substrate units 1 are adhered in such a manner that pads (not shown) provided thereon are in a predetermined positional relationship with signal/power supply pads (not shown) provided on the wiring board 71. The wiring board 71 is further provided with a connector (not shown) for receiving the print signals and the driving electric power from the exterior.

Then the silicon substrate units 1 and the wiring board already adhered on the base plate 70 are connected by wire bonding.

In the following there will be explained a cover plate 50.

The cover plate 50 shown in FIG. 24 is molded by a known method, then subjected to a simultaneous grinding process for the surface of the orifice plate, the face bearing the ink paths and the face to be adhered to the heater board, and is then subjected to the formation of an ink-repellent film on the surface of the orifice plate, in order to prevent deterioration of the discharging ability by ink wetting in the periphery of each orifice present on the surface of the orifice plate.

Subsequently an ink path groove is formed with an excimer laser, corresponding to each energy generating element 1 of the silicon substrate unit 1 shown in FIG. 35. In this operation, the laser beam working is repeated with a mask, with a unit of 128 ink paths as in the heater board. After the formation of the ink path grooves, orifices are formed with a mask from the rear side of the orifice plate, with a unit of 128 orifices at a time, as in the ink path grooves.

The cover plate 50 is provided with ink paths provided corresponding to the energy generating elements 1 formed on the silicon substrate unit 1, orifices 18 provided respectively corresponding to the ink paths and serving to discharge the ink toward the recording medium, a liquid chamber for supplying the ink paths with ink, and an ink supply aperture 20 for feeding ink, supplied from an ink tank (not shown), into the liquid chamber. Naturally the cover plate 50 is formed with such a length that substantially covers the array of the energy generating elements, formed by the array of the plural silicon substrate units 1.

The cover plate 50 is mounted in such a manner that the ink paths thereof are in a predetermined positional relationship with the energy generating elements provided on the silicon substrate unit 1, arranged on the base plate 70.

Such mounting can be achieved in various manners, for example by mechanical pressing with springs 410 and a spring holder 415 supporting the springs 410 or by fixing with an adhesive material.

The material constituting the cover plate 50 can be a resinous material allowing precise groove formation, but there are additionally desired excellent mechanical strength, dimensional stability and ink resistance. For meeting these requirements there is preferred epoxy resin, acrylic resin, diglycol-dialkyl carbonate resin, unsaturated polyester resin, polyurethane resin, polyimide resin, melamine resin, phenolic resin or urea resin, and particularly preferred in terms of the moldability and the liquid resistance is polysulfone resin or polyethersulfone resin.

Figure 25:
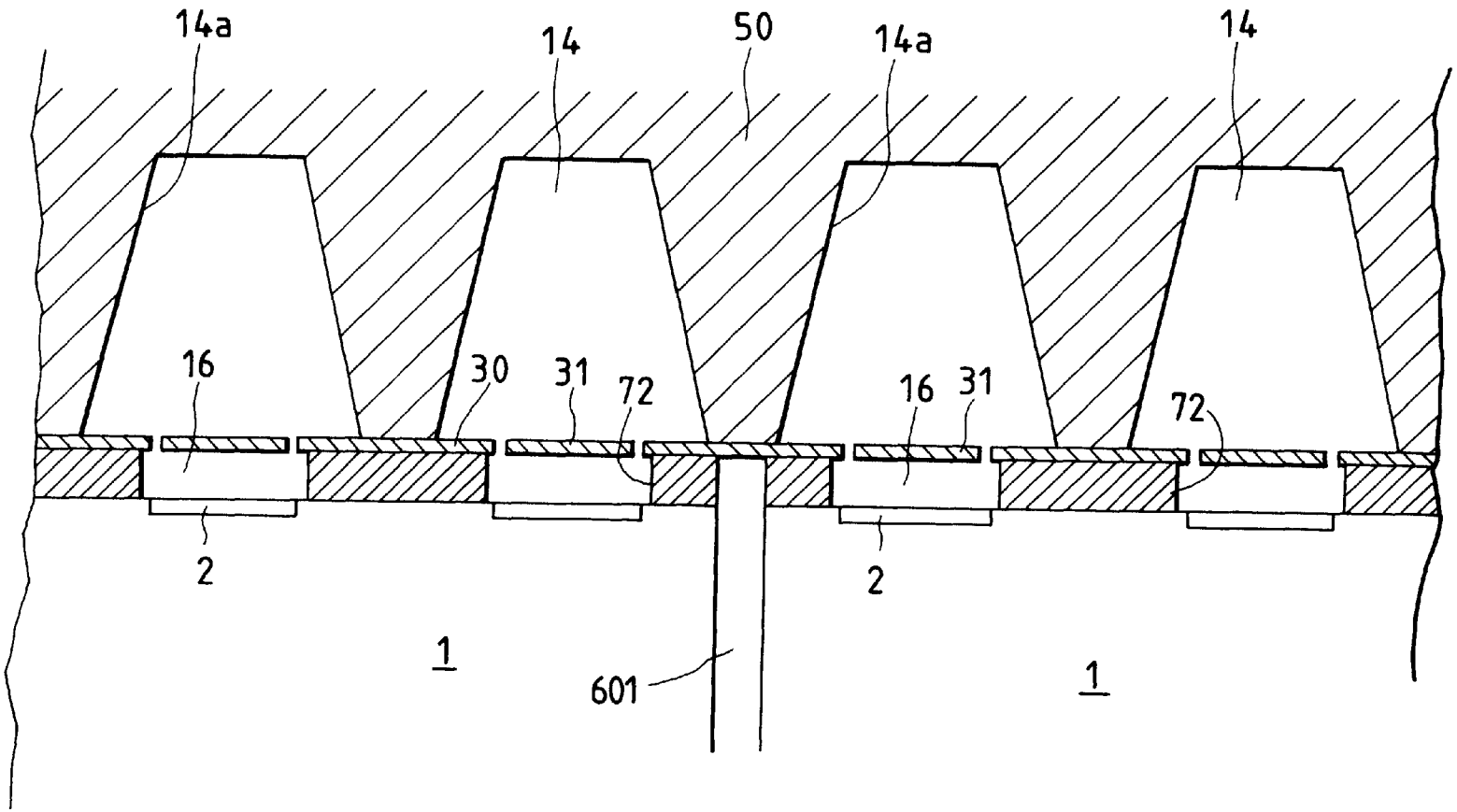
FIG. 25 is a magnified partial cross-sectional view of the embodiment shown in FIG. 24.
Figure 36:
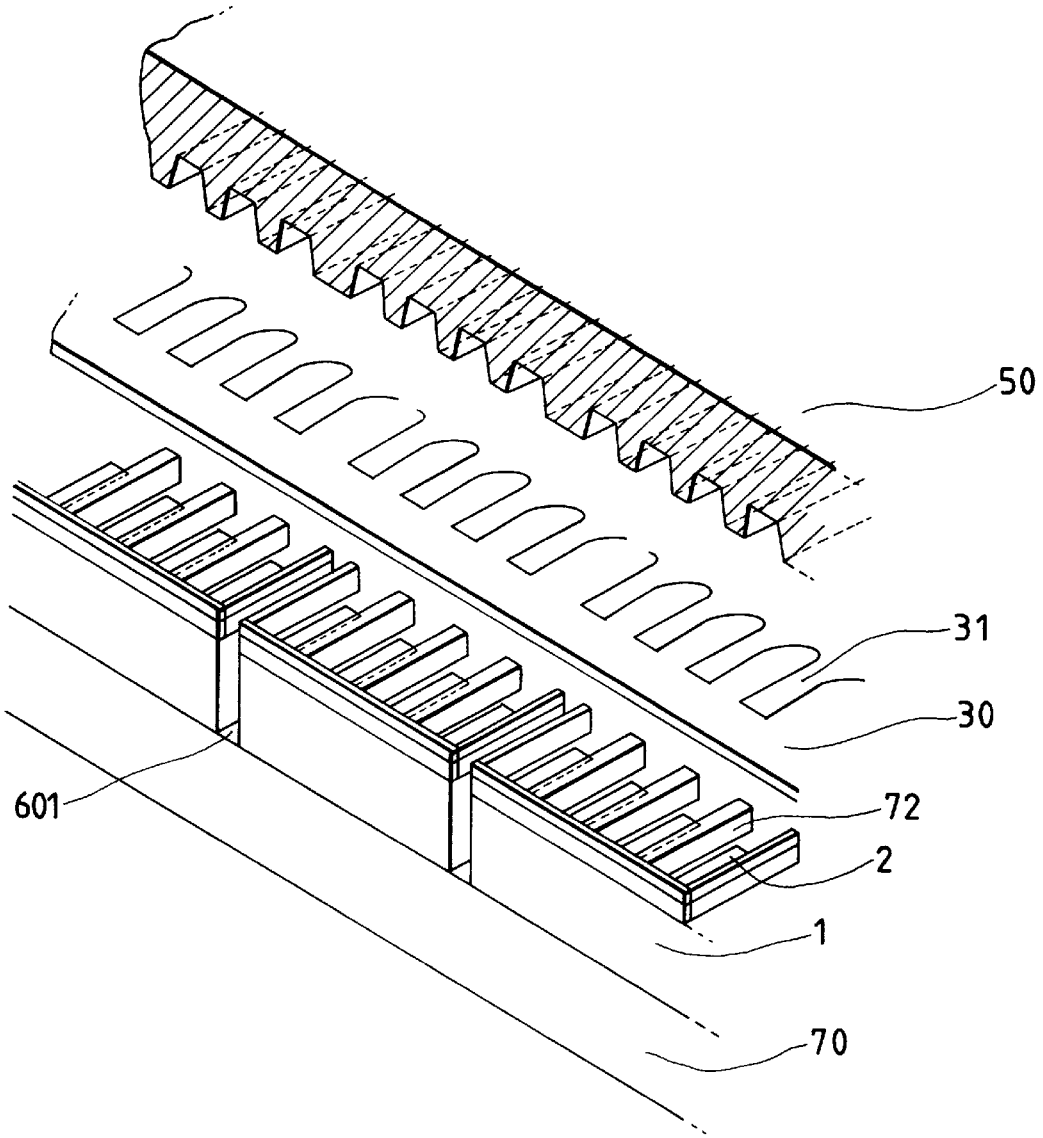
FIG. 36 is a perspective view showing a fourth embodiment of the liquid discharge head of the present invention.

A main aspect of the present invention will be described with reference to FIGS. 36 and 25. FIG. 36 is a magnified schematic perspective view of the principal parts of FIG. 24. FIG. 25 is a cross-sectional view, perpendicular to the liquid paths, of the heat generating member portion of the recording head shown in FIG. 24. Walls 72 of the second liquid path stand on both sides of the heat generating member 2, and the adjacent silicon substrate units 1 are so arranged that the respective liquid path walls are mutually opposed. Thus, by placing the partition wall 30 on the walls 72 of the second liquid paths, there are defined the second liquid paths, and the gap 601 between the adjacent silicon substrate units 1 is sealed by the partition wall 30.

As explained above, in the ink jet recording head of the present example, the above-mentioned gap can be securely covered by the partition wall and the two-path configuration can be realized with a single component, whereby the liquid in the vicinity of the discharge port can be efficiently discharged and the power loss in such gap portion can be prevented. Thus there can be obtained printing of satisfactory quality.

EXAMPLE 2

In contrast to the example 1 in which the partition wall 30 is composed of a single member, the partition wall 30 of the present example is divided into plural portions corresponding to the element substrates 1.

Figure 26:
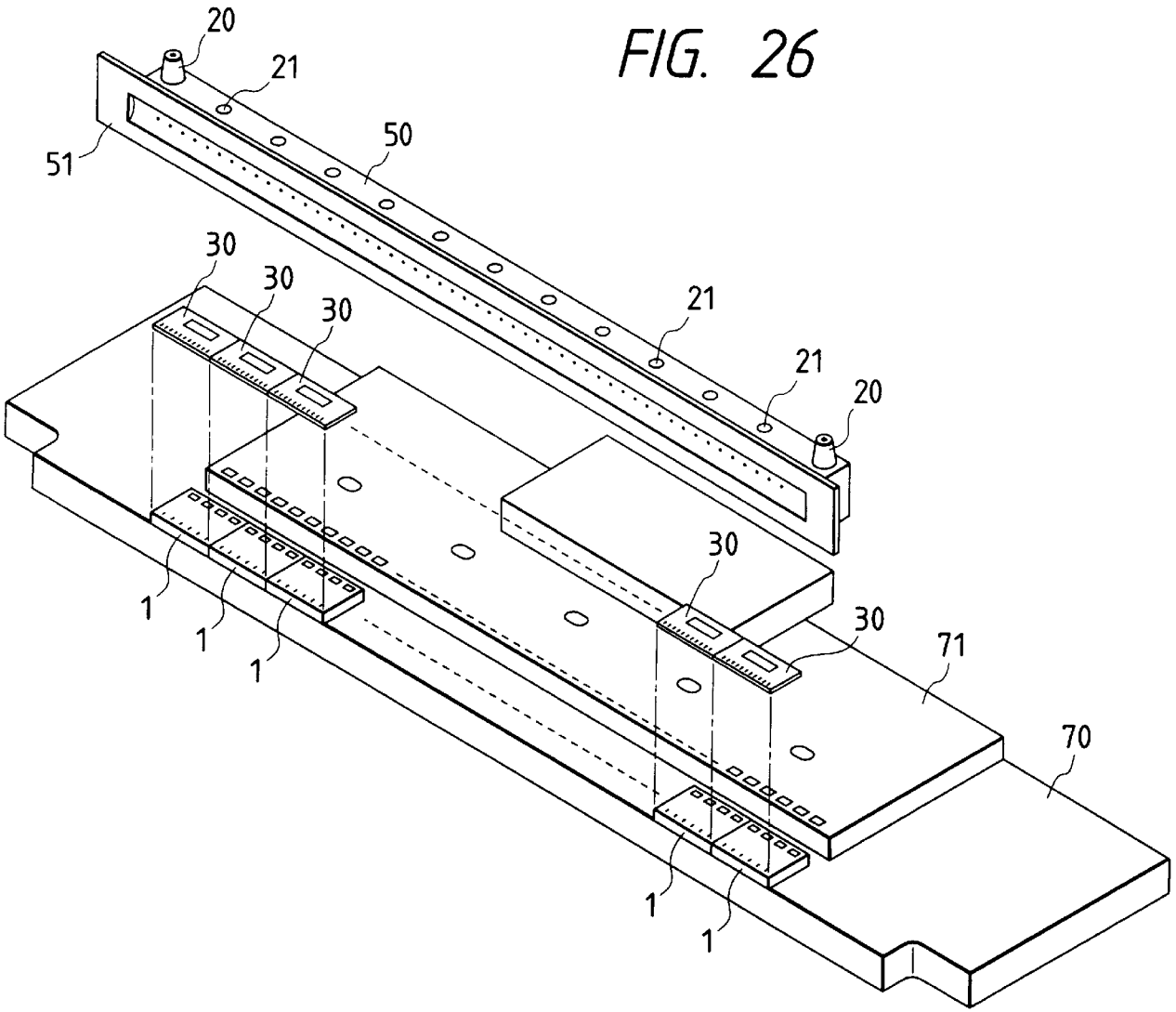
FIG. 26 is an entire exploded perspective view of another embodiment of the liquid discharge head of the present invention.
Figure 27:
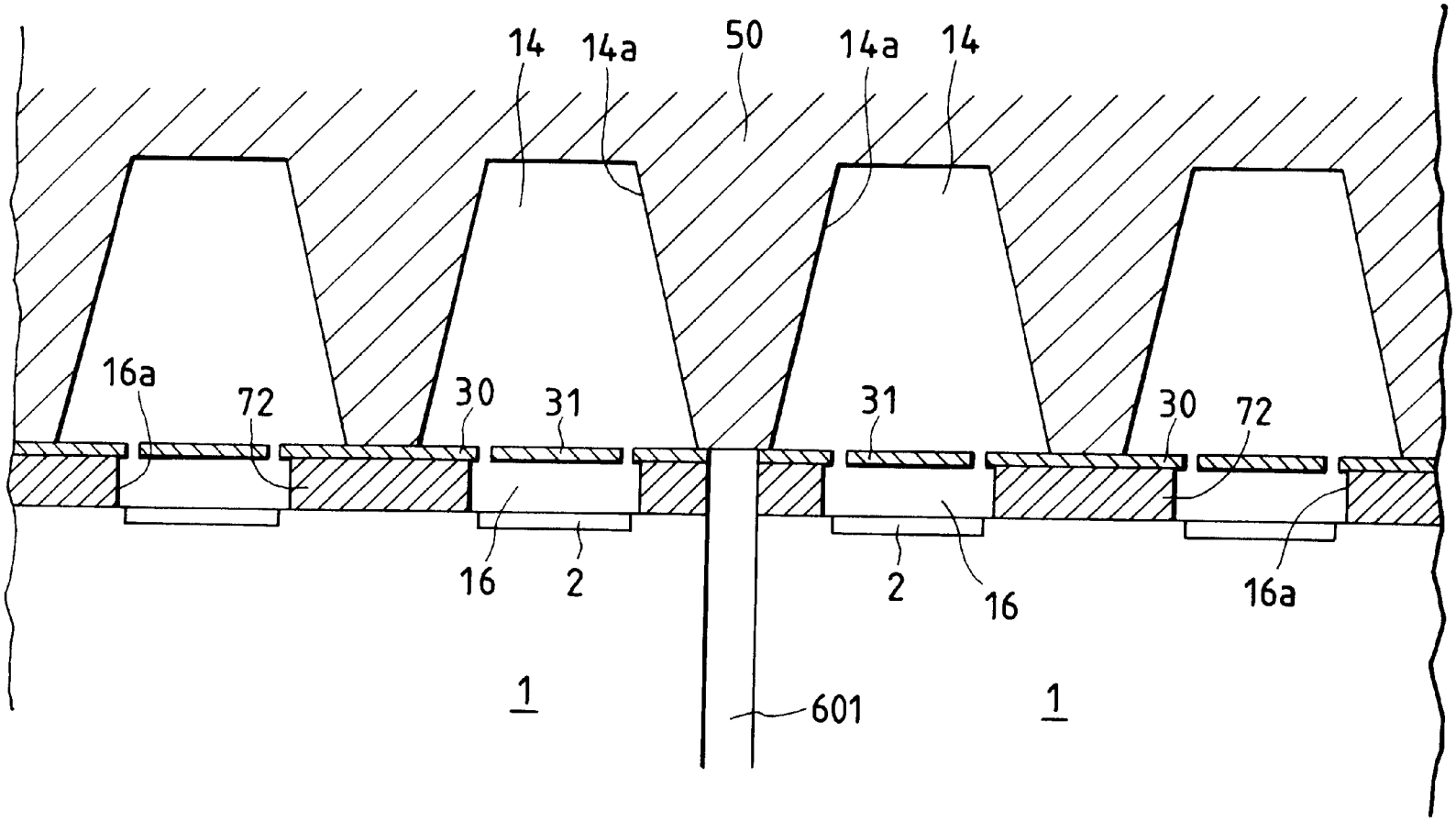
FIG. 27 is a magnified partial cross-sectional view of the embodiment shown in FIG. 26.

FIG. 26 is an exploded perspective view of the entire head of the present example, while FIG. 27 is a cross-sectional view, perpendicular to the liquid paths, of the heat generating members of the head shown in FIG. 26.

In the present example, the partition wall 30 can be prepared in a relatively small unit, so that there can be achieved an improvement in the production yield of the partition wall 30 and eventually of the liquid discharge head. Also the positioning of the partition wall 30 can be facilitated since the partition wall 30 can be positioned in a state adhered in advance to the element substrate 1.

EXAMPLE 3

Figure 28:
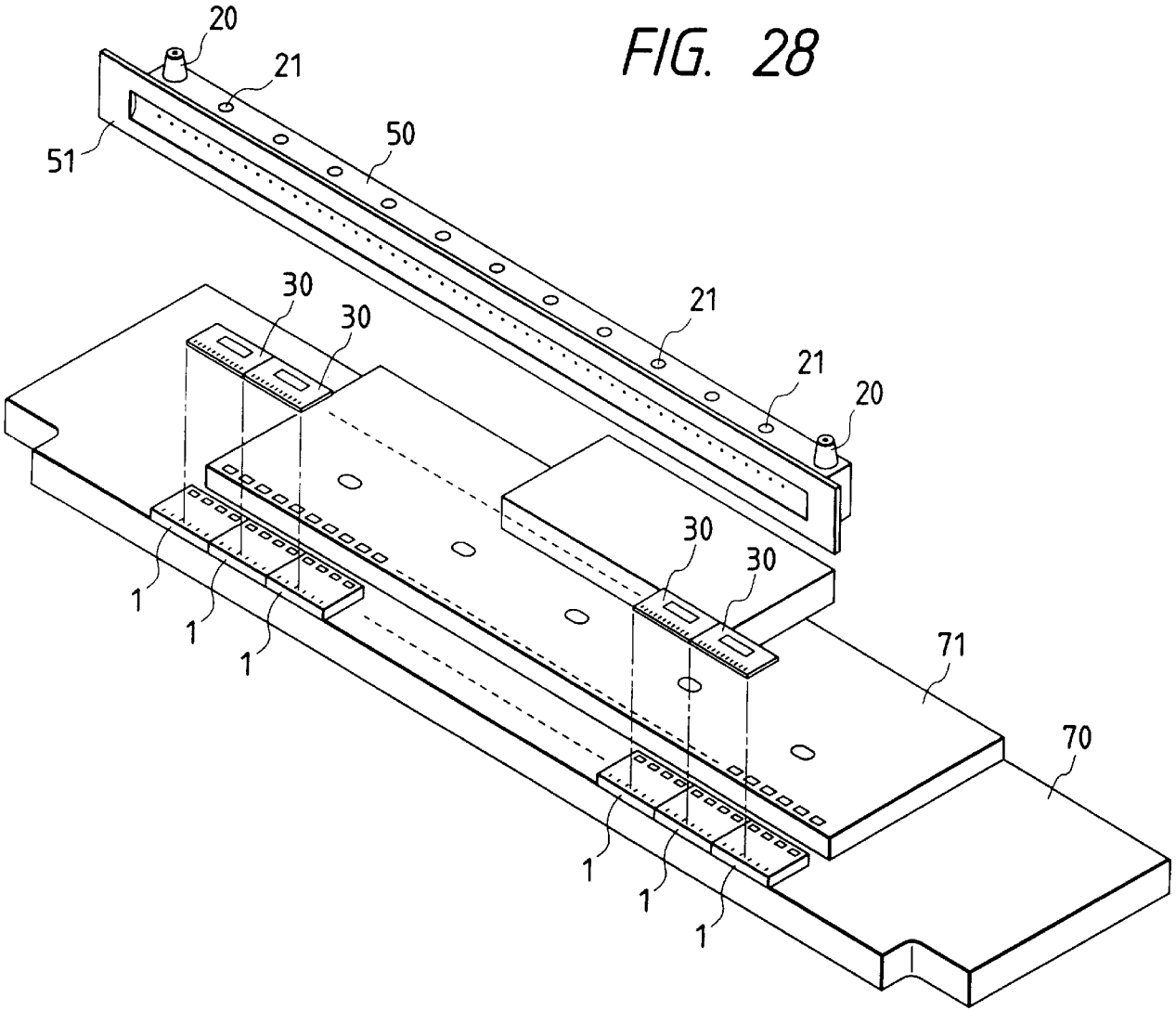
FIG. 28 is an entire exploded perspective view of still another embodiment of the liquid discharge head of the present invention.

In the example 2, the joint 601 of the element substrates 1 is not covered by the partition wall 30. However such joint 601 of the element substrates 1 can be covered by the partition wall 30, by displacing the plural partition walls 30 in the direction of array of the element substrates 1 for example by a half pitch of the element substrate 1 as shown in FIG. 28, thereby bridging each joint 601 with the partition wall 30. In such case, the number of the partition walls 30 may be made less than that of the element substrates 1.

EXAMPLE 4

Figure 37:
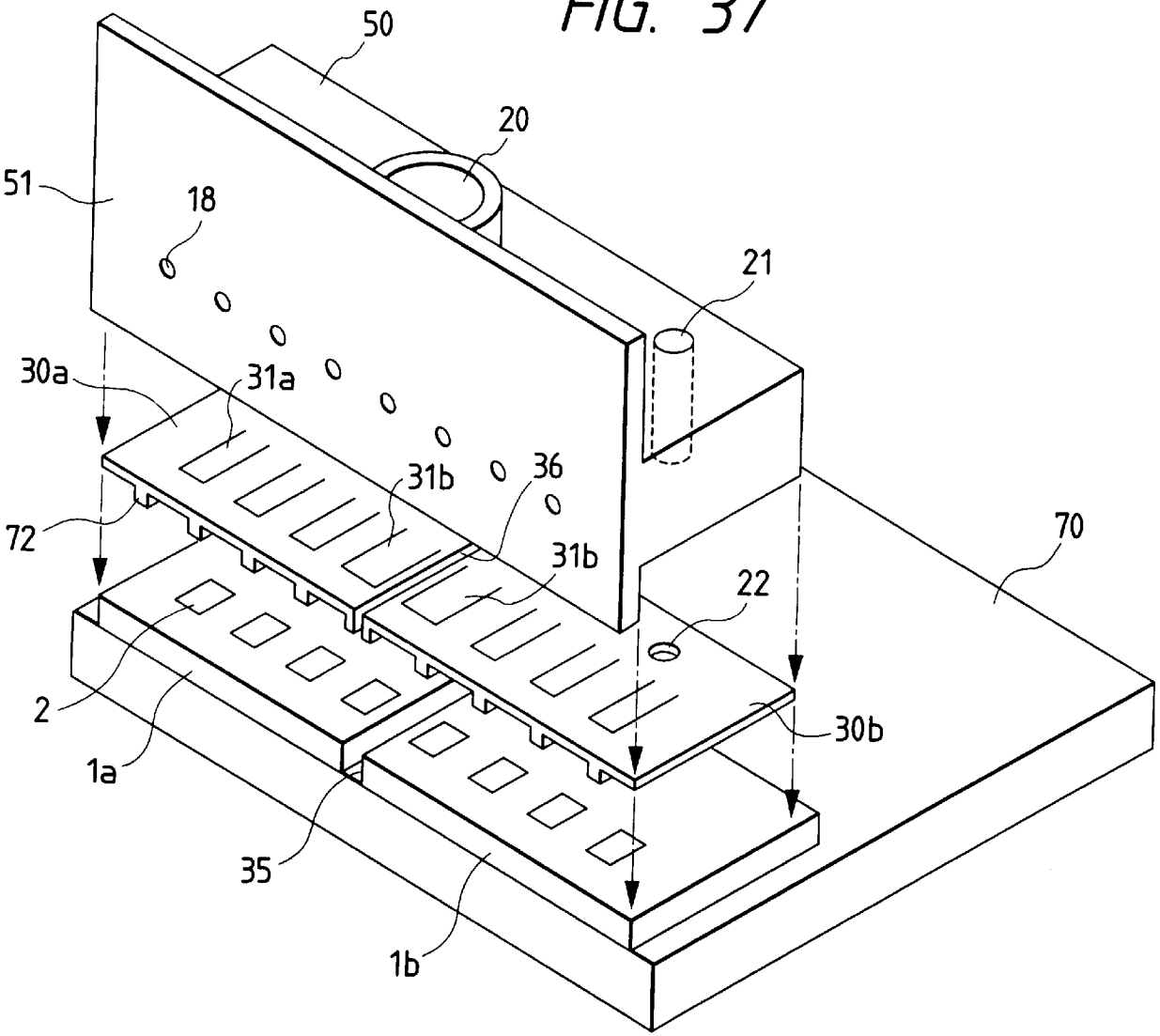
FIG. 37 is an exploded partial perspective view of the fourth embodiment of the present invention.

FIG. 37 is an exploded perspective view of a part of the liquid discharge head in a fourth example of the present invention.

The head shown in FIG. 37 is composed of a grooved member 50, partition walls 30*a*, 30*b*, substrates 1*a*, 1*b* and a support member 70 in a mutually adhered state. The discharge port 18 for liquid discharge is formed on a face 51 of the grooved member 50 and communicates with a groove (not shown) formed on the grooved member 50, corresponding to the discharge port 18. The grooves provided in plural units communicate with recesses (not shown) formed on the grooved member 50, and these grooves and recesses are adhered to the partition walls 30*a*, 30*b* to constitute a first liquid's liquid paths and a first common liquid chamber. The partition walls 30*a*, 30*b* bear movable members 31*a*, 31*b* and walls 72 of the second liquid's liquid paths, corresponding to the grooves, and are jointed to the substrates 1*a*, 1*b* adhered to the support member 70 to constitute the second liquid's liquid paths. The substrates 1*a*, 1*b* bear heat generating members 2, respectively corresponding to the second liquid's liquid paths, which communicate with a second common liquid chamber (not shown) formed by the jointing of the partition walls 30*a*, 30*b* with the substrates 1*a*, 1*b*. The second liquid's liquid paths receive the bubble generating liquid from a second liquid introducing path 21, through a partition wall hole 22 and the second common liquid chamber. Also the first liquid's liquid paths receive the discharge liquid from a first liquid introducing path 20, through the first common liquid chamber. The gaps between the partition walls 30*a*, 30*b* and between the substrates 1*a*, 1*b* are entirely or partially filled with a sealant or an adhesive material.

Figure 38:
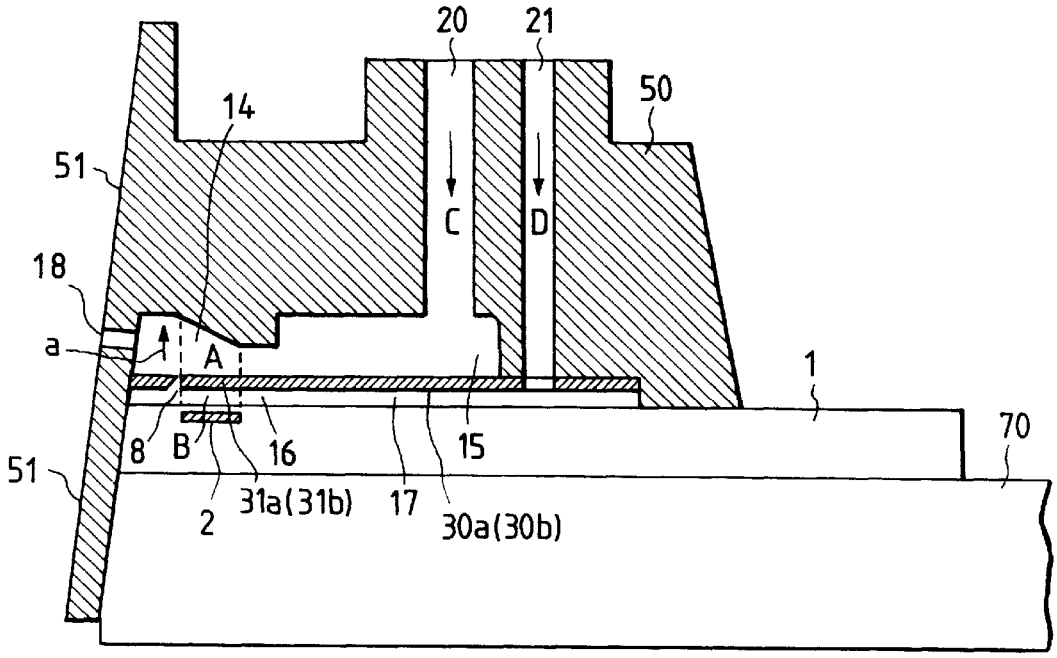
FIG. 38 is a partial cross-sectional view of the fourth embodiment of the head of the present invention.

FIG. 38 is a cross-sectional view of the head shown in FIG. 37.

In this example, the grooved member 50 is provided with an orifice plate having the discharge ports 18, plural grooves constituting the plural first liquid's liquid paths 14, and a recess constituting the first common liquid chamber commonly communicating with the plural paths 14 and serving to supply the liquid (discharge liquid) to the first liquid's liquid paths.

The plural first liquid's liquid paths 14 can be formed by adhering the partition walls 30*a*, 30*b* to the lower face of the grooved member 50. Such grooved member 50 is provided therein with a first liquid supply path 20 starting from the top and reaching the first common liquid chamber 15, and a second liquid supply path 21 starting from the top, penetrating the partition wall 30 and reaching the second common liquid chamber 17.

The first liquid (discharge liquid) is supplied, as indicated by an arrow C in FIG. 38, through the first liquid supply path 20 to the first common liquid chamber 15 and then to the first liquid's liquid paths 14, while the second liquid (bubble generating liquid) is supplied, as indicated by an arrow D in FIG. 38, through the second liquid supply path 21 to the second common liquid chamber 17 and then to the second liquid's liquid paths 16.

In the present example, the second liquid supply path 21 is provided parallel to the first liquid supply path 20, but it may be provided in any manner reaching the second common liquid chamber 17 through the partition wall 30 provided outside the first common liquid chamber 15.

The size (diameter) of the second liquid supply path is determined in consideration of the supply amount of the second liquid. The second liquid supply path need not be circular but can be of any other shape such as rectangular shape.

The second liquid common chamber 17 can also be formed by covering the grooved member 50 with the partition wall 30. The second common liquid chamber 17 and the second liquid's liquid paths 16 may be formed, as illustrated in the exploded perspective view in FIG. 38, by forming the frame of the common liquid chamber and the wall of the second luqid's liquid paths with a dry film on the substrate, and adhering the substrate 1 with the combination of the grooved member 50 and the partition wall 30.

In the present example, on the support member 70 composed of a metal such as aluminum, there is provided the substrate 1 provided with plural electrothermal converting elements, constituting the heat generating members for generating heat, thereby inducing film boiling in the bubble generating liquid to generating bubbles therein.

The heat generating member 2 generates heat under application of a voltage by the conductive electrodes 5 for example of aluminum.

The grooved member 50 is provided with grooves to constitute the discharge liquid paths (first liquid's liquid paths) 14 upon adhesion with the partition wall 30, a recess for constituting the first common liquid chamber (discharge liquid common chamber) 15 which communicates with the discharge liquid paths and supplies these paths with the discharge liquid, a first supply path (discharge liquid supply path) 20 for supplying the first common liquid chamber with the discharge liquid, and a second suply path (bubble generating liquid supply path) 21 for supplying the second common liquid chamber 17 with the bubble generating liquid. The second supply path 21 is connected to a path positiooned outside the first common liquid chamber 15 and leading to the second common liquid chamber 17 through the partition wall 30, and such path allows to supply the bubble generating liquid to the second common liquid chamber 15 without mixing with the discharge liquid.

The positional relationship of the substrate 1, the partition wall 30 and the grooved cover plate 50 is such that the heat generating members of the substrate 1 correspond to the movable members 31, which in turn correspond to the discharge liquid paths 14. In the present example, a second supply path is provided in the grooved member, but such second supply path may be provided in plural units according to the required supply amount. Also the cross sections of the discharge liquid supply path 20 and the bubble generating liquid supply path 21 are to be determined in proportion to the supply amounts.

The optimization of such cross sections of the supply paths allows to compactize the components constituting the grooved member 50 etc.

In increasing the number of the discharge nozzles, it is preferable to use a plurability of small substrates in combination, instead of using a single large substrate, in consideration of the ease of manufacture. For this reason, the present example employs two substrates as already explained before. However there is formed a gap 35 between the substrates la and 1*b* as shown in FIG. 37, and the pressure of generated bubble may leak from such gap. The gap 35 may be filled with a sealant, but the surface condition of the heat generating member 2 may become uneven by such sealant, thus reducing the size of the generated bubble. At the end of the substrate, the pressure from the heat generating member 2 may not be transmitted sufficiently at the liquid discharge, for the above-mentioned reason and also for other reasons. Consequently, in the present example, the movable member 31*b* corresponding to the heat generating member at the end of the substrate is so shaped as to more sufficiently receive the pressure of the bubble and to increase the discharge efficiency. More specifically, such movable member is made larger than other movable members. In this manner the discharge characteristics of the nozzles are made uniform, and there can be avoided the locally low density at the end of the substrate, resulting from a lower discharge amount by the lower efficiency at such end portion.

In the present example, the partition walls 30*a*, 30*b* also have a gap 36 there between, which may similarly cause unevenness in the image. However, it is possible to improve the image quality by modifying a part of the movable members as explained above.

The modification of the movable member may be made not only by the size thereof but also by other designing parameters capable of varying the discharge characteristics such as the position of the fulcrum or the free end.

Also in case the discharge amount becomes larger in such portion, the design of the movable member may be similarly modified so as to obtain uniform discharge characteristics.

As explained in the foregoing, the present example allows to avoid the loss of the discharge characteristics at the boundary of the substrates, by increasing the size of the movable member at such boundary in comparison with the movable members in other portions.

EXAMPLE 5

Figure 39:
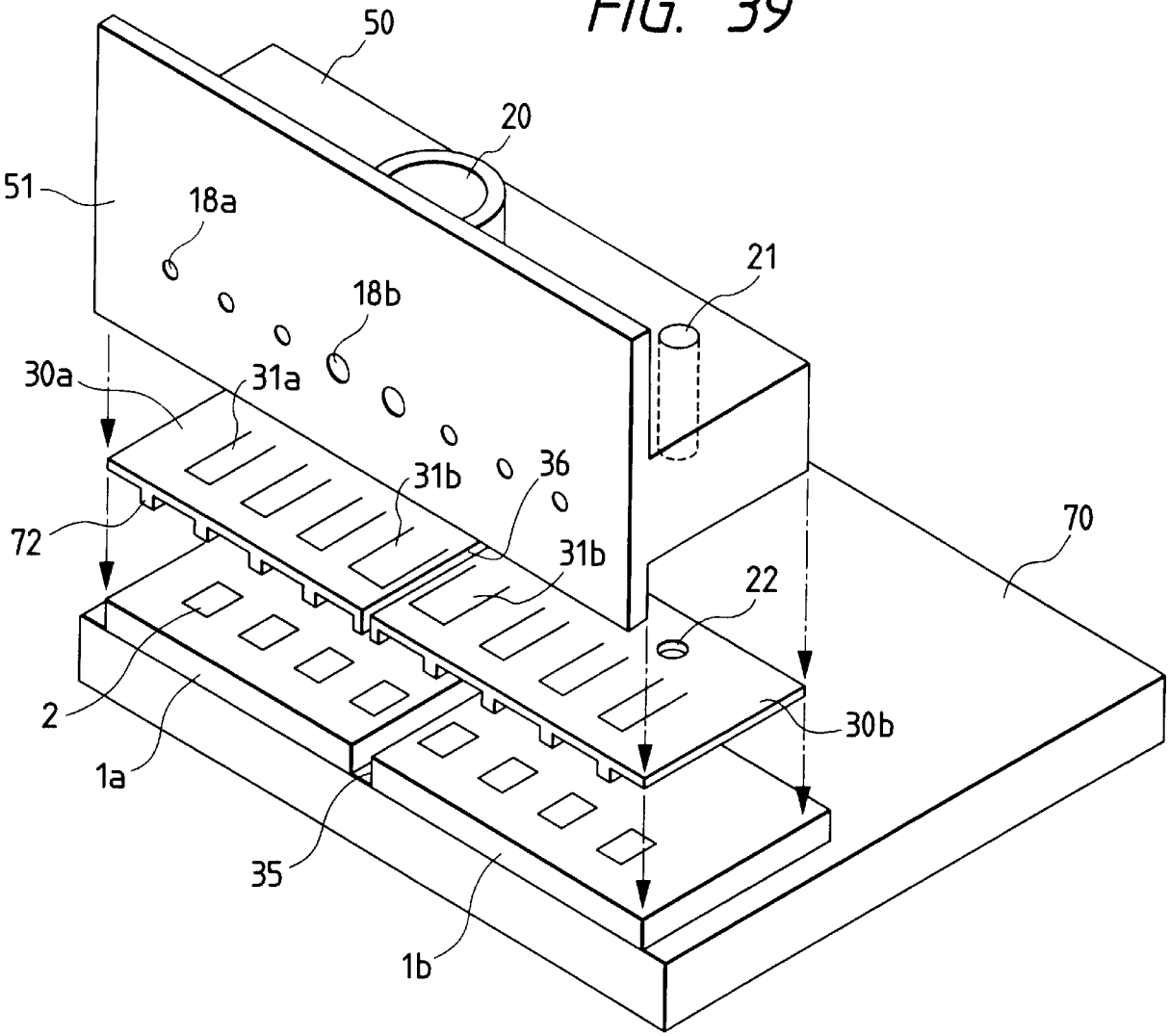
FIG. 39 is an exploded partial perspective view of a fifth embodiment of the head of the present invention.

The present example will be explained with reference to FIG. 39. The basic configuration in this example is same as that shown in FIG. 37, and will not, therefore, be explained further.

In this example, the factor of unevenness resulting from the partition walls 30*a*, 30*b*, for example that resulting from the gap 36 therebetween, is coped with by the grooved member 50. More specifically, the discharge characteristics and the discharge amounts of the nozzles within the head are made uniform by increasing the aperture area of the discharge port 18, corresponding to the gap 36 of the partition walls.

The size of the discharge ports can be made locally different by an adjustment in the mask size, in case the discharge ports are formed with the light of a laser and a mask. Consequently the unevenness in the discharge characteristics can be easily rectified.

EXAMPLE 6

Figure 40:
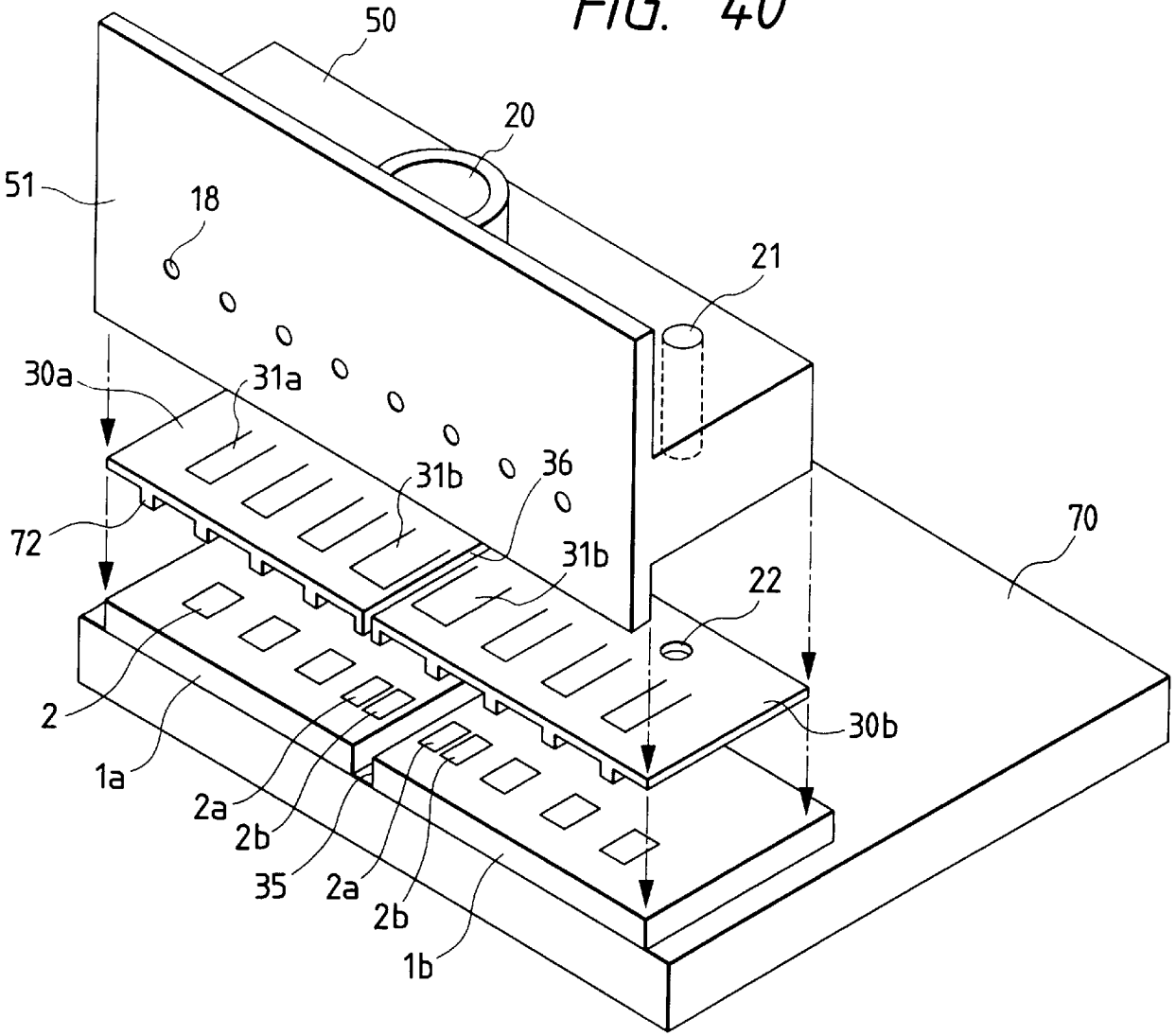
FIG. 40 is a partial cross-sectional view of a sixth embodiment of the head of the present invention.

The present example will be explained with reference to FIG. 40. The basic configuration in this example is also same as that shown in FIG. 37, and will not, therefore, be explained further.

In the present example, the discharge characteristics are made uniform by forming plural heat generating members 2*a*, 2*b* in each liquid path, corresponding to the gap 36 which is present between the partition walls 30*a*, 30*b* and constitutes the factor of unevenness.

In this case, the modification can be made in the driving method, for example by generating heat by the member 2*a* or 2*b* or by both, according to the level of unevenness in the discharge characteristics.

EXAMPLE 7

This example will be explained with reference to FIGS. 41A to 41C.

Figures 41A, 41B, 41C:
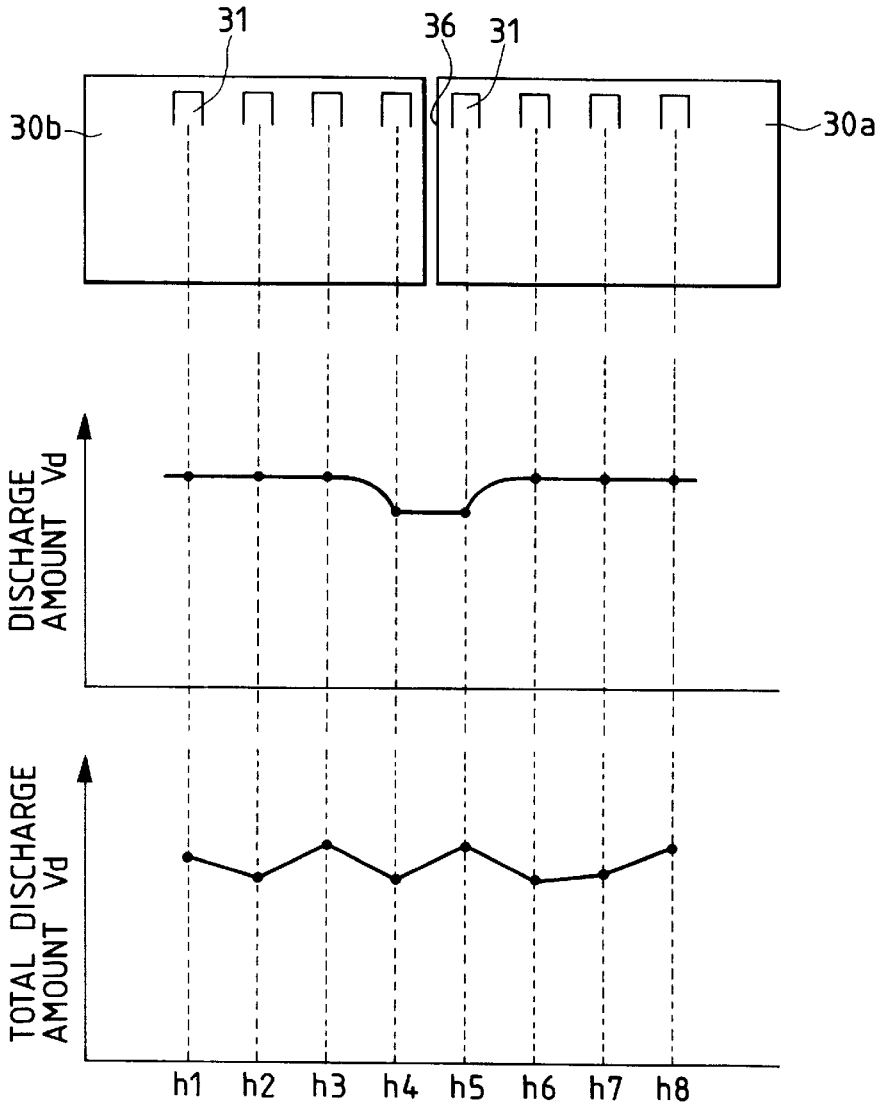

FIG. 41A is a view of the pratition walls 30*a*, 30*b* corresponding to FIG. 37. Referring to FIG. 41A, as explained in the foregoing example where all the movable members 31 have a same size, the discharge amount in the vicinity of the gap 36 becomes lower (or higher) because of the influence thereof, as indicated in FIG. 41B.

In the present example, however, the movable members 31 have respectively different sizes as shown in FIG. 41A, so that the discharge characteristics fluctuate in random manner. Such fluctuation is superposed with the characteristics shown in FIG. 41B to provide a fluctuation of the discharge amount as shown in FIG. 41C.

Such fine intentional fluctuation can render the heat generating members, which are visually easily recognizable for example by the large and regular unevenness as shown in FIG. 41B, less conspicuous.

This example utilizing random fluctuation regardless of the position of the unevenness, is effective in case the location of generation of the uneven pattern is difficult to specify.

EXAMPLE 8

FIGS. 42A to 42E show the combination of plural substrates and a partition wall having plural movable members, and relative levels of the distribution of the discharge amount. The entire head configuration in this example is same as that in the example 6 or 7.

Figure 42A:
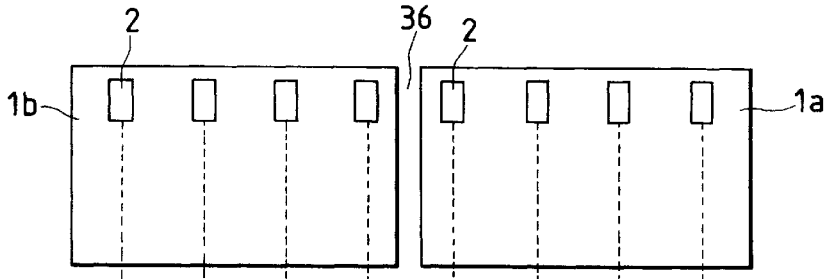
Figure 42B:
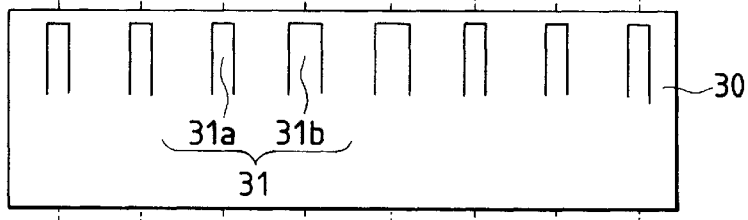
Figure 42C:
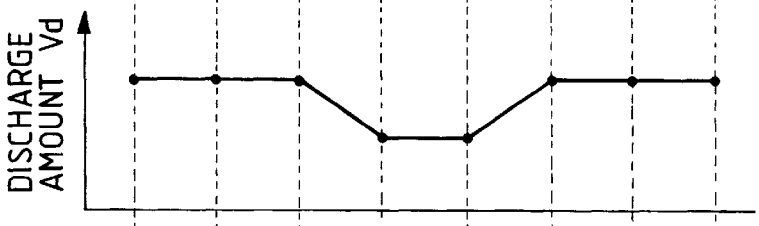

FIG. 42A shows the arrangement of the plural substrates, having heat generating members 2 of a same form (for example rectangular). In such case, if other components of the nozzles are same, the heat generating members 2 in the vicinity of the gap 36 between the substrates may result in a lowered discharge amount, because of the leak of the bubble pressure and the flow of the sealant into the gap 36, thus giving rise to a relative fluctuation of the discharge amount as shown in FIG. 42C.

Figure 42D:
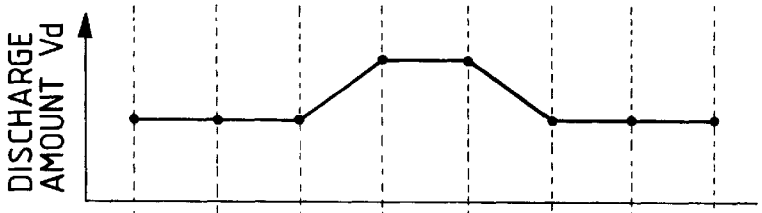

On the other hand, if the movable members 31 in the partition wall are made larger in size only in the portions corresponding to such heat generating members, such movable members 31 alone provides a distribution of the discharge amount as shown in FIG. 42D.

Figure 42E:
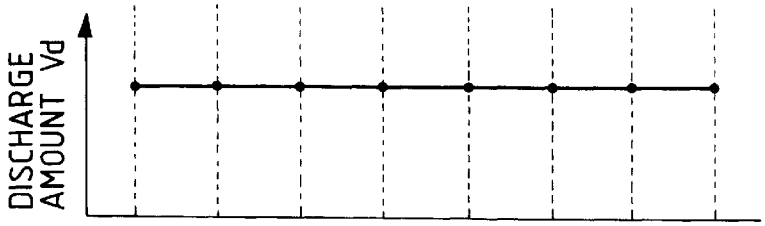

In a head obtained by combining these components, the fluctuations in the discharge amount are mutually canceled so that the discharge amount becomes uniform as shown in FIG. 42E, thus improving the image quality.

The examples 4 to 8 explained above allow to prevent the distortion in the recorded image resulting from various fluctuation factors in the head, such as the fluctuations in the discharge ports or nozzles of the grooved cover plate and the gaps of plural partition walls or of plural substrates, thereby achieving an improvement in the production yield and a reduction in the manufacturing cost.

[Discharge liquid, bubble generating liquid]

As explained in the foregoing examples, the present invention, employing a configuration with the movable members 31, allows to discharge the liquid with a higher discharge power, a discharge efficiency and a higher discharge speed, in comparison with the conventional liquid discharge head. Among such examples, if the bubble generating liquid and the discharge liquid are same, there can be employed liquid of various kinds as long as it does not deteriorate by the heat from the heat generating member 2, it hardly generate deposit on the heat generating member 2 upon heating, it is capable of reversible state change of gasification and condensation by heat and it does not deteriorate the liquid path, the movable member 31 and the partition wall 30.

Among such liquids, the ink of the composition employed in the conventional bubble jet printing apparatus may be employed as the liquid for printing.

On the other hand, in case the discharge liquid and the bubble generating liquid are made mutually different in the head of the present invention with the two-path configuration, the bubble generating liquid can have the properties as explained in the foregoing and can be composed, for example, methanol, ethanol, n-propanol, isopropanol, n-hexane, n-heptane, n-octane, toluene, xylene, methylene dichloride, trichlene, fleon TF, fleon BF, ethyether, dioxane, cyclohexane, methyl acetate, ethyl acetate, acetone, methylethylketone, water or a mixture thereof.

As the discharge liquid there can be employed various liquids irrespective of the bubble generating property or the thermal properties, and there can even be employed a liquid with low bubble generating property, a liquid easily denatured or deteriorated by heat or a liquid of a high viscosity, which cannot be easily discharged in the conventional art.

However the discharge liquid is preferably not to hinder the discharge, bubble generation or the function of the movable member 31 by a reaction of the discharge liquid itself or with the bubble generating liquid.

The discharge liquid for printing can for example be ink of high viscosity. Also a pharmaceutical liquid or perfume may be employed as the discharge liquid.

In the present invention, the printing operation was conducted with the inks of following compositions as the printing liquid that could be used for both the discharge liquid and the bubble generating liquid. There could be obtained a very satisfactory printed image because of the improved accuracy of landing of the droplet, as the ink discharge speed was made higher by the increased discharge power.

| | |
|---|---|
| dye (C.I. food black 2) | 3 wt. % |
| diethylene glycol | 10 wt. % |
| thioglycol | 5 wt. % |
| ethanol | 5 wt. % |
| water | 77 wt. % |

The printing operation was also conducted with combinations of the following liquids. Satisfactory discharge could be achieved not only with a liquid of a viscosity higher than 10 cp but also with a liquid of a very high viscosity of 150 cp, which could not be discharged in the conventional head, thereby providing prints of high image quality:

Composition of bubble generating liquid 1

| | |
|---|---|
| ethanol | 40 wt. % |
| water | 60 wt. % |

Composition of bubble generating liquid 2

| | |
|---|---|
| water | 100 wt. % |

Composition of bubble generating liquid 3

| | |
|---|---|
| isopropyl alcohol | 10 wt. % |
| water | 90 wt. % |

Composition of discharge liquid 1 (pigment ink of ca. 15 cp)

| | |
|---|---|
| carbon black | 5 wt. % |
| styrene-acrylic acid-ethyl acrylate copolymer (acid value 140, weight-averaged molecular weight 8000) | 1 wt. % |
| monoethanolamine | 0.25 wt. % |
| glycerine | 69 wt. % |
| thiodiglycol | 5 wt. % |
| ethanol | 3 wt. % |
| water | 16.75 wt. % |

Composition of discharge liquid 2 (55 cp)

| | |
|---|---|
| polyethyleneglycol 200 | 100 wt. % |

Composition of discharge liquid 32 (150 cp)

| | |
|---|---|
| polyethyleneglycol 600 | 100 wt. % |

In case of the aforementioned liquid that is considered difficult to discharge in the conventional head, the low discharge speed increases the fluctuation in the directionality of discharge, resulting in an inferior precision of the dot landing on the recording paper. Also the discharge amount fluctuates because of the unstable discharge. The high-quality image has been difficult to obtain because of these factors. However, in the head configuration of the foregoing examples, the bubble generation can be conducted sufficiently and stably by the use of the bubble generating liquid mentioned above. As a result, there can be achieved improvements in the precision of droplet landing and in the stability of ink discharge amount, whereby the quality of the printed image can be significantly improved.

[Preparation of liquid discharge head]

In the following there will be explained the preparation process of the liquid discharge head of the present invention.

A liquid discharge head as shown in FIG. 2 is prepared by forming the support member 34 for supporting the movable member 31 on the element substrate 1 by patterning for example a dry film, then fixing the movable member 31 to the support member 34 by adhesion or fusion, and adhering the grooved member which bears plural grooves constituting the liquid paths 10, the discharge ports 18 and the recess constituting the common liquid chamber 15, to the element substrate 1 in such a manner that the grooves respectively correspond to the movable members 31.

In the following there will be explained the preparation process of the liquid discharge head of the two-path configuration, as shown in FIG. 10, 22 to 28.

In brief, the head is prepared by forming the walls of the second liquid's liquid paths 16 on the element substrate 1, then mounting the partition wall 30 thereon and mounting thereon the grooved member 50 which bears the grooves constituting the first liquid's liquid paths 14 etc. Otherwise it is prepared, after the formation of the walls of the second liquid's liquid paths 16, by thereon adhering the grooved member 50 already combined with the partition wall 30.

In the following there will be given a detailed explanation on the method of preparation of the second liquid's liquid paths.

FIGS. 29A to 29E are schematic cross-sectional views showing a first example of the preparation method of the liquid discharge head of the present invention.

Figure 29A:
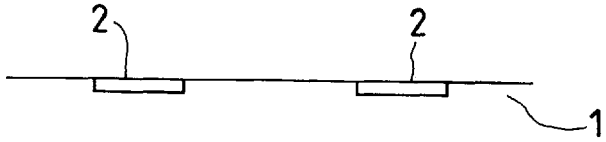
FIGS. 29A, 29B, 29C, 29D and 29E are views showing steps of a manufacturing process for the liquid discharge head of the present invention.

In this example, on the element substrate (silicon wafer) 1, there were prepared electrothermal converting elements including the heat generating members 2 for example of hafnium boride or tantalum nitride as shown in FIG. 29A, with a manufacturing apparatus similar to that employed in the semiconductor device manufacture, and the surface of the element substrate 1 was rinsed for the purpose of improving adhesion with the photosensitive resin in a next step. Further improvement in the adhesion was achieved by surface modification of the element substrate 1 with ultraviolet light-ozone treatment, followed by spin coating of liquid obtained by diluting a silane coupling agent (A189 supplied by Nippon Unika Co.) to 1 wt. % with ethyl alcohol.

Figure 29B:
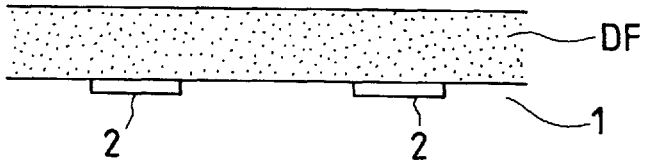

After surface rinsing, an ultraviolet-sensitive resin film DF (dry film Ordil SY-318 supplied by Tokyo Ohka Co.) was laminated on the substrate 1 with thus improved adhesion, as shown in FIG. 29B.

Figure 29C:
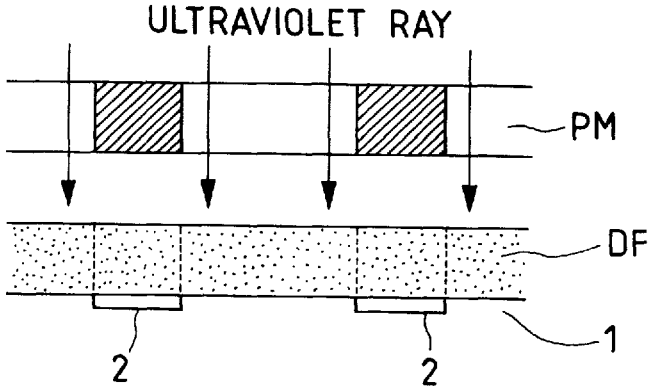

Then, as shown in FIG. 29C, a photomask PM was placed on the dry film DF, and the portions to be left as the walls of the second liquid's liquid paths were exposed to the ultraviolet light through the photomask PM. The exposure step was conducted with an exposure apparatus MPA-600, supplied by Canon Co., with an exposure amount of about 600 mJ/cm$^2$.

Figure 29D:
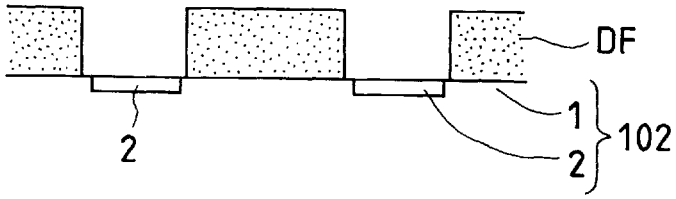
Figure 29E:
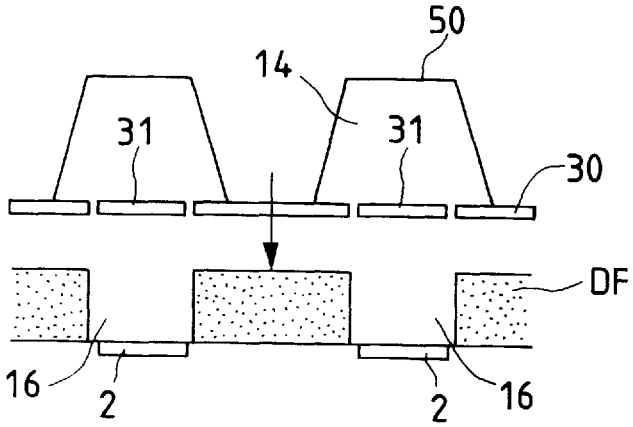

Then, as shown in FIG. 29D, the dry film DF was developed with developer (BMRC-3 supplied by Tokyo Ohka Co.) consisting of a mixture of xylene and butylcellosolve acetate to dissolve the unexposed portions, whereby the exposed and hardened portions were left as the walls of the second liquid's liquid paths 16. The residue remaining on the element substrate 1 was removed by a treatment for ca. 90 seconds in an oxygen plasma ashing apparatus (MAS-800 supplied by Alcantec Co.). Subsequently ultraviolet light irradiation was conducted for 2 hours at 150° C. with an intensity of 100 mJ/cm$^2$ to completely harden the exposed portions.

The above-explained method allowed to uniformly prepare the second liquid's liquid paths in precise manner, on the plural heater boards (element substrates 1) to be divided from the silicon wafer. The silicon substrate was cut and separated, by a dicing machine (AWD-4000 supplied by Tokyo Seimitsu Co.) with a diamond blade of a thickness of 0.05 mm, into respective heater boards 1. The separated heater board was fixed on the aluminum base plate 70 with an adhesive material (SE4400 supplied by Toray Co.)(cf. FIG. 24). Then the heater board 1 was connected with the printed wiring board 71, adhered in advance to the aluminum base plate 70, with aluminum wires (not shown) of a diameter of 0.05 mm.

Then, on thus obtained heater board 1, the adhered member of the grooved member 50 and the partition wall 30 was aligned and adhered by the above-mentioned method. More specifically, after the grooved member having the partition wall 30 and the heater board 1 were aligned and fixed with the spring 78, the ink/bubble generating liquid supply member 80 was fixed by adhesion on the aluminum base plate 70, and the gaps among the aluminum wires and between the grooved member 50, the heater board 1 and the ink/bubble generating liquid supply member 80 were sealed with a silicone sealant (TSE399 supplied by Toshiba Silicone Co.)

The preparation of the second liquid's liquid paths by the above-mentioned method allowed to obtain liquid paths of satisfactory precision, without positional aberration with respect to the heaters of each heater board. The adhesion in advance of the grooved member 50 and the partition wall 30 allows to improve the positional precision between the first liquid's liquid paths 14 and the movable members 31.

Such high-precision manufacturing method stabilizes the liquid discharge and improves the print quality. Also collective manufacture on the wafer enables the manufacture in a large amount, with a low cost.

In the present example, the second liquid's liquid paths were prepared with the ultraviolet-hardenable dry film, but they can also be prepared by laminating and hardening a resin having the absorption band in the ultraviolet region, particularly in the vicinity of 248 nm, and directly eliminating the resin in the portions constituting the second liquid's liquid paths with an excimer laser.

FIGS. 30A to 30D are schematic cross-sectional views showing a second example of the preparation method of the liquid discharge head of the present invention.

Figure 30A:
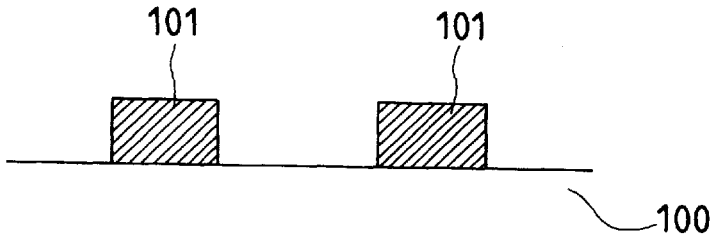
FIGS. 30A, 30B, 30C and 30D are views showing steps of a manufacturing process for the liquid discharge head of the present invention.

In this example, as shown in FIG. 30A, a photoresist of a thickness of 15 $\mu$m was patterned in the form the second liquid's liquid paths on a stainless steel substrate 100.

Figure 30B:
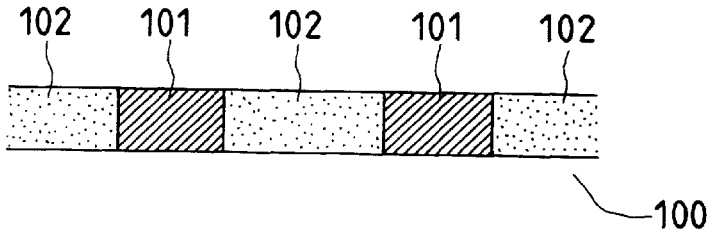

Then, as shown in FIG. 30B, the substrate 100 was subjected to electroplating to grow a nickel layer 102 with a thickness of 15 $\mu$m. The plating bath contained nickel sulfamate, a stress reducing agent (Zero-all supplied by World Metal Co.), an antipitting agent (NP-APS supplied by World Metal Co.) and nickel chloride. The electroplating was conducted by mounting an electrode at the anode side and the patterned substrate 100 at the cathode side, with the plating bath of 50° C. and a current density of 5 A/cm$^2$.

Figure 30C:
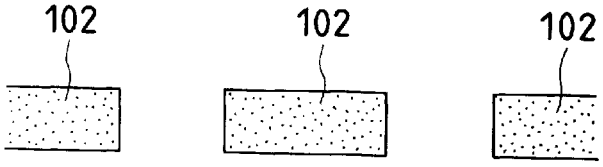

Then, as shown in FIG. 30C, the substrate 100 after the electroplating step was subjected to ultrasonic vibration, whereby the nickel layer 102 was peeled from the substrate 100 in the portions of the second liquid's liquid paths.

Figure 30D:
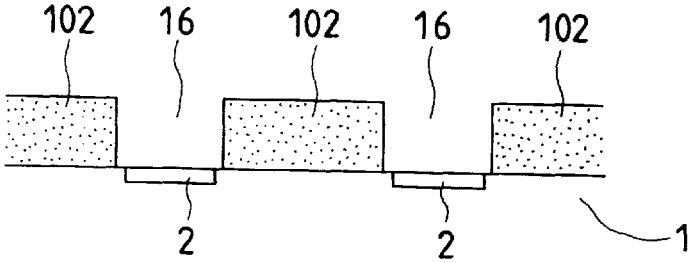

On the other hand, the heater boards bearing the electrothermal converting elements were prepared on a silicon wafer, with a manufacturing apparatus similar to that used in the semiconductor device manufacture, and the wafer was separated into the respective heater boards with the dicing machine, as in the foregoing example. The heater board 1 was adhered to the aluminum base plate 70 on which the printed wiring board was adhered in advance, and the electrical connections were made with the printed wiring board by the aluminum wires (not shown). On the heater board in such state, the nickel layer 102 bearing the second liquid's liquid paths prepared in the foregoing step was aligned and fixed, as shown in FIG. 30D. This fixing only needs to be of a level not causing positional displacement at the adhesion of the cover plate, since the cover plate and the partition wall are fixed by the spring in a subsequent step, as in the foregoing first example.

In this example, the alignment and fixing mentioned above were achieved by coating an ultraviolet-settable adhesive material (Amicon UV-300 supplied by Grace Japan Co.), followed by ultraviolet irradiation of 100 mJ/cm$^2$ for about 3 seconds in an ultraviolet irradiating apparatus.

The method of this example can provide a highly reliable head resistant to alkaline liquids, since the liquid path walls are made of nickel, in addition to the preparation of the highly precise second liquid's liquid paths without positional aberration relative to the heat generating members 2.

FIGS. 31A to 31D are schematic cross-sectional views showing a third example of the preparation method of the liquid discharge head of the present invention.

Figure 31A:
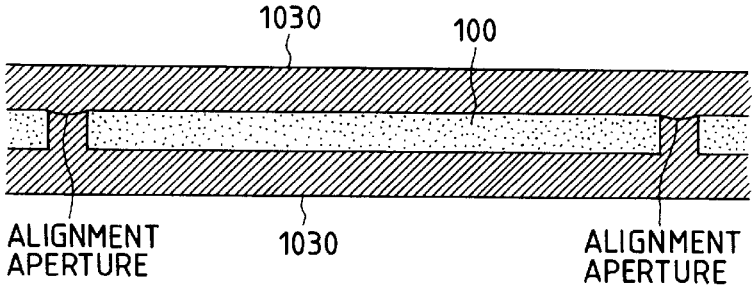
FIGS. 31A, 31B, 31C and 31D are views showing steps of a manufacturing process for the liquid discharge head of the present invention.

In this example, photoresist 1030 (PMERP-AP900 supplied by Tokyo Ohka Co.) was coated on both faces of a stainless steel substrate 100 of a thickness of 15 $\mu$m, having an alignment hole or a mark 100*a*, as shown in FIG. 31A.

Figure 31B:
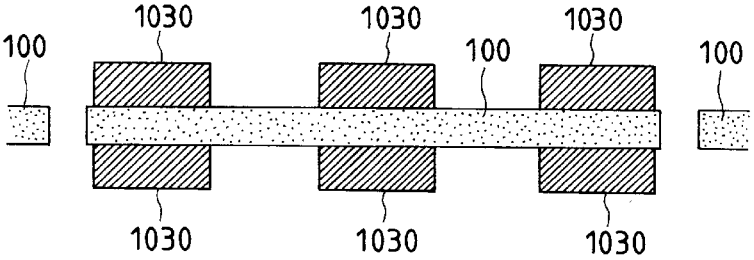

Then, as shown in FIG. 31B, exposure was made with an exposing apparatus (MPA-600 supplied by Canon K. K.), utilizing the alignment hole 100*a* of the substrate 100, with an exposure amount of 800 mJ/cm$^2$, to remove the resist 1030 in the portions where the second liquid's liquid paths are to be formed.

Figure 31C:
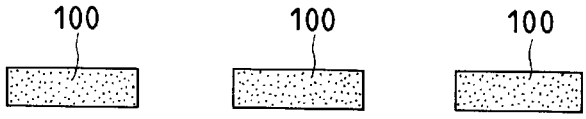

Then, as shown in FIG. 31C, the substrate 100 with the patterned resists on both faces was immersed in an etching bath (aqueous solution of ferric chloride or cupric chloride) to etch off the portions exposed from the resist, and then the resist was stripped off.

Figure 31D:
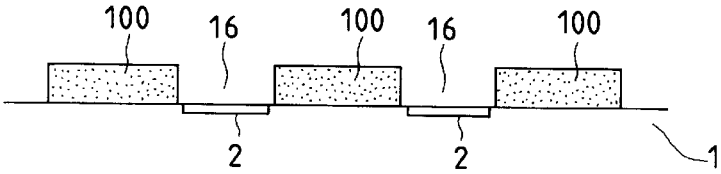

Them, as shown in FIG. 31D, the substrate 100 subjected to the etching step was aligned and fixed on the heater board 1 in the same manner as in the foregoing examples to obtain the liquid discharge head having the second liquid's liquid paths 16.

The method of the present example can form the second liquid's liquid paths 16 in highly precise manner without positional aberration with respect to the heat generating members, and can provide a highly reliable liquid discharge head resistant to acidic and alkaline liquids, since the liquid paths are formed with stainless steel.

As explained in the foregoing, the method of the present example enables highly precise alignment of the electrothermal converting member and the second liquid's liquid path, by forming the walls thereof in advance on the element substrate 100. Also the liquid discharge heads can be prepared in a large number, with a low cost, since the second liquid's liquid paths can be simultaneously prepared on a plurality of the element substrates prior to the cutting of the wafer.

Also the liquid discharge head prepared by the preparation method of the present example can efficiently receive the pressure of the bubble, generated by heat generation of the electrothermal converting member, thereby providing an excellent discharge efficiency, since the heat generating member 2 and the second liquid's liquid path are aligned with a high precision.

Figure 32:
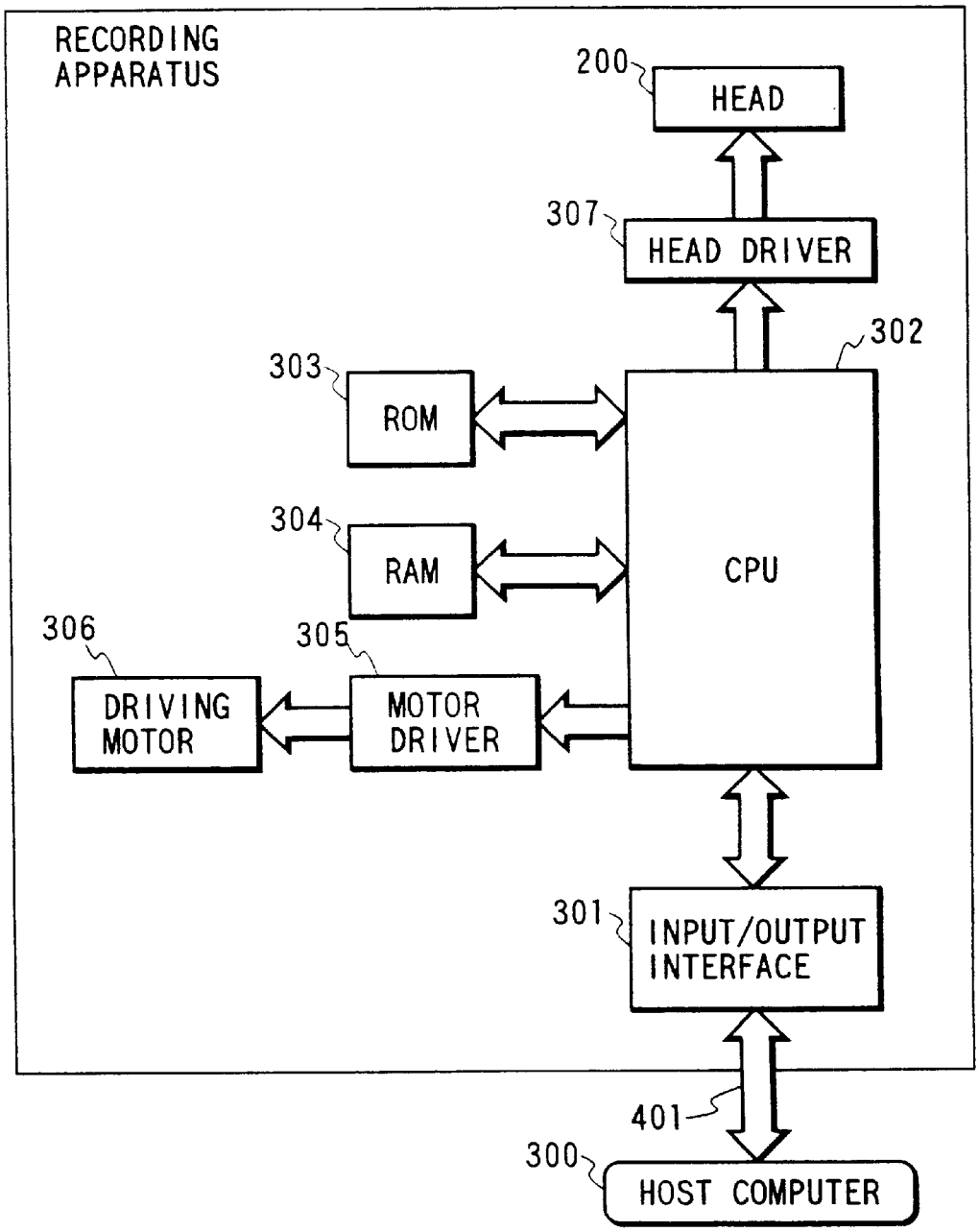
PRIOR ART FIG. 32
FIG. 32 is a block diagram of a recording apparatus.

FIG. 32 is a block diagram of an entire apparatus for executing the ink jet printing, utilizing the liquid discharge method and the liquid discharge head of the present invention.

The recording apparatus receives, from a host computer 300, the print information as a control signal. The print information is temporarily stored in an input interface 301 in the apparatus, and is also converted at the same time into data that can be processed in the apparatus, and such data are supplied to a CPU 302 serving also as head drive signal supply means. The CPU 302 processes thus entered data, based on a control program stored in a ROM 303 and utilizing peripheral units such as a RAM 304, thus converting the data into print data (image data).

The CPU 302 also prepares drive data for driving a drive motor for displacing the printing sheet and the printing head in synchronization with the image data, in order to print the image data in an appropriate position on the printing sheet. The image data and the motor driving data are respectively supplied, through a head driver 307 and a motor driver 305, to a head 200 and a drive motor 306, which are thus driven in controlled timings to form an image.

Examples of the printing medium, usable in such printing apparatus and capable of receiving the discharge of liquid such as ink, include various papers, an OHP sheet, plastics used in the compact disk or the decorative board, textiles, a metal such as aluminum or copper, leather such as cow, pig or artificial leather, timber, plywood, bamboo, ceramics such as a tile and a three-dimensional structured material such as sponge.

Also the above-mentioned printing apparatus include printers for printing on various papers and OHP sheet, apparatus for printing on plastics such as a compact disk, those for printing on a metal, those for printing on leather, those for printing on ceramics, those for printing on a three-dimensional foamed structure such as sponge and those for printing on textiles.

The discharge liquid to be employed in such liquid discharging apparatus can be selected according to the respective printing medium and printing conditions.

[Printing system]

In the following there will be explained an example of the ink jet printing system, employing the liquid discharge head of the present invention and executing printing on a print medium.

Figure 33:
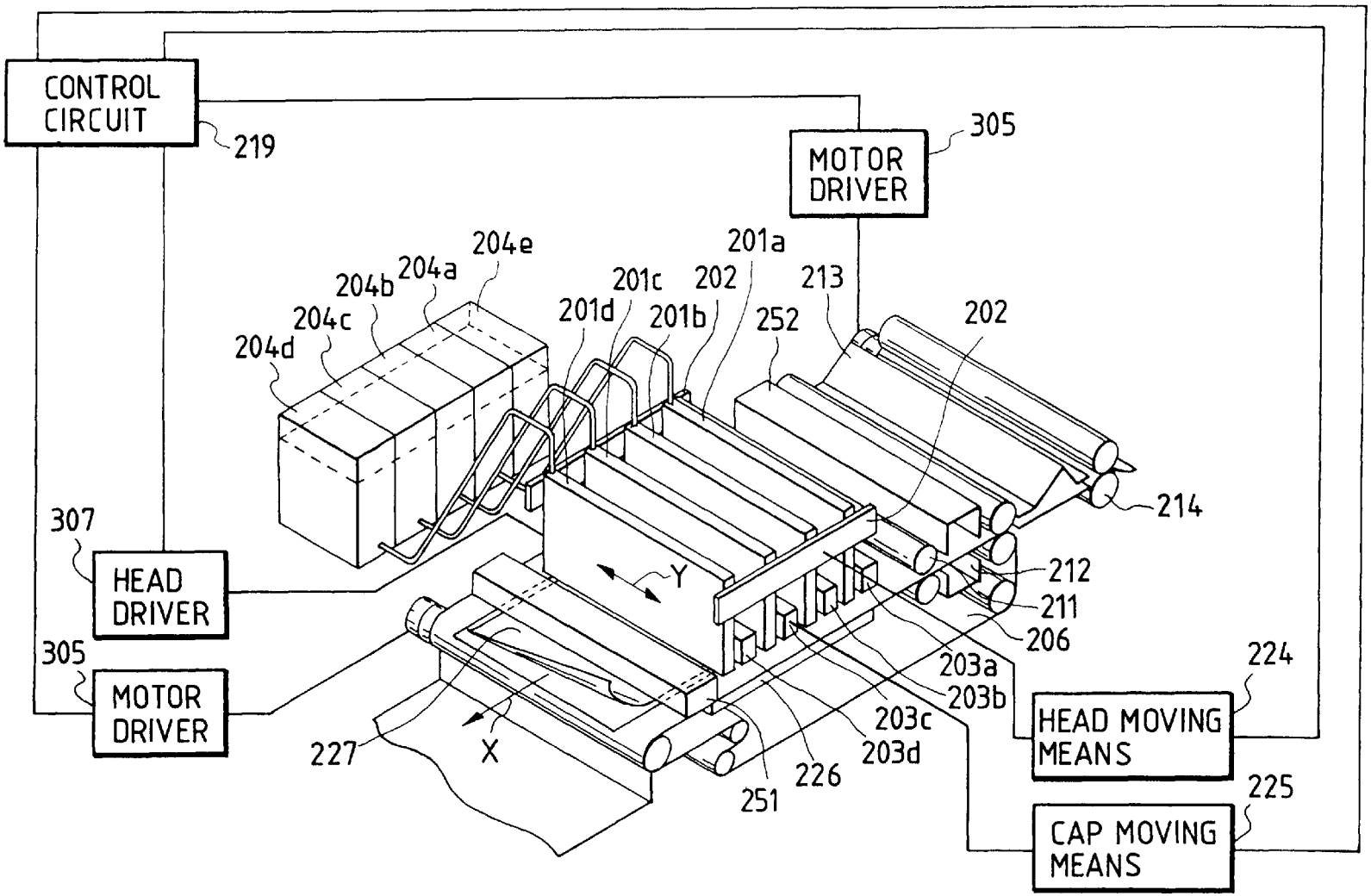
FIG. 33 is a view showing a liquid discharge printing system.
Figure 34A:
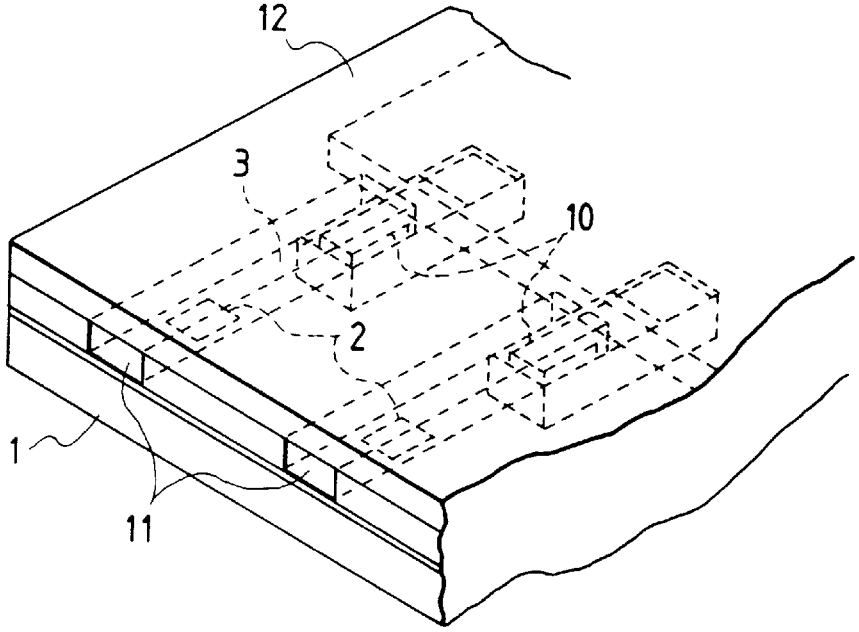
PRIOR ART FIG. 34A
FIGS. 34A and 34B are views showing the liquid path configuration of a conventional liquid discharge head.
Figure 34B:
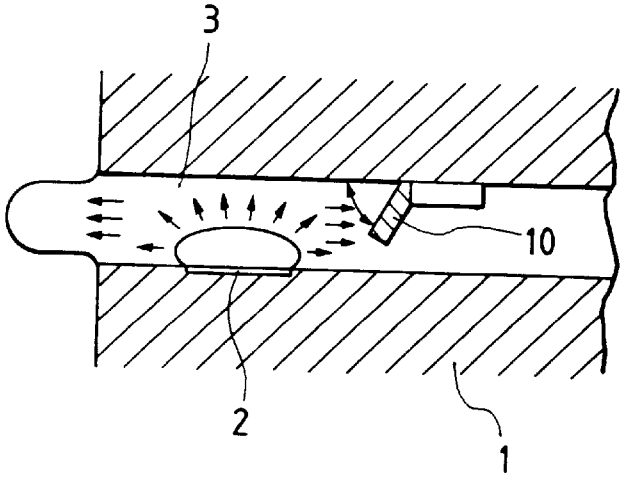
PRIOR ART FIG. 34B

FIG. 33 is a schematic view showing the configuration of an ink jet printing system, employing aforementioned liquid discharge heads 201*a*–201*d* of the present invention, which are of full-line type, having plural discharge ports at a pitch of 360 dpi over a length corresponding to the printable width of a print medium 150, thus having the discharge ports over the entire width (in Y-direction) of the printing area of the printing medium, and four heads 201*a*–201*d*, respectively of yellow (Y), magenta (M), cyan (C) and black (Bk), are supported by a holder 202, with a predetermined interval in the X-direction.

These heads 201*a*–201*d* receive signals from a head driver 307 constituting the drive signal supply means, and are driven by such signals.

The heads 201*a*–201*d* receive, as the discharge liquids, inks of Y, M, C and Bk colors from ink containers 204*a*–204*d*. A bubble generating liquid container 204e contains and supplies the bubble generating liquid to the heads 201*a*–201*d*.

Under the heads 201*a*–201*d* there are provided head caps 203*a*–203*d* which are provided therein with ink absorbent material such as sponge and are adapted to cover the discharge ports of the heads 201*a*–201*d* when the printing operation is not conducted, for the purpose of maintenance.

A conveyor belt 206 constitutes transport means for transporting the print medium. It is maintained along a predetermined path by various rollers, and is driven by a drive roller connected to a motor driver 305.

The ink jet printing system of this example is provided with a pre-processing device 251 and a post-processing device 252 for applying various processes to the print medium before and after the printing, respectively at the upstream and downstream sides of the print medium transport path.

Such pre-process and post-process vary according to the kind of the print medium and that of the inks. For example, for metals, plastics and ceramics, the ink adhesion can be improved by surface activation by ultraviolet and ozone irradiation. Also in a print medium which easily generates static electricity such as plastics, dusts are easily deposited thereon and may hinder satisfactory printing operation. It is therefore advantageous to employ an ionizer as the pre-processing device to eliminate the static electricity from the print medium, thereby avoiding dust deposition. In case of textile printing, for the purpose of preventing the blotting and improving the dyability, there can be executed a pre-process of applying, to the textile, a material selected from an alkaline substance, a water-soluble substance, a synthetic polymer, a water-soluble metal salt, urea and thiourea. The pre-process is not limited thereto but can also be a process of maintaining the print medium at a temperature suitable for printing.

On the other hand, the post-process can for example be a fixation process for accelerating the ink fixation by a heat treatment or ultraviolet irradiation, or washing of a processing material which is applied in the pre-process and remains unreacted in the print medium.

What is claimed is:

1. A liquid discharge head having discharge ports for discharging liquid, first liquid flow paths communicating with the discharge ports, second liquid flow paths provided with heat generating members and communicating with the first liquid flow paths, movable members provided at borders between the first and second liquid flow paths and movable in a direction toward the first liquid flow paths upon driving by the heat generating members, said liquid discharging head comprising:

a grooved member having recessed portions for forming the first liquid flow paths;

a plurality of element substrates, each having a plurality of the heat generating members and a plurality of liquid flow path side walls for forming the second liquid flow paths;

a support member for supporting said plurality of element substrates in an arrangement direction of the heat generating members; and a partition wall having said plurality of movable members, said partition wall being joined between said plurality of element substrates and said grooved member so as to contact said liquid flow path side walls to form said first liquid flow paths and said second liquid flow paths, wherein said partition wall bridges over gaps between adjacent element substrates of said plurality of element substrates.

2. A liquid discharge head according to claim 1, wherein the number of said discharge ports is 500 or larger.

3. A liquid discharge head according to claim 1, wherein said discharge ports are arranged over the entire width of a print area, along the direction of width of the print medium perpendicular to the transport direction thereof.

4. A liquid discharge head according to claim 1, wherein said partition wall is composed of a single material extending over all said element substrates.

5. A liquid discharge head according to claim 1, wherein said partition wall is provided as a plurality of partition wall portions, each partition wall portion respectively corresponding to one of said element substrates.

6. A liquid discharge head according to claim 1, wherein said partition wall is provided as a plurality of partition wall portions, each partition wall portion bridging two adjacent element substrates.

7. A liquid discharge head according to claim 1, further comprising a base plate on which said element substrates are adjoined.

8. A liquid discharge head according to claim 1, wherein a free end of each said movable member is positioned at a downstream side of a center of an area of each respective said heat generating member.

9. A liquid discharge head according to claim 1, wherein said grooved member further includes a first supply path for introducing the liquid into a first common liquid chamber and a second supply path for introducing the liquid into a second common liquid chamber.

10. A liquid discharge head according to claim 9, wherein said second supply path is provided in plural units.

11. A liquid discharge head according to claim 9, wherein a ratio of cross sections of said first supply path and said second supply path is proportional to a ratio of supply amounts of liquids in said first supply path and said second supply path, respectively.

12. A liquid discharge head according to claim 9, wherein said second supply path is adapted to supply said second common liquid chamber with the liquid and passes through said partition wall.

13. A liquid discharge head according to claim 1, wherein liquid supplied to said first liquid path is the same as liquid supplied to said second liquid path.

14. A liquid discharge head according to claim 1, wherein liquid supplied to said first liquid flow paths is different from liquid supplied to said second liquid flow paths.

15. A liquid discharge head according to claim 14, wherein the liquid supplied to said second liquid flow paths is superior in at least one of the properties of lower viscosity, bubble generation and thermal stability, in comparison with the liquid supplied to said first liquid flow paths.

16. A liquid discharge head according to claim 1, wherein each said heat generating member is an electrothermal converting member having a heat generating resistance member capable of heat generation by receiving an electrical signal.

17. A liquid discharge head according to claim 16, wherein said electrothermal converting member includes a protective film on said heat generating resistance member.

18. A liquid discharge head according to claim 16, wherein each said element substrate has wirings thereon for transmitting the electric signal to said electrothermal converting member and a functional element for selectively supplying said electrothermal converting member with the electrical signal.

19. A liquid discharge head according to claim 1, wherein each said second liquid flow path comprises a chamber-shaped portion where said bubble generation takes place or said heat generating member is provided.

20. A liquid discharge head according to claim 1, wherein each said second liquid flow path comprises a constricted portion at an upstream side of the bubble generating area or the heat generating member.

21. A liquid discharge head according to claim 1, wherein a distance from a surface of each said heat generating member to each respective said movable member is 30 $\mu$m or less.

22. A liquid discharge head according to claim 1, wherein the liquid discharged from said discharge ports is ink.

23. A liquid discharge apparatus comprising:

a liquid discharge head according to claim 1; and drive signal supply means for supplying a drive signal for causing said liquid discharge head to discharge liquid.

24. A liquid discharge apparatus comprising:

a liquid discharge head according to claim 1; and print medium transport means for transporting a print medium for receiving the liquid discharged from said liquid discharge head.

25. A liquid discharge apparatus according to claim 23 or 24 for printing by discharging ink from said liquid discharge head and depositing ink on paper.

26. A liquid discharge apparatus according to claim 23 or 24 for printing by discharging print liquid from said liquid discharge head and depositing said print liquid on a textile.

27. A liquid discharge apparatus according to claim 23 or 24 for printing by discharging print liquid from said liquid discharge head and depositing said print liquid on plastics.

28. A liquid discharge apparatus according to claim 23 or 24 for printing by discharging print liquid from said liquid discharge head and deposition said print liquid on a metal.

29. A liquid discharge apparatus according to claim 23 or 24 for printing by discharging print liquid from said liquid discharge head and depositing said print liquid on a timber.

30. A liquid discharge apparatus according to claim 23 or 24 for printing by discharging print liquid from said liquid discharge head and depositing print liquid on leather.

31. A liquid discharge apparatus according to claim 23 or 24 for color printing by discharging print liquids of plural colors from said liquid discharge head and depositing said print liquids of plural colors on a print medium.

32. A liquid discharge apparatus according to claim 23 or 24 wherein a plurality of said discharge ports are arranged over the entire width of printable area of the print medium.

33. A printing system comprising:

a liquid discharge apparatus according to claim 23 or 24; and a post-process device for accelerating the fixation of said liquid on the print medium after the printing.

34. A printing system comprising:

a liquid discharge apparatus according to claim 23 or 24; and a pre-process device for increasing the fixation of said liquid on the print medium before the printing.

35. A liquid discharge head according to claim 1, capable of realizing uniform discharge distribution in all of the discharge ports within the head, by varying, at least in the boundary areas between said substrates, at least one condition selected from a group consisting of:

at least one of the number, dimension and position of the heat generating members for generating said bubble;

at least one of the dimension and position of said movable members;

a dimension of said discharge ports; and at least one of a dimension and shape of the first or second liquid flow paths in which said liquids flow.

* * * * *

UNITED STATES PATENT AND TRADEMARK OFFICE

CERTIFICATE OF CORRECTION

PATENT NO. : 6,302,518 B1
DATED : October 16, 2001
INVENTOR(S) : Kiyomitsu Kudo et al.

It is certified that error appears in the above-identified patent and that said Letters Patent is hereby corrected as shown below:

Title page,
Item [56] FOREIGN PATENT DOCUMENTS,
"10-63185 3/1989 (JP)" should read -- 1-063185 3/1989 (JP) --.

Column 7,
Line 19, "iD" should read -- ID --; and
Line 64, "a." should read -- a --.

Column 8,
Line 14, "on of" should be deleted; and
Line 17, "to" (2nd occurrence) should be deleted.

Column 9,
Line 39, "is" should read -- in --.

Column 11,
Line 8, "Liquid" should read -- liquid --.

Column 12,
Line 20,, "areal" should read -- area --.

Column 20,
Line 21, "121," should read -- 12A, --.

Column 26,
Line 53, "liqid's" should read -- liquid's --.

Column 27,
Line 7, "suply" should read -- supply --;
Line 11, "positiooned" should read -- positioned --;
Line 36, "1a" -- 1 -- should be boldfaced.

Column 28,
Line 44, "pratition" should read -- partition --.

UNITED STATES PATENT AND TRADEMARK OFFICE

CERTIFICATE OF CORRECTION

PATENT NO. : 6,302,518 B1
DATED : October 16, 2001
INVENTOR(S) : Kiyomitsu Kudo et al.

It is certified that error appears in the above-identified patent and that said Letters Patent is hereby corrected as shown below:

Column 30,
Line 11, "power." should read -- power. Composition of dye ink (viscosity 2cp). --.

Column 32,
Line 14, "ashing" should read -- washing --.

Column 33,
Line 59, "Them," should read -- Then, --.

Signed and Sealed this

Fourteenth Day of May, 2002

*Attest:*

*Attesting Officer*

JAMES E. ROGAN
*Director of the United States Patent and Trademark Office*